US005873206A

United States Patent [19]

Roberts

[11] Patent Number: 5,873,206

[45] Date of Patent: Feb. 23, 1999

[54] INTERLOCKING BUILDING BLOCK

[75] Inventor: Peter A. Roberts, Alfred Station, N.Y.

[73] Assignee: PolyCeramics, Inc., Alfred, N.Y.

[21] Appl. No.: 851,702

[22] Filed: May 6, 1997

Related U.S. Application Data

[63] Continuation-in-part of Ser. No. 710,004, Sep. 11, 1996, which is a continuation-in-part of Ser. No. 399,277, Mar. 16, 1995, Pat. No. 5,560,151.

[51] Int. Cl.[6] ..... E04B 1/04; E04B 1/32

[52] U.S. Cl. ..... 52/245; 52/81.1; 52/81.4; 52/81.5; 52/249; 52/604; 52/608; 52/DIG. 10

[58] Field of Search ..... 52/245, 249, DIG. 10, 52/608, 604, 81.4, 81.5, 786, 81.1

[56] References Cited

U.S. PATENT DOCUMENTS

| | | | |
|---|---|---|---|
| 3,953,009 | 4/1976 | Kan | 52/249 X |
| 4,522,006 | 6/1985 | Plikuhn | 52/245 X |
| 5,170,598 | 12/1992 | Kadar et al. | 52/245 X |
| 5,261,194 | 11/1993 | Roberts | 52/285.1 X |
| 5,329,737 | 7/1994 | Roberts et al. | 52/245 |
| 5,560,151 | 10/1996 | Roberts | 52/DIG. 10 X |

*Primary Examiner*—Christopher Kent
*Attorney, Agent, or Firm*—Howard J. Greenwald

[57] ABSTRACT

An arcuate building structure containing at least three five-sided building blocks, at least three six-sided building blocks, and said five-sided and six-sided building blocks are independently able to provide means for connecting one of said five-sided building blocks to at least one of said six-sided building blocks. The top side of the six-sided block has a substantially triangular shape, and is substantially parallel to the bottom side of the six-sided block. The front side of the six-sided block has a substantially trapezoidal shape with a top edge, a bottom edge, a right edge, and a left edge. The right edge and the left edge have equal lengths and form equal angles with the bottom edge. The back side of the six-sided block has a substantially triangular shape with at least two sides equal in length to each other. The left and right sides of the six-sided block are congruent with each other, are in the shape of a parallelogram, and contain a recess and projection within their borders. The five-sided block contains a top side with a substantially rectangular shape and a recess and projection disposed within such shape, a left and right side (each of which are congruent with the left and right sides of the six-sided block), and a front and back side (each of which are congruent with each other and with the back side of the six-sided block).

12 Claims, 46 Drawing Sheets

FIG. 6
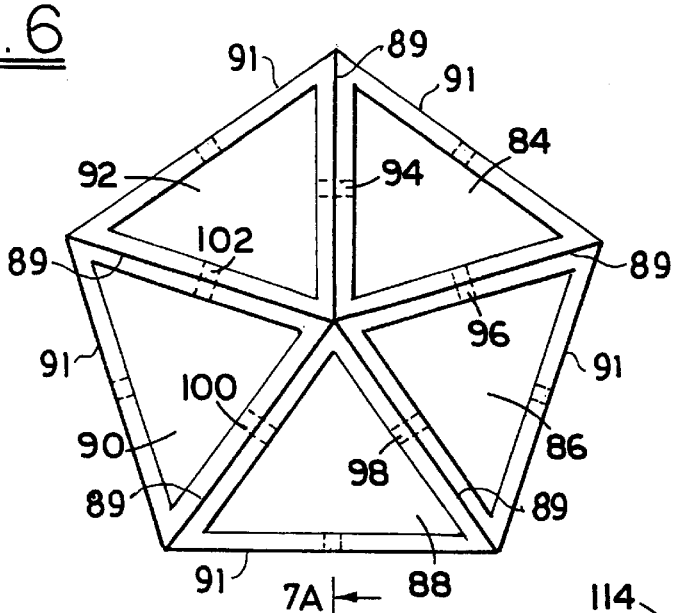
FIG. 7
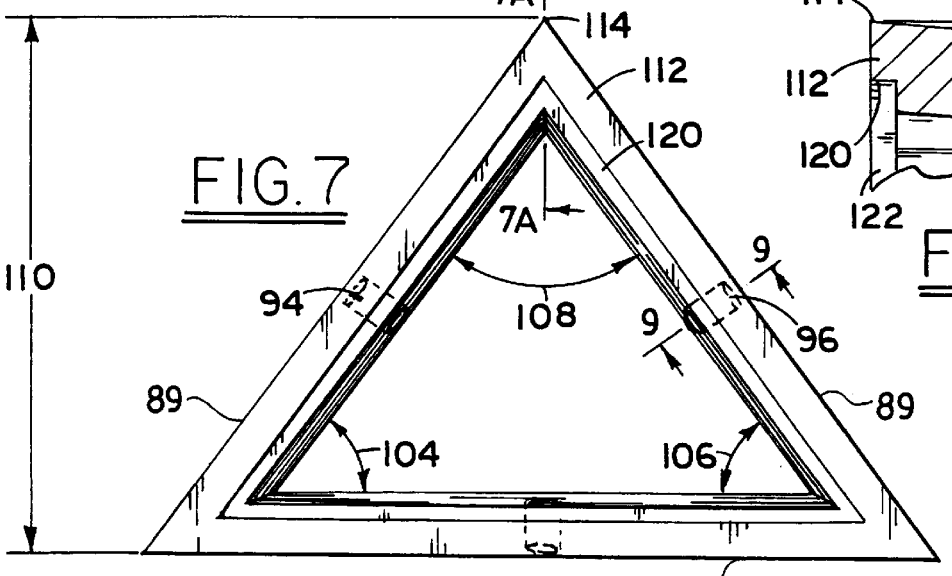
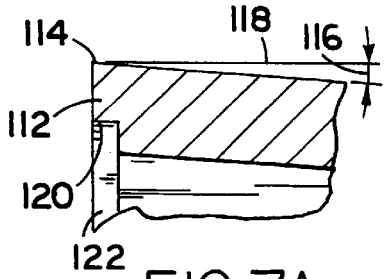
FIG. 7A
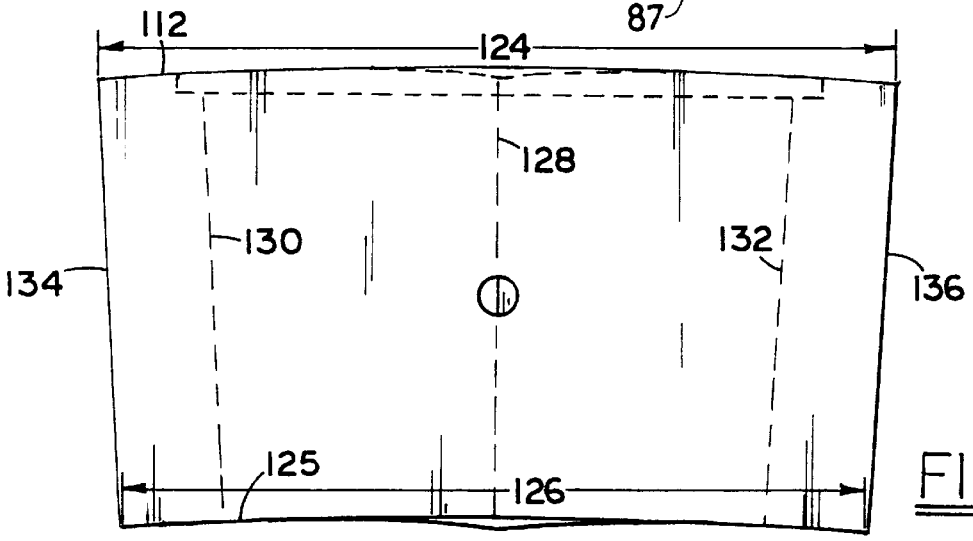
FIG. 8

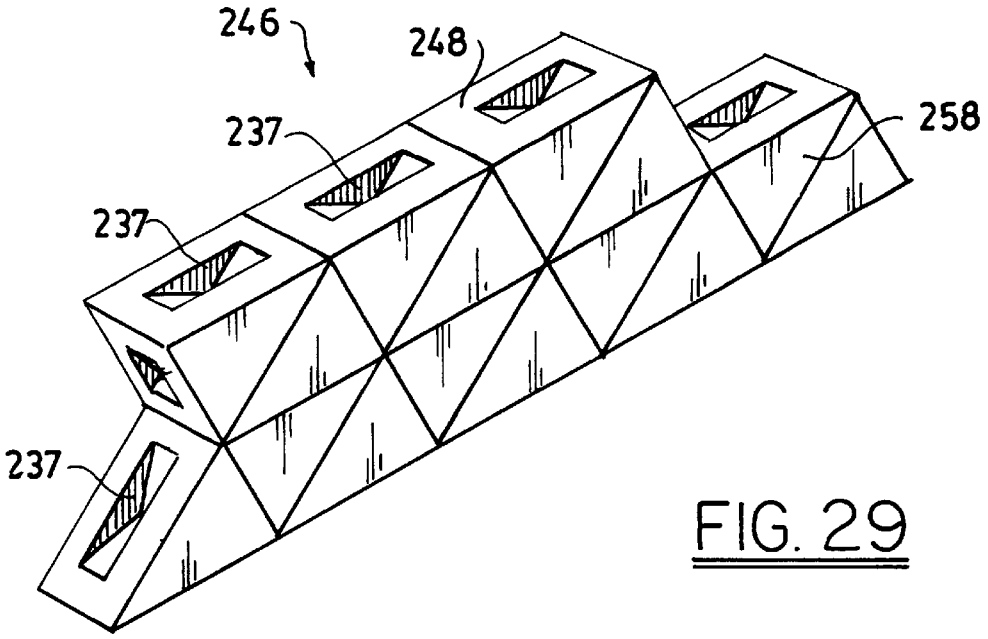
FIG. 29
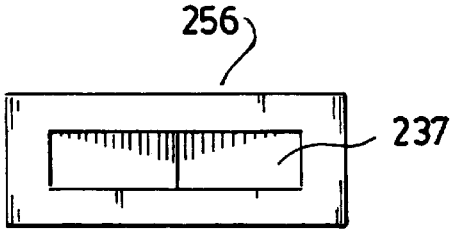
FIG. 33
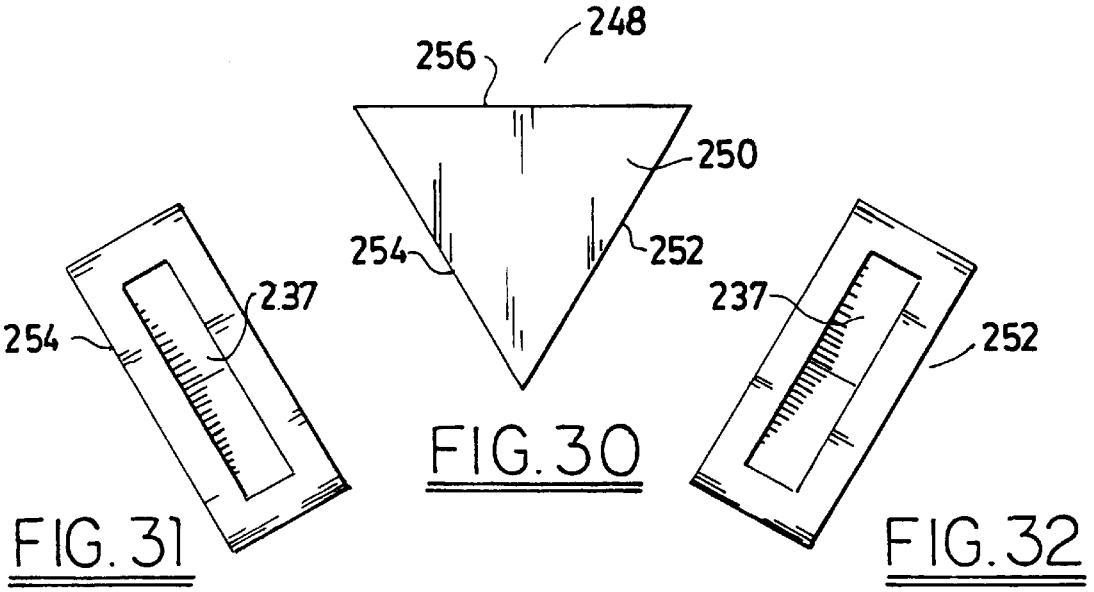
FIG. 30
FIG. 31
FIG. 32

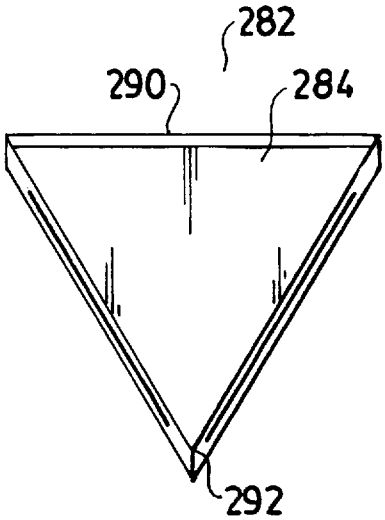
FIG. 38
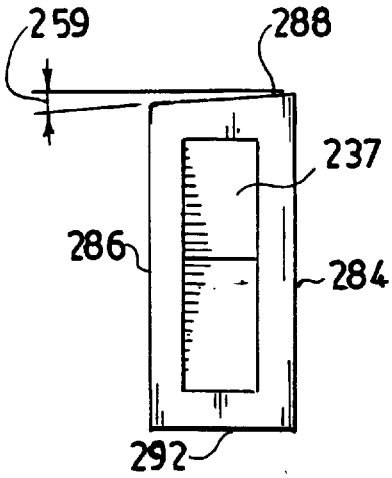
FIG. 39
FIG. 40
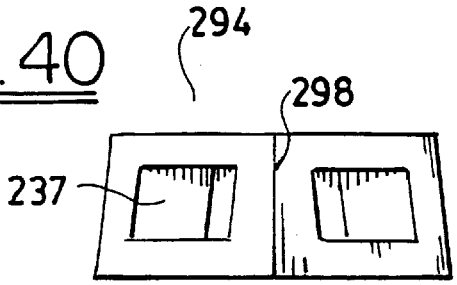
FIG. 41
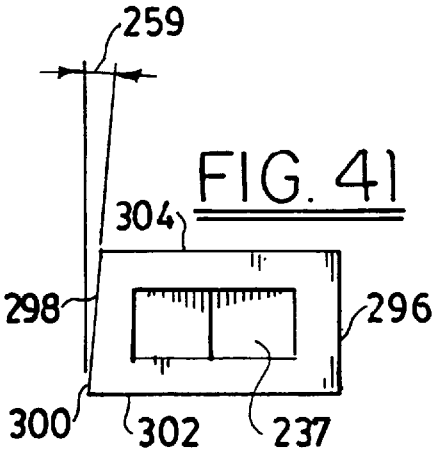
FIG. 42
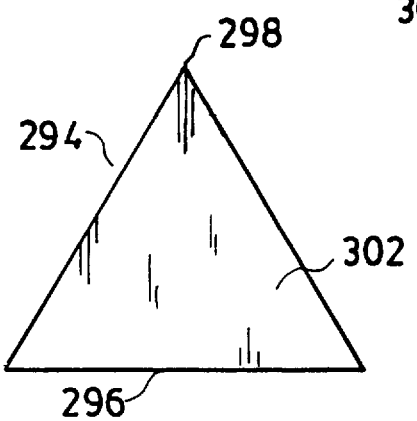

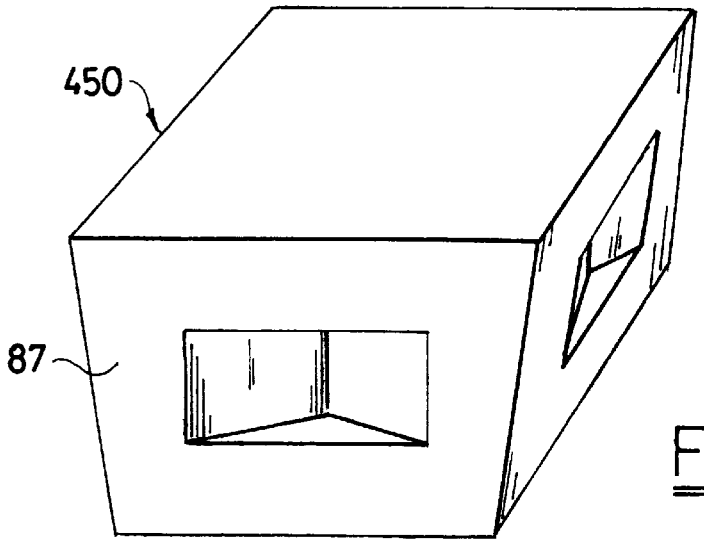
FIG.70
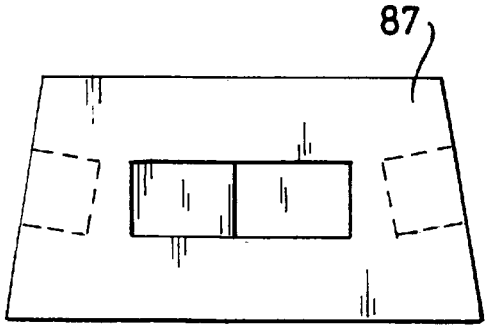
FIG.71
FIG.72
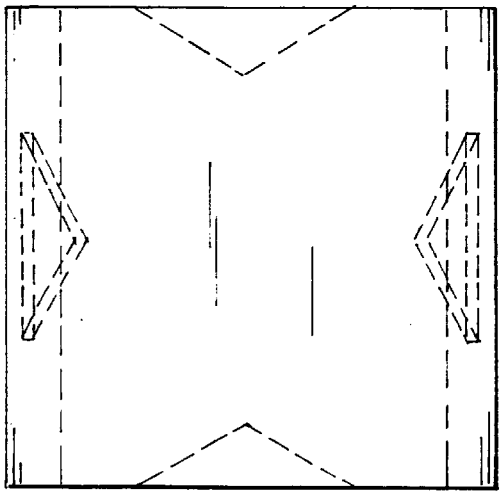
FIG.73
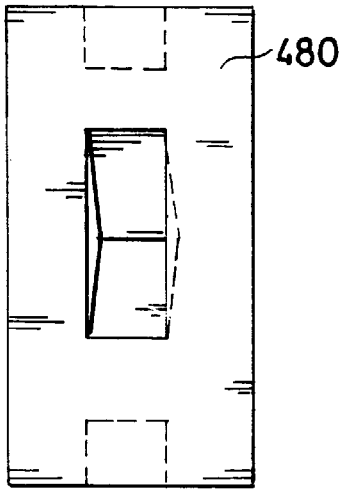

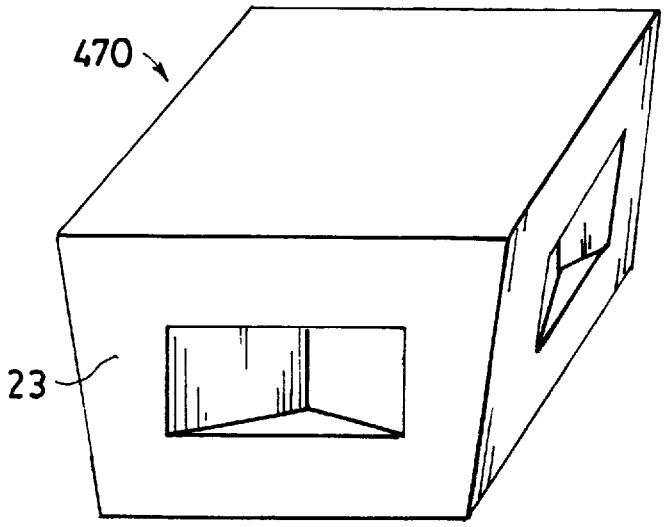
FIG.74
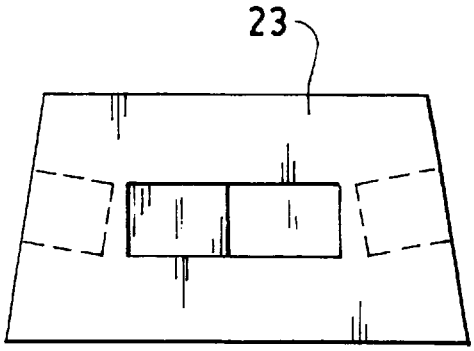
FIG.75
FIG.76
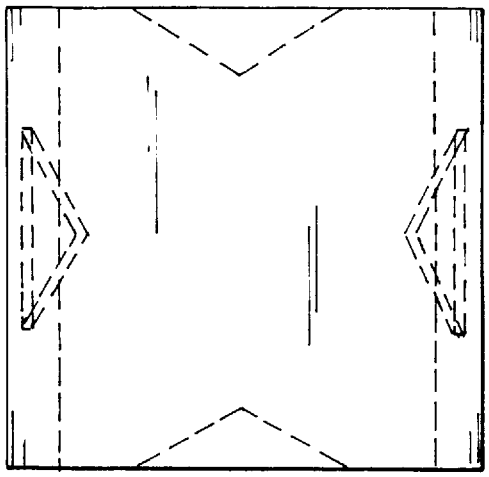
FIG.77
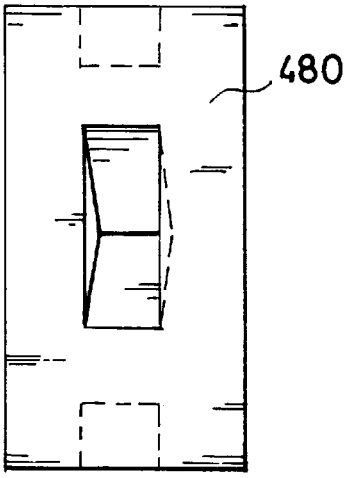

FIG. 95
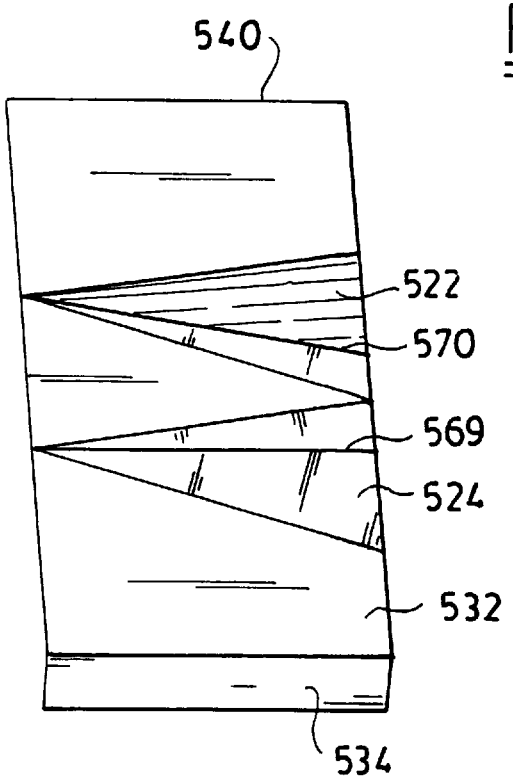
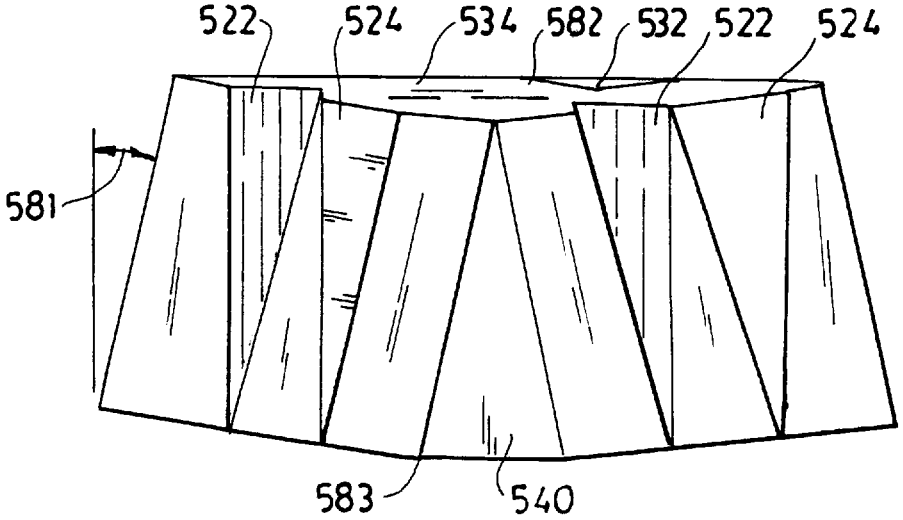
FIG. 96

INTERLOCKING BUILDING BLOCK

CROSS-REFERENCE TO RELATED PATENT APPLICATIONS

This is a continuation-in-part of applicant's copending patent application U.S. Ser. No. 08/710,004, filed Sep. 11, 1996, which was a continuation-in-part of application Ser. No. 08/399,277, filed on Mar. 6, 1995, now U.S. Pat. No. 5,560,151.

FIELD OF THE INVENTION

Building blocks which are unit shapes which are to be joined together into arcuate structures, which interlock without an independent key, and which can be made from a two piece mold without an undercut.

BACKGROUND OF THE INVENTION

In U.S. Pat. Nos. 5,261,194, 5,329,737, and 5,560,151, a building structure is disclosed which is comprised of building blocks which are substantially triangular; the entire description of each of these United States patents is hereby incorporated by reference into this specification. This prior art building structure contains building blocks which require an independent key.

Furthermore, in this prior art structure, the key way, or recess, creates an undercut in the block which complicates its manufacture.

It is an object of this invention to provide a building block which can be more readily assembled than prior art building blocks.

It is another object of this invention to provide a building block which can be readily locked into tangential position of a radial structure upon assembly.

It is another object of this invention to provide a single type of building block which can be used variously for the construction of right circular cylinders, vaulted arches, straight vertical walls with vertical reinforcing ribs, and walls which are inclined slightly from the vertical, for use as a structural retaining wall.

It is another object of this invention to provide a novel interlocking radial structure which does not have an independent key and which can be made from a simple two piece mold without undercuts.

SUMMARY OF THE INVENTION

In accordance with this invention, there is provided a building structure comprised of a first building block and a second building block removably attached to each other. These blocks can be used to construct a spherical section, such as a dome, which is a truncated icosahedron.

There is also provided a number of building structures comprised of a third type of building block removably attached to itself.

BRIEF DESCRIPTION OF THE DRAWINGS

The present invention will be more fully understood by reference to the following detailed description thereof, when read in conjunction with the attached drawings, wherein like reference numerals refer to like elements, and wherein:

FIG. 6 is a top view of a pentagonal section of the dome of FIG. 1.

FIG. 7 is an end view of a pentagonal building block of this invention.

FIG. 7A is a side view of a corner of the block of FIG. 7.

FIG. 8 is a side view of the block of FIG. 7.

FIG. 29 is a perspective view of a straight wall structure of applicants' invention.

FIG. 30 is a front view of the structure of FIG. 29.

FIGS. 31 and 32 are each side views of the structure of FIG. 29.

FIG. 33 is a top view of the structure of FIG. 29.

FIG. 38 is a front view of one of the blocks used in the structure of FIG. 34.

FIG. 39 is a side view of the block of FIG. 38.

FIG. 40 is a top view of a section of the structure of FIG. 34.

FIG. 41 is an side view of the structure of FIG. 40.

FIG. 42 is a front view of the structure of FIG. 40.

FIG. 70 is a perspective view of another building block of this invention.

FIG. 71 is an end view of the block of FIG. 70.

FIG. 72 is a top view of the block of FIG. 70.

FIG. 73 is a side view of the block of FIG. 70.

FIG. 74 is a perspective view of another building block of this invention.

FIG. 75 is an end view of the block of FIG. 74.

FIG. 76 is a top view of the block of FIG. 74.

FIG. 77 is a side view of the block of FIG. 74.

FIG. 95 is a side view of a first preferred block which may be used to construct the structure of FIG. 17.

FIG. 96 is a top view of a first preferred block which may be used to construct the structure of FIG. 17.

FIG. 107B is a side view of another preferred embodiment of the vertical wall shown in FIG. 107.

DESCRIPTION OF THE PREFERRED EMBODIMENTS

In the first portion of this specification, applicant will describe a building block suitable for making a geodesic dome, a process for making such building block and such dome, and the geodesic dome so made. In the remainder of this specification, applicant will describe other building structures.

Figure 1:
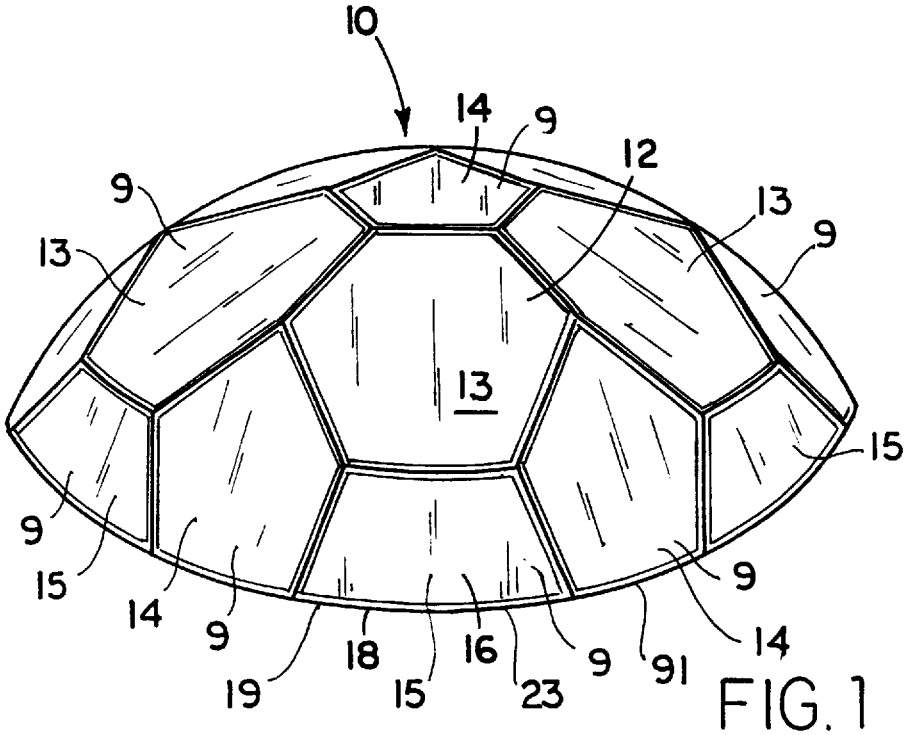
FIG. 1 is a perspective view of one embodiment of the geodesic dome of this invention.

Referring to FIG. 1, the geodesic dome 10 of this invention is shown. Prior to describing this dome, certain terms will be defined. Each of these terms is also defined, and explained, in U.S. Pat. No. 2,682,235 of Fuller, the disclosure of which is hereby incorporated by reference into this specification.

The term geodesic, as used in this specification, refers to of or pertaining to great circles of a sphere, or of arcs of such circles; as a geodesic line, hence a line which is a great circle or arc thereof; and as a geodesic pattern hence a pattern created by the intersections of great circle lines or arcs, or their cords.

The term spherical, as used in this specification, refers to a structure having the form of a sphere. It includes bodies having the form of a portion of a sphere. It also includes polygonal bodies whose sides are so numerous that they appear to be substantially spherical.

The term icosahedron, as used in this specification, describes a polyhedron of twenty faces.

The term spherical icosahedron refers to an icosahedron which has been "exploded" onto the surface of a sphere. It bears the same relationship to an icosahedron as a spherical triangle bears to a plane triangle. The sides of the faces of the spherical icosahedron are all geodesic lines.

The term equilateral refers to a structure in which all of the sides are approximately equal.

The term modularly divided refers to a structure which is divided into modules, or units.

Referring again to FIG. 1, and in the preferred embodiment illustrated, it will be seen that geodesic dome 10 consists essentially of three building units. The first such unit is substantially hexagonal building unit 12. The second such unit is substantially pentagonal building unit 14. The third such unit is substantially trapezoidal building unit 16. These units are joined to each other to define a substantially spherical shape.

Referring again to FIG. 1, it will be seen that the geodesic dome 10 is comprised of substantially planer areas 9 which, in this embodiment, tend to make dome 10 weaker in the center of each such planar area 9. In another embodiment, described later in this specification, the use of a different building block substantially avoids the presence of such planar areas 9.

Referring again to FIG. 1, one or more of the sides of building units 12, 14, and 16 are curved; see, for example, side 18 of building unit 16. Thus, inasmuch as side 18 is curved, building unit 16 is substantially trapezoidal. By the same token, inasmuch as each of building units 12 and 14 have at least one curved side, they are substantially hexagonal and substantially pentagonal, respectively.

The geodesic dome illustrated in FIG. 1 is similar in some respects to the geodesic dome shown in U.S. Pat. No. 3,043,054 of Schmidt, the disclosure of which is hereby incorporated by reference into this specification. However, the geodesic dome of Schmidt includes an arcuate span of greater than 180 degrees on any vertical cross section thereof. By comparison, the geodesic dome illustrated in FIG. 1 of this specification includes an arcuate span of less than 180 degrees on any vertical cross section thereof. It is preferred that such geodesic dome include an arcuate span of less than 175 degrees on any vertical cross section thereof. In an even more preferred embodiment, such geodesic dome includes an arcuate span of less than about 171 degrees on any vertical cross section thereof.

Referring again to FIG. 1, in one preferred embodiment, geodesic dome 10 includes an arcuate span of from about 168 to about 175 degrees on any vertical cross section there of.

Figure 2:
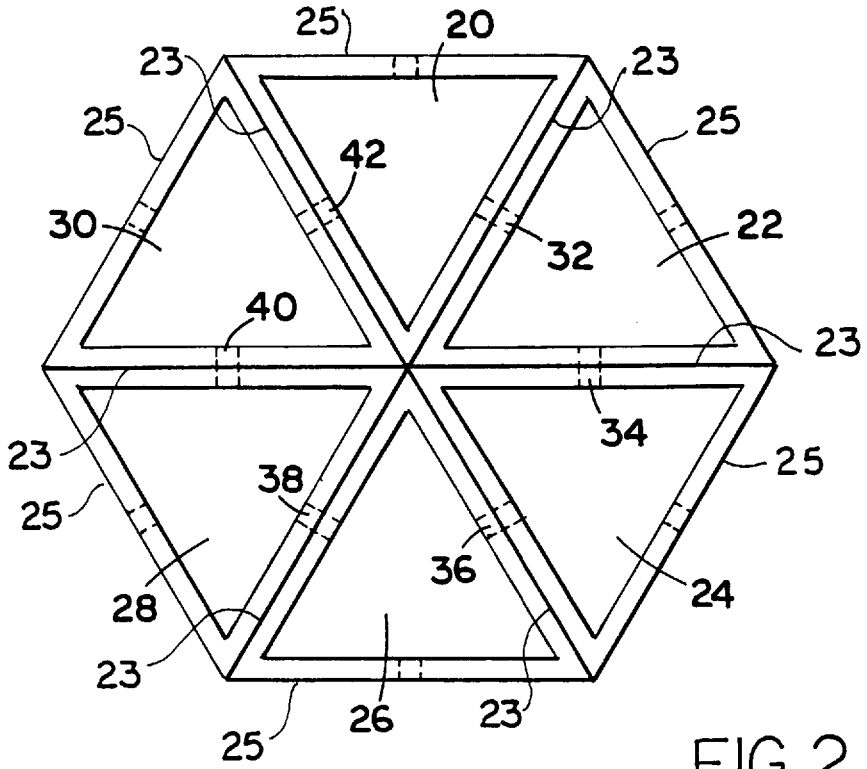
FIG. 2 is a top view of one hexagonal section of the dome of FIG. 1.

FIG. 2 is a top view of hexagonal building structure 12. Referring to FIG. 2, it will be seen that hexagonal building unit 12 is comprised of six substantially equilateral building blocks 20, 22, 24, 26, 28, and 30 which, preferably, are joined to each other by fasteners inserted through holes 32, 34, 36, 38, 40, and 42.

In one of the preferred embodiments illustrated in FIG. 2, each of building blocks 20, 22, 24, 26, 28, and 30 is in the shape of an equilateral triangle, and each of said blocks is substantially congruent with each of the other blocks. Thus, in this embodiment, all of the sides of said triangle are equal.

In another preferred embodiment illustrated in FIG. 2, each of building blocks 20, 22, 24, 26, 28, and 30 is in the shape of an isosceles triangle wherein at least one of the sides of such triangle is not equal to the other two sides. In this embodiment, each of the isosceles triangles making up the hexagonal structure 12 are congruent, and each of the isosceles triangles making up the pentagonal structure 14 (see FIG. 1) are also congruent; however, the isosceles triangles making up the hexagonal structure are not congruent to the isosceles triangles making up the pentagonal structure. Thus, in this second preferred embodiment, a building structure is defined in which a first isosceles triangle structure is joined to a second isosceles structure with which it is congruent (within the hexagonal or pentagonal building structure) and, additionally, to a third isosceles triangle structure with which it is not congruent. In this embodiment, the flat areas 9 are avoided, and the resulting structure is substantially spherical and stronger. In this latter embodiment, wherein the building structure 10 is comprised of two different isosceles triangles, it will be appreciated by those skilled in the art that the geodesic beveled equilateral block which constructs a hexagon (FIG. 3) may be proportionated such that the interior faces 23 (see FIG. 2) are preferably slightly longer than the outer faces 25 (see FIG. 2), being at least about two percent greater than said outer faces 25. Thus, for example, if the length of the outer face 25 is proportionally equal to 1.0, then the length of the interior faces 23 will be proportionally equal to from about 1.01 to about 1.03 and, preferably, be about 1.02. The structure so produced will create a peak in the center of the hexagonal building structure 12 (see FIG. 1) which is closer to the surface of the sphere described by this structure.

Furthermore, in this latter embodiment utilizing isosceles-shaped blocks, the isosceles building block which constructs a pentagon (see FIG. 6) may be proportioned such that the interior faces 89 are slightly shorter than the exterior faces 91. If the length of the outer faces 91 (FIG. 2,21) is proportionally equal to 1.0, then the inner faces 89 will be proportionally equal to from about 0.8 to about 0.9 and, preferably, be about 0.86. This will produce a peak in the center of the pentagon which is closer to the surface of the sphere described by this structure.

Referring again to FIG. 1, it will be apparent to those skilled in the art that any of the triangular shapes defined by said building blocks may be subdivided into smaller triangular shapes. Thus, by way of illustration, triangular building block 20 defines a triangle which might be made up of four congruous smaller triangles, and each of said four congruous smaller triangles similarly might be subdivided into four yet smaller triangles, etcetera ad infinitum.

Figure 3:
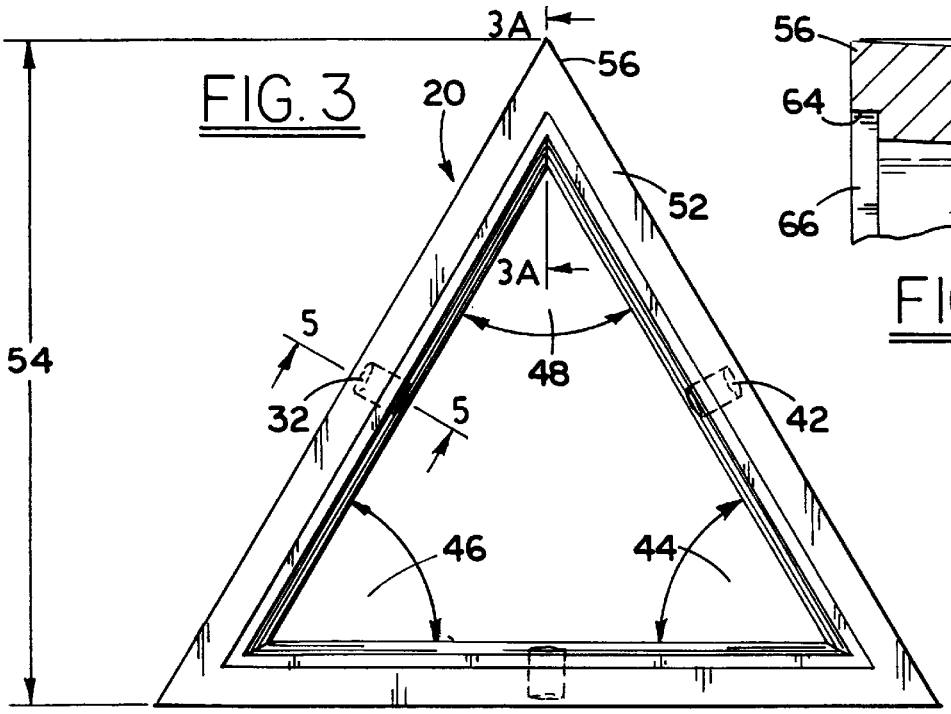
FIG. 3 is an end view of one hexagonal building block of this invention.

FIG. 3 is an end view of building block 20. Referring to FIG. 3, in the embodiment in which the building block is shaped like an equilateral triangle, each of the angles 44, 46, and 48 are substantially 60 degrees.

However, and referring again to FIG. 3, where the building block 20 is shaped like an isosceles triangle, the angles 44, 46, and 48 will not all be equal.

The building block 20 of FIG. 3 may be used to produce the hexagonal building structure 12 (see FIG. 1). In the embodiment where it is shaped like an isosceles triangle, such a building block 20 will be shaped such that angles 44 and 46 will be equal to each other and will be from about 60.0 to about 60.8 degrees and, preferably, about 60.7 degrees.

Without wishing to be bound to any particular theory, applicant believes that a building structure made from these two dissimilar isosceles triangle shaped blocks possesses substantially more earthquake resistance than do structures made from similar equilateral triangles.

In the remainder of this specification, for simplicity of representation, reference will be made to structures containing said equilateral triangle shapes, it being understood that the comments relating to such structures are equally applicable to the devices containing dissimilar isosceles triangle shapes.

Referring again to FIG. 1, and in one preferred embodiment, building block 20 (and each of the other building blocks 22, 24, 26, 28, and 30) are comprised of at least 90 weight percent of ceramic material. As used in this specification, the term ceramic material refers to a solid material produced from essentially inorganic, non-metallic substances which is preferably formed simultaneously or subsequently matured by the action of heat. See, e.g., A.S.T.M. C-242-87, "Definitions of Terms Relating to Ceramic Whitewares and Related Products."

In one embodiment, the ceramic material is formed by the mixing of organic binder with a moist earth. The mass so mixed is compacted into the desired shape and used without sintering.

By way of illustration, the ceramic material used in the building block 20 may be concrete. As is known to those skilled in the art, the term concrete refers to a composite material that consists essentially of a binding medium within which are embedded particles or fragments of aggregate.

By way of further illustration, the ceramic material used in the building block 20 is a ceramic whiteware, that is a ceramic body which fires to a white or ivory color. Methods of preparing ceramic whiteware bodies are well known to those skilled in the art and are described, e.g., in U.S. Pat. No. 4,812,428 of Kohut, the description of which is hereby incorporated by reference into this specification.

In another preferred embodiment, the ceramic material is basic brick. As is known to those skilled in the art, basic brick is a refractory brick which is comprised essentially of basic materials such as lime, magnesia, chrome ore, or dead burned magnesite, which reacts chemically with acid refractories, acid slags, or acid fluxes at high temperatures.

In yet another embodiment, the ceramic material is refractory. As is known to those skilled in the art, a refractory material is an inorganic, nonmetallic material which will withstand high-temperatures; such materials frequently are resistant to abrasion, corrosion, pressure, and rapid changes in temperature. By way of illustration, suitable refractories include alumina, sillimanite, silicon carbide, zirconium silicate, and the like.

By way of further illustration, the ceramic material may be a structural ceramic such as, e.g., silicon nitride, sialon, boron nitride, titanium bromide, etc.

In another embodiment the ceramic material consists essentially of clay or shale.

In yet another embodiment, the ceramic material consists of or comprises glass. As used in this specification, the term glass refers to an inorganic product of fusion which has cooled to a rigid configuration without crystallizing. See, for example, George W. McLellan et al.'s "Glass Engineering Handbook," Third Edition (McGraw-Hill Book Company, New York, 1984). By way of illustration, some suitable glasses include sodium silicate glass, borosilicate glass, aluminosilicate glass, and the like. Many other suitable glasses will be apparent to those skilled in the art.

Figure 10:
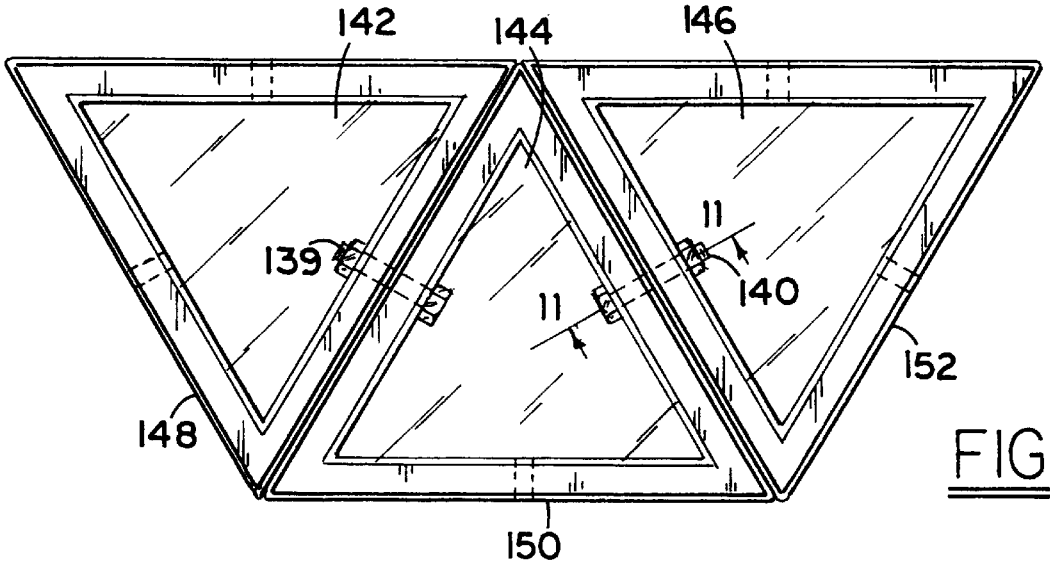
FIG. 10 is a partial top view of a geodesic dome this invention.
Figure 11:
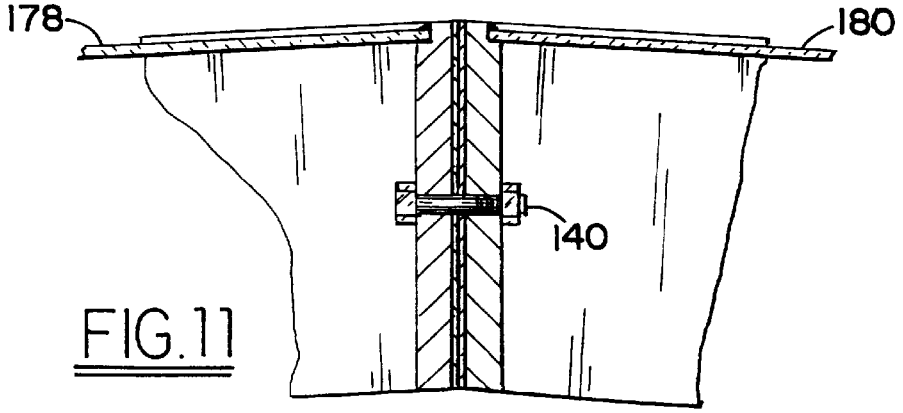
FIG. 11 is a partial sectional view of the dome FIG. 10, taken along lines 11—11.

Referring to FIGS. 10 and 11, it will be seen that, in one embodiment, triangular window sections 142, 144, and 146 are enclosed by both the walls of the building block and by glass panes 178 and 180. In this embodiment, the building block provides insulation. The enclosed window areas 142, 144, and 146 may be comprised of air. Alternatively, or additionally, they may be comprised of insulating material.

As will be apparent to those skilled in the art, one may use Plexiglass rather than glass. Alternatively, one may use glass which may be the same ceramic material, or a different ceramic, than is used in the body of the building block. The glass panes may be transparent, opaque, or translucent. The panes may be secured to the building block by adhesive means, a retaining pin, or any other conventional fastening means used to secure glass or plexiglass panes to window frames.

In one embodiment, glass panes 178 and 180 are comprised of plate glass.

In one embodiment, not shown, several layers of glass may be used, in a manner similar to that used on storm windows, to maximize insulating efficiency. The glass layers may be contiguous, or they may be separated by air.

In another embodiment, one may use layers of both glass and plastic material, which may be contiguous with each other.

Substantially any ceramic material may be used in applicant's building block. The use of such materials provides a block with improved resistance to radiation, resistance to heat, high compressive strength, electrical insulation, and the like. Furthermore, inasmuch as such materials may have their appearances improved by processes such as glazing, the geodesic dome 10 produced therefrom may have many desirable aesthetic features.

It is preferred that the ceramic material in building block 20 have a modulus of rupture of at least about 300 pounds per square inch. The modulus of rupture of the ceramic material is tested in accordance with A.S.T.M. Standard Test C-158-84. In one preferred embodiment, the modulus of rupture of the ceramic material is at least about 800 pounds per square inch. In another preferred embodiment, the modulus of rupture of the ceramic material is at least about 25,000 pounds per square inch. In one preferred embodiment, the ceramic material used in building block 10 is comprised of aluminosilicate material derived from clay or shale. These aluminosilicate clay mineral materials are well known to those skilled in the art; see, e.g., the "Spinks Clay Data Book" published by the H.C. Spinks Clay Company of Paris, Tenn.

Referring again to FIG. 3, it is preferred that at least about 95 weight percent of building block 20 be comprised of ceramic material.

Building block 20 preferably is comprised of at least two orifices 32 and 42 into which fasteners (not shown) may be inserted.

Figure 3A:
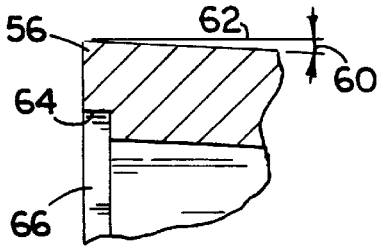
FIG. 3A is a sectional view of one corner of the building block of FIG. 3.

Applicant's building block 20 has a height 54 which decreases from its front face 52 to its rear face (not shown in FIG. 3). Thus, referring to FIG. 3A (which is a cross-sectional view of the front corner 56), it will be seen that front corner 56 is higher than the rear corner (not shown). The angle 60 formed between a line 62 drawn between the front and rear corners and a line perpendicular to the tangent of the front corner 56 is from about 1 to about 12 degrees. It will be apparent to those skilled in the art that, by varying the number and size of triangular structures in applicant's device, angle 60 may be varied. The greater the number of triangles, and the smaller their size, the smaller is angle 60.

Referring again to FIG. 3A, it will be seen that, in the preferred embodiment depicted, the front and/or rear walls of building block 20 may be recessed to receive a glass pane. Thus, notch 64 in building block 20 is adapted to receive glass pane 66. A similar notch, not shown, may appear in the rear wall(s) of building block 20. The space between the two glass panes may consist of air. Alternatively, it may be evacuated. Alternatively, it may be filled with insulating material such as, e.g., polystyrene foam.

Referring again to FIG. 3, and in yet another preferred embodiment, building block 20 consists essentially of plastic material.

In one aspect of this embodiment, building block 20 consists essentially of thermoplastic material. As is known to those skilled in the art, a thermoplastic material is a high polymer that softens when exposed to heat and returns to its original condition when cooled to room temperature. Natural substances that exhibit this behavior are crude rubber and a number of waxes. However, the term is often applied to synthetics such as polyvinyl chloride, nylons, fluorocarbons, linear polyethylene, polyurethane prepolymer, polystyrene polypropylene, polycarbonates, acrylonitrile/butadiene/styrene, and cellulosic and acrylic resins.

In another aspect of this embodiment, building block 20 consists essentially of thermoset plastics. As is known to those skilled in the art, a thermoset material is a high polymer that solidifies or sets irreversibly when heated. This property is usually associated with a crosslinking reaction or radiation, as with proteins, and in the baking of doughs. In many cases it is necessary to add "curing agents", such as organic peroxides or (in the case of rubber) sulfur. Thus, e.g., linear polyethylene can be crosslinked to a thermosetting material by radiation or by chemical reaction. Phenolics, allyls, melamines, urea-formaldehyde resins, alkyds, amino resins, polyesters, epoxides, and silicones are usually considered to be thermosetting, but the term also applies to materials where additive-induced crosslinking is possible (e.g., natural rubber).

In another aspect of this embodiment, the building block 20 consists essentially of foamed plastic such as e.g., polyurethane foam, polystyrene foam, polyethylene foam, and the like.

By way of further illustration and not limitation, one may use one or more of the plastic materials to construct the building block(s) of this invention which are described in U.S. Pat. Nos. 5,360,264, 5,306,098, 5,259,803, 5,215,490, 5,069,647, 5,057,049 4,909,718, 4,887,403, 4,808,140, 4,804,350, 4,708,684, 4,699,601, 4,676,762, 4,671,039, 4,633,639, 4,602,908, 4,575,984, 4,556,394, 4,475,326, 4,341,050, 4,308,698, 4,288,960, 4,374,221, 4,258,522, 4,159,602, 4,077,154, 4,075,808, 4,055,912, 3,949,534, 3,854,237, 3,668,832, 3,626,632, 3,468,081, and the like. The disclosure of these United States patents is hereby incorporated into this specification.

Figure 4:
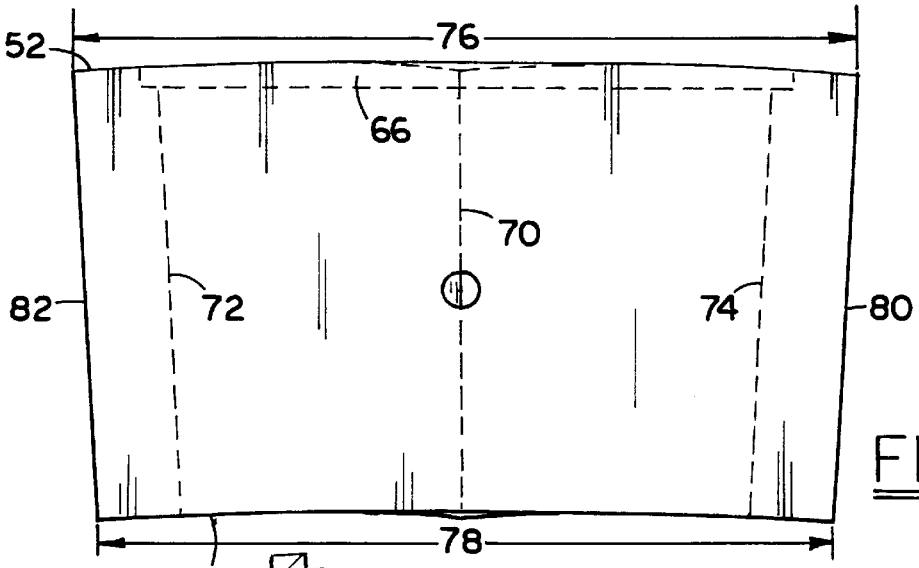
FIG. 4 is a side view of the block of FIG. 3.

FIG. 4 is a side view of the block 20 of FIG. 3. Referring to FIG. 4, it will be seen that face 52 is the front of block 20, face 68 is the rear of the block, dotted line 70 represents the top of block 20, and dotted lines 72 and 74 represent, respectively, the left and right corners of block 20.

Referring again to FIGS. 3, 3A, and 4, it will be seen that applicant's building block 20 is both wedge-shaped and beveled. In addition to height 54 decreasing from front face 52 to rear face 68 (see FIG. 4), the length 76 of face 52 is greater than the length 78 of face 68.

FIG. 4 illustrates one of the three sides of building block 20. It will be apparent to those skilled in the art that each side of building block 20 is in the shape of a four-sided figure with two arcuate surfaces 52 and 68 of different lengths, and two straight surfaces 80 and 82 which, preferably, have substantially the same length.

Figure 5:
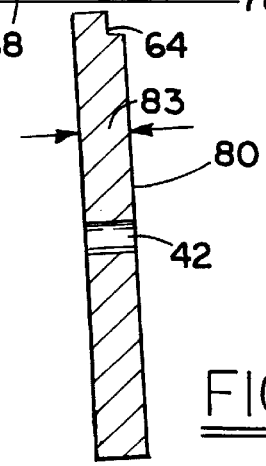
FIG. 5 is a sectional view of one side of the block of FIG. 3, taken along lines 5—5.

FIG. 5 illustrates one preferred embodiment of the invention, being a sectional view of wall 80, illustrating notch 64 and orifice 42. The thickness 82 of block 20 may vary, depending upon the type of ceramic material used, its strength, and other factors well known to those skilled in the art. In general, thickness 82 will be at least about 8 percent of the length 76 of block 20.

FIG. 6 is a top view of pentagonal building structure 14. Referring to FIG. 6, it will be seen that pentagonal building unit 14 is comprised of five substantially isosceles building blocks 84, 86, 88, 90, and 92 which, preferably, are joined to each other by fasteners inserted through holes 94, 96, 98, 100, and 102.

Each of building blocks 84, 86, 88, 90, and 92 is in the shape of an isosceles triangle, and each of said blocks is substantially congruent with each of the other blocks; however, as indicated earlier in this specification, the isosceles triangular blocks of the pentagonal building unit 14 are not congruent with the isosceles triangular blocks of the hexagonal building unit 12. Thus, only two of the sides of said triangle are equal.

When the building blocks in the hexagonal building 12 are substantially equilateral, and referring to FIG. 7, the sides of the triangle of the pentagonal building blocks form base angles 104 and 106 of about 54 degrees and an apex angle 108 of about 72 degrees. When, however, the building blocks in the hexagonal building structure 12 are isosceles shaped, then the base angles 104 and 106 are between 54.5 and 54.7 degrees.

In the preferred embodiment depicted in FIG. 7, the sides of the building block 84 (and/or of block 20, and/or of any other block used in structure 10) contain a designation which will help one using the block to construct a structure to determine how to align such a block with an adjacent block. By designating the abutting faces of all blocks so that adjacent faces share a common designation, it is easy for children to assemble blocks in a systematic manner. For example, if the faces of adjacent blocks share a common color, then a child simply has to match the color to color. This designation may be a number, an alphabetical letter, a picture, a shape, or any other unique identical, symbol and/or color. This designation may also indicate direction, e.g., an arrow, North & South, left & right, in and out, etc. The short sides (interior edges) of the isosceles blocks which comprise the pentagon preferably share a unique designation (see, e.g., designation 89, FIG. 6). The interior edges of the block which comprise the hexagon preferably share a unique designation (see element 23, FIG. 2). The exterior edges of the pentagonal isosceles block (see FIG. 6, element 87) and the exterior edges of the hexagonal isosceles block (see FIG. 2, element 25) preferably share a unique designation. In addition, the outer and inner faces of each block may share common designations (see FIG. 13, elements 151 and 153). For example, the outer faces may all be black, and the inner faces may all be white. Concentric congruent domes and cylinders may be attached to one another wherein the outer face (see FIG. 13, element 151) of the smaller dome or cylinder shares a designation with the inner face (see FIG. 13, element 153) of the larger dome or cylinder.

Referring again to FIG. 7, it will be apparent to those skilled in the art that any of the triangular shapes defined by said building blocks may be subdivided into smaller triangular shapes. Thus, by way of illustration, triangular building block 84 defines a triangle which might be made up of four congruous smaller triangles, and each of said four congruous smaller triangles similarly might be subdivided into four yet smaller triangles, etcetera ad infinitum.

In one embodiment, building block 84 (and each of the other building blocks 86, 88, 90, and 92) are comprised of at least 90 weight percent of the ceramic material described elsewhere in this specification; in another embodiment, such building block(s) are comprised of at least 90 weight percent of the plastic material described above. Such building block is also preferably comprised of at least two orifices 94 and 96 into which fasteners (not shown) may be inserted.

Applicant's building block 84 has a height 110 which decreases from its front face 112 to its rear face (not shown in FIG. 7). Thus, referring to FIG. 7A (which is a cross-sectional view of the front corner 114), it will be seen that front corner 114 is higher than the rear corner (not shown). The angle 116 formed between a line 118 drawn between the front and rear corners and a line perpendicular to the tangent of the front corner 114 is from about 1 to about 12 degrees. It will be apparent to those skilled in the art that, by varying the number and size of triangular structures in applicant's device, angle 60 may be varied. The greater the number of triangles, and the smaller their size, the smaller is angle 116.

Referring again to FIG. 7A, it will be seen that, in the preferred embodiment depicted, the front and/or rear walls of building block 84 may be recessed to receive a glass pane. Thus, notch 120 in building block 84 is adapted to receive glass pane 122. A similar notch, not shown, may appear in the rear wall(s) of building block 84. The space between the two glass panes may consist of air. Alternatively, it may be evacuated. Alternatively, it may be filled with insulating material such as, e.g., polystyrene foam.

FIG. 8 is a side view of the block 84 of FIG. 6. Referring to FIG. 8, it will be seen that face 112 is the front of block 84, face 125 is the rear of the block, dotted line 128 represents the top of block 84, and dotted lines 130 and 132 represent, respectively, the left and right corners of block 84.

Referring again to FIGS. 6, 7, 7A, and 8, 4, it will be seen that applicant's building block 84 is both wedge-shaped and beveled. In addition to height 110 decreasing from front face 112 to rear face 125 (see FIG. 8), the length 124 of face 112 is greater than the length 125 of face 125.

FIG. 8 illustrates one of the three sides of building block 84. It will be apparent to those in the art that each side of building block 84 is in the shape of a four-sided figure with two arcuate surfaces 112 and 125 of different lengths, and two straight surfaces 134 and 136 which, preferably, have substantially the same length.

Figure 9:
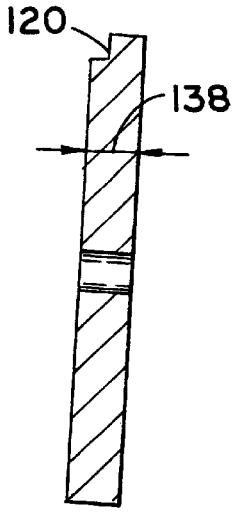
FIG. 9 is a sectional vie w of a wall of the block FIG. 7, taken along lines 9—9.

FIG. 9 is a sectional view of wall 136, illustrating notch 120 and orifice 96. The thickness 138 of block 84 may vary, depending upon the type of ceramic material used, its strength, and other factors well known to those skilled in the art. In general, thickness 138 will be at least about 8 percent of the length 124 of block 84.

FIG. 10 is a sectional view of a portion of building section 12, illustrating how building blocks 24, 26,and 28 may be joined to each other. Referring to FIG. 10, it will be seen that fasteners 139 and 140 may be inserted through orifices 36 and 38 (not shown in FIG. 2) to join the blocks together.

In the embodiment illustrated in FIG. 2, the fasteners used are nuts and bolts. In another embodiment, not shown, the fastener used is one which will not extend into the triangular window sections 142, 144, and 146 defined by the building blocks. By way of illustration and not limitation, one such suitable fastener is a clevis pin. Alternatively, or additionally, one may use adhesive, a shim, and the like.

Figure 12:
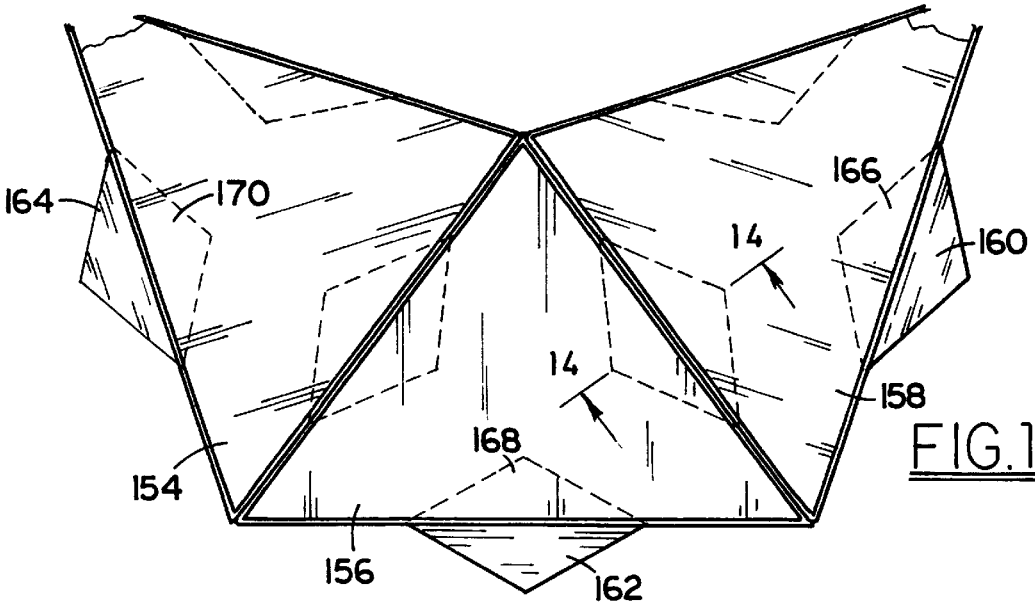
FIG. 12 is a sectional view of three of the building blocks of FIG. 1 joined together.

In the preferred embodiments illustrated in FIGS. 10 and 12, each of the building blocks (such as building blocks 24, 26, and 28) is preferably sheathed in a gasket material. Thus, gasket material 148 sheaths the outer faces of building block 28, whereas gasket materials 150 and 152 sheath building blocks 26 and 24, respectively.

In this embodiment, the gasket material tends to prevent crack propagation when the building block is subjected to a severe shock. Any of the materials known to inhibit crack propagation of ceramic material may be used as the gasket material. Thus, by way of illustration, one may use rubber, an elastomer, red rubber, silicone, tan vegetable fiber, neoprene, fiberfax, fiberglass, polyvinylchloride, latex, soft metal, and the like.

In general, the thickness of the gasket material will range from about 0.016 to about 1.0 inches. The thickness of the gasket material will generally be from 0.05 to about 10 percent of the thickness of the wall of the building block.

The gasket material, although it may be either organic or inorganic, will preferably have a different chemical composition and a different Young's modulus than the ceramic material in the building block.

In the embodiment illustrated in FIGS. 10 and 11, it is preferred that gasket material contact the entire surface of each of the adjacent faces so that there is substantially no direct contact between the ceramic surfaces of adjacent blocks.

In the preferred embodiment illustrated in FIG. 11, fastener 140 is also sheathed by a gasket material similar to that described above so that there is preferably no direct contact between fastener 140 and the ceramic material of the building block.

FIG. 12 illustrates another means of joining adjacent building blocks. In the preferred embodiment illustrated in this Figure, each of building blocks 154, 156, and 158 is substantially solid. Each face of these substantially solid building blocks is comprised of a substantially triangular orifice; when two of such orifices are placed base to base, they define a substantially diamond-shaped figure.

Referring again to FIG. 12, it can be seen that diamond shaped plug 160, 162, and 164 may be placed into the triangular orifices, such as orifices 166, 168, and 170. Once these plugs have been placed into the orifice, the blocks may be joined to adjacent blocks by lining up the diamond-shaped plug so that if fits into the orifice of the adjacent block. In this embodiment, in addition to joining adjacent blocks together, the diamond-shaped plugs also help to align them.

Figure 13:
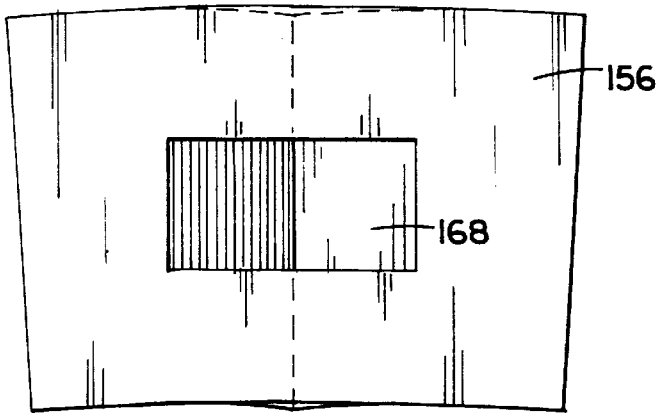
FIG. 13 is a side view of the structure of FIG. 12.
Figure 14:
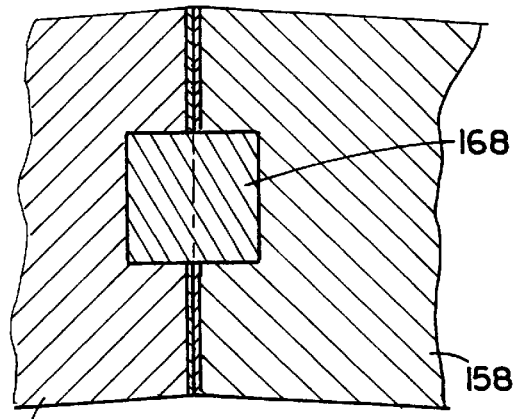
FIG. 14 is a sectional view, taken along lines 14—14 of FIG. 12, of the juncture of two of said building blocks.

FIG. 13 is a side view of block 156, showing substantially triangular shaped orifice 168. FIG. 14 is a cross-section taken across lines 14—14 between adjacent blocks 156 and 158.

Figure 15:
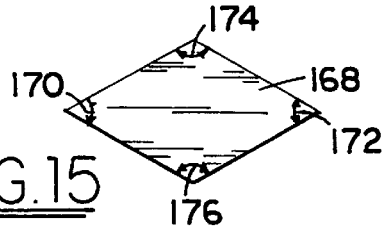
FIG. 15 is a top view of a wedge used to join the building blocks in FIG. 12.

FIG. 15 illustrates the shape of the preferred plug 168 which may be used in the embodiment of FIG. 12. In this embodiment, it is preferred that plug 168 define a four-sided Figure containing two substantially acute angles 171 and 172 of about 60 degrees and two substantially obtuse angles 174 and 176 of about 120 degrees.

Figure 16:
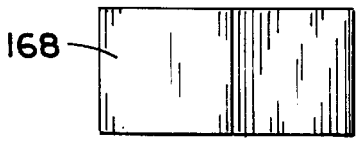
FIG. 16 is a side view of the wedge of FIG. 15.

FIG. 16 is a side view of plug 168.

Figure 90:
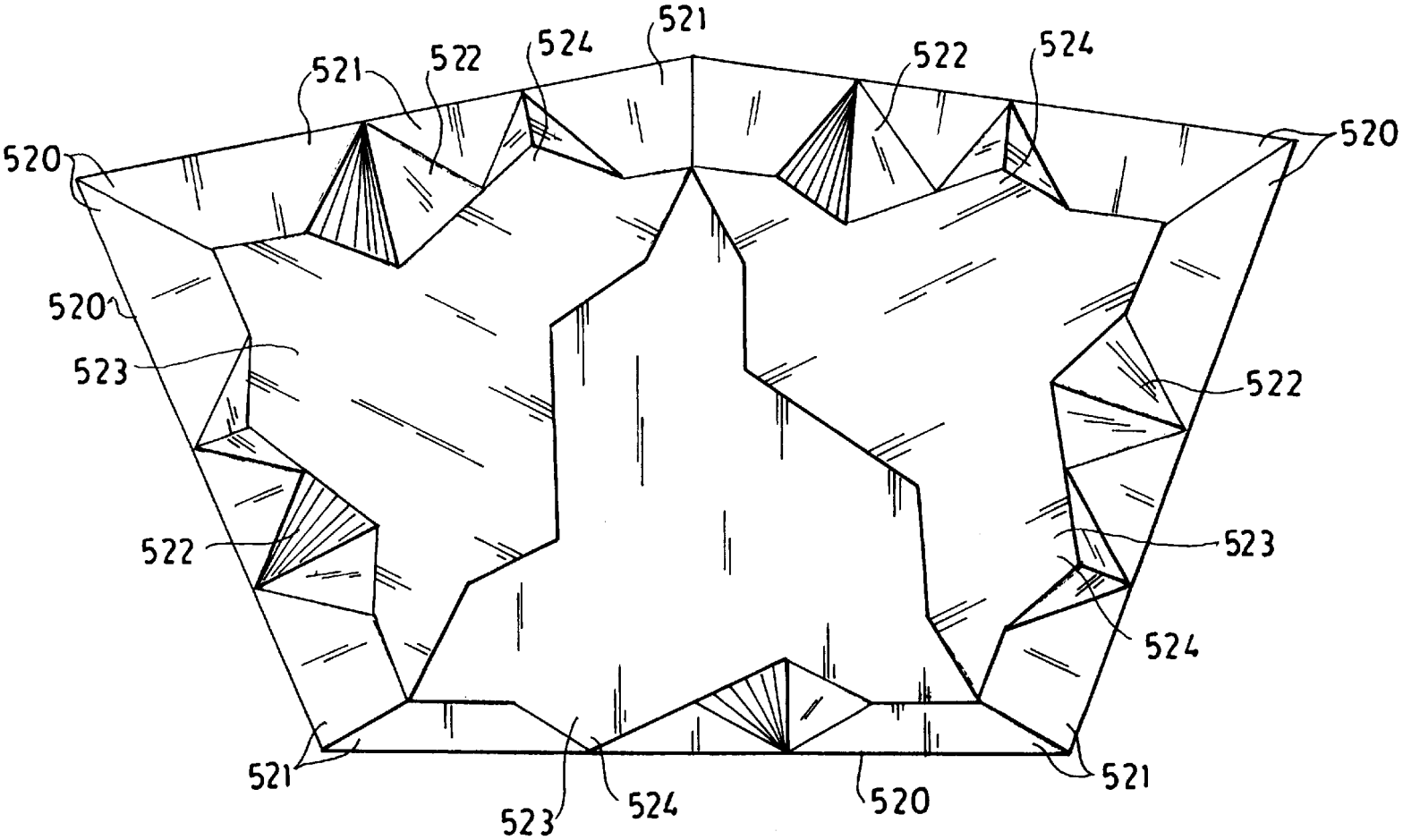
FIG. 90 is a sectional view of three of the building blocks of FIG. 84 joined together.

FIG. 90 illustrates another means of joining adjacent building blocks. In the preferred embodiment, each of the building blocks 520, 530, 540, 550, and 560 is substantially solid. Each of these substantially solid building blocks is comprised of a substantially tapered zig-zag of alternating orifice 522 and plug 524 combination.

Referring to FIG. 90, it can be seen that the tapered zig-zig orifice 522 and plug 524 combination alternates between the two abutting faces of each block. The blocks are joined together by the interlocking nature of the tapered zig-zag. The plug inserts into the orifice along the abutting faces of the two adjacent blocks, such that no independent key is required. In this embodiment, in addition to joining adjacent blocks together, the tapered zig-zag also helps to align them. This interlocking feature is achieved in a mold without undercuts, and can be made with existing two piece machines as are commonly used by industry. These machines include plastic injection machines, ceramic ram press machines, concrete block machines, brick machines, and the like. The blocks described in U.S. Pat. No. 5,261,194 and No. 5,329,737 can not be made on these simple two piece mold machines commonly used by industry, but require special equipment.

Figure 94:
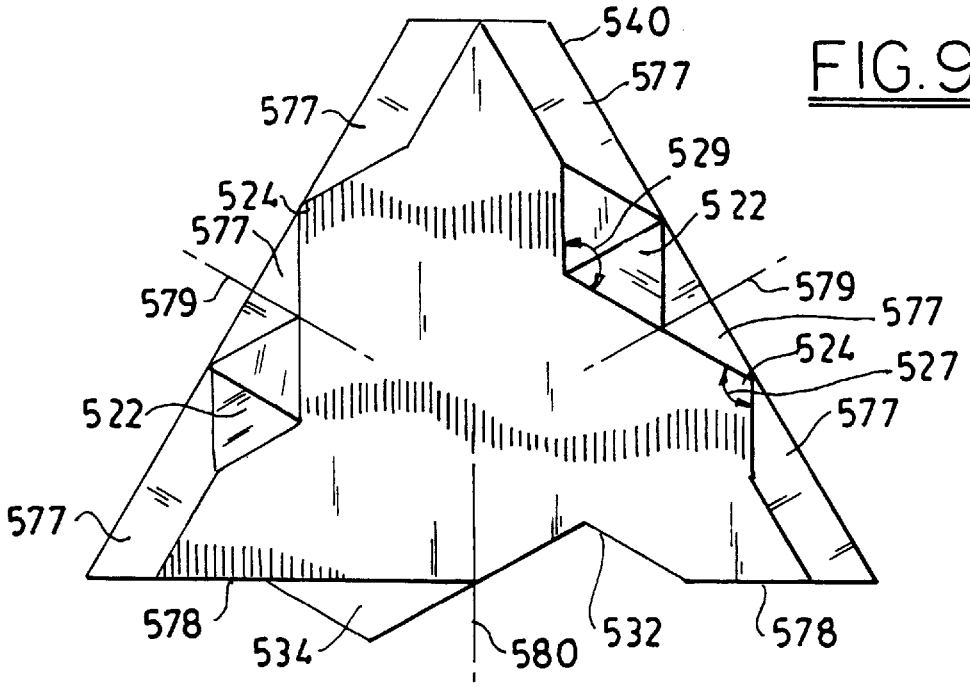
FIG. 94 is an end view of a first preferred block which may be used to construct the structure of FIG. 17.
Figure 94A:
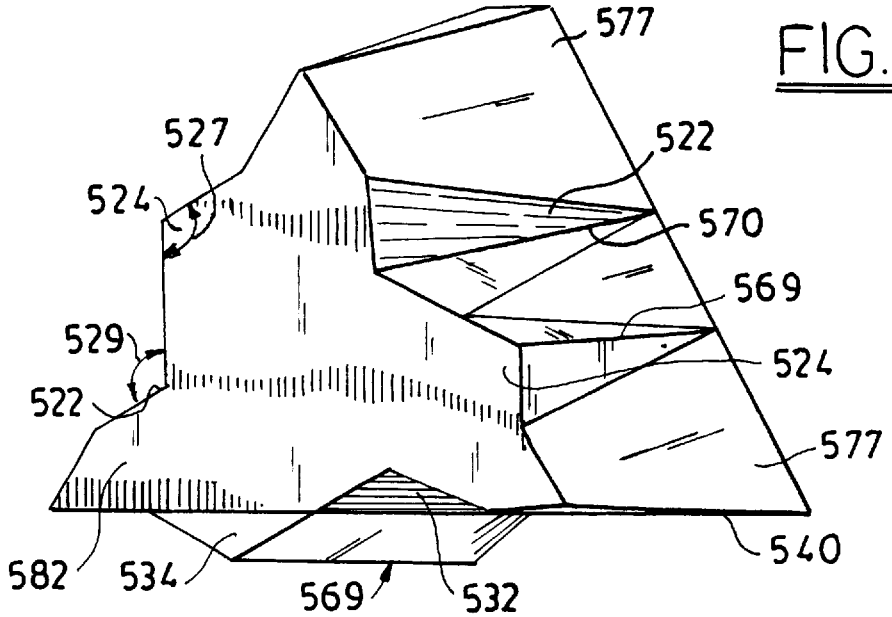
Figure 97:
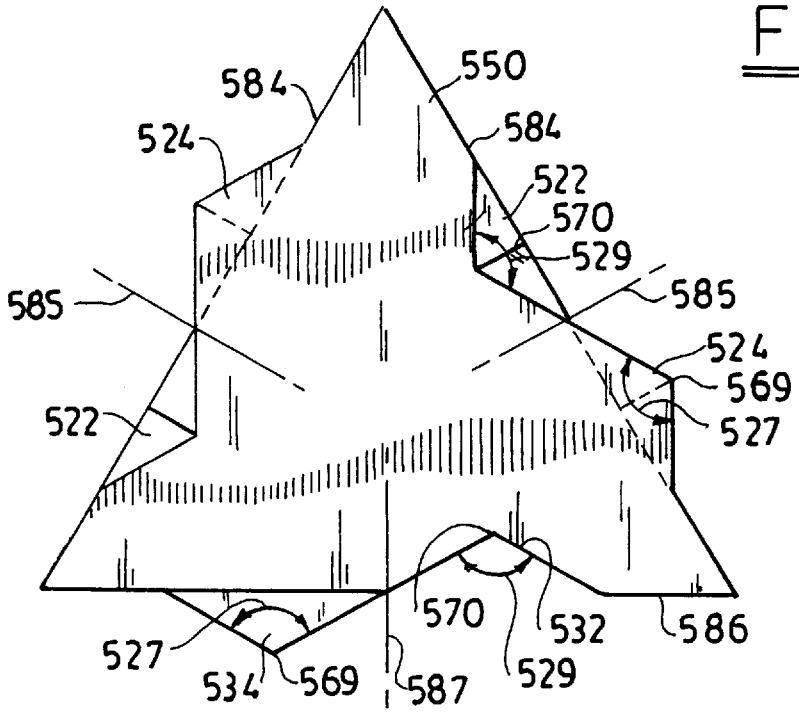
FIG. 97 is an end view of a second preferred building block which may be used to construct the structure of FIG. 17.

Referring to FIGS. 94 and 97, the flat top block 540 and the parallelogram block 550 are used to construct a right circular cylinder, which curves in two dimensions, as opposed to a sphere which curves in three dimensions. Thus only two sides of the flat top and parallelogram require the orifice 522 and the plug 524 to be tapered. The non-tapered or non-beveled side thus uses a non-tapered, or straight through, orifice 532 and a nontapered, or straight through, plug 534.

Building blocks 20 and 84, and other similarly shaped blocks, may be made by conventional ceramic forming processes. Thus, for example, one may use the processes described in, e.g., James S. Reed's "Introduction to the Principles of Ceramic Processing," (John Wiley & Sons, New York, 1988). Thus, one may use pressing (see pages 329–353), plastic forming (see pages 255–379), casting (see pages 380–402), and the like.

In one preferred embodiment, the building block 20 and/or 84 is made by ram-pressing. As is known to those skilled in the art, ram pressing is a process for plastic forming of ceramic ware by pressing a bat of the prepared body between two porous plates or mold units; after the pressing operation, air may be blown through the porous mold parts to release the shaped ware. See, e.g., A.E. Dodd's "Dictionary of Ceramics, Potter, Glass . . . ," Philosophical Library, Inc., New York, 1964).

In one embodiment, the building block is made with a CINVA-Ram block press using a mixture of soil, sand, silt, clay, and cement; the press has a mold box in which a hand-operated piston compresses a slightly moistened mixture of soil and cement or lime. This process is described in, e.g., a publication entitled "Making Building Blocks with the CINVA-Ram Block Press" (Volunteers in Technical Assistance, Mt. Ranier, Md., 1977). After the green body is formed by this process, it may be sintered.

In another embodiment, the building block is made by slip casting in a plaster mold, and the green body thus formed is sintered by conventional means.

In one preferred embodiment, the building block 20 and/or the building block 84 has a porosity of at least about 20 volume percent. Any conventional means may be used to produce a ceramic article with this porosity.

Thus, by way of illustration, one may prepare a green body which contains at least about 1 weight percent of pore-forming body which, upon sintering, will burn out of the ceramic. Thus, one may use micro-balloons, sawdust, shredded rubber, and any other organic material which will burn out during sintering and create the desired pore structure.

One advantage of applicant's building block is that it may be produced in many different locations from commonly available materials. Thus, anywhere where clay and sand is available, one may shape the building block, sinter it with a solar kiln, and build one's desired structure. If, for example, one were on the moon (where the solar wind is quite strong and clay is readily available), one can produce a ceramic building from commonly available material.

Referring to FIG. 1, hexagonal building section 12 may be produced by joining together six of the triangular building blocks 20 (see FIG. 10). Pentagonal building section 14 may be produced by joining together five of the triangular building blocks 84 (see FIG. 6). Substantially trapezoidal building unit 16 may be produced by joining together three of the triangular building blocks 20.

Referring to FIG. 90, it can be seen that the tapered zig-zig orifice 522 and plug 524 combination alternates between the two abutting faces of each block. The blocks are joined together by the interlocking nature of the tapered zig-zag. The plug inserts into the orifice along the abutting faces of the two adjacent blocks, such that no independent key is required. In this embodiment, in addition to joining adjacent blocks together, the tapered zig-zag also helps to align them. This interlocking feature is achieved in a mold without undercuts, and can be made with existing two piece machines as are commonly used by industry. These machines include plastic injection machines, ceramic ram press machines, concrete block machines, brick machines, and the like. The blocks described in U.S. Pat. No. 5,261,194 and No. 5,329,737 can not be made on these simple two piece mold machines commonly used by industry, but require special equipment.

Figure 100:
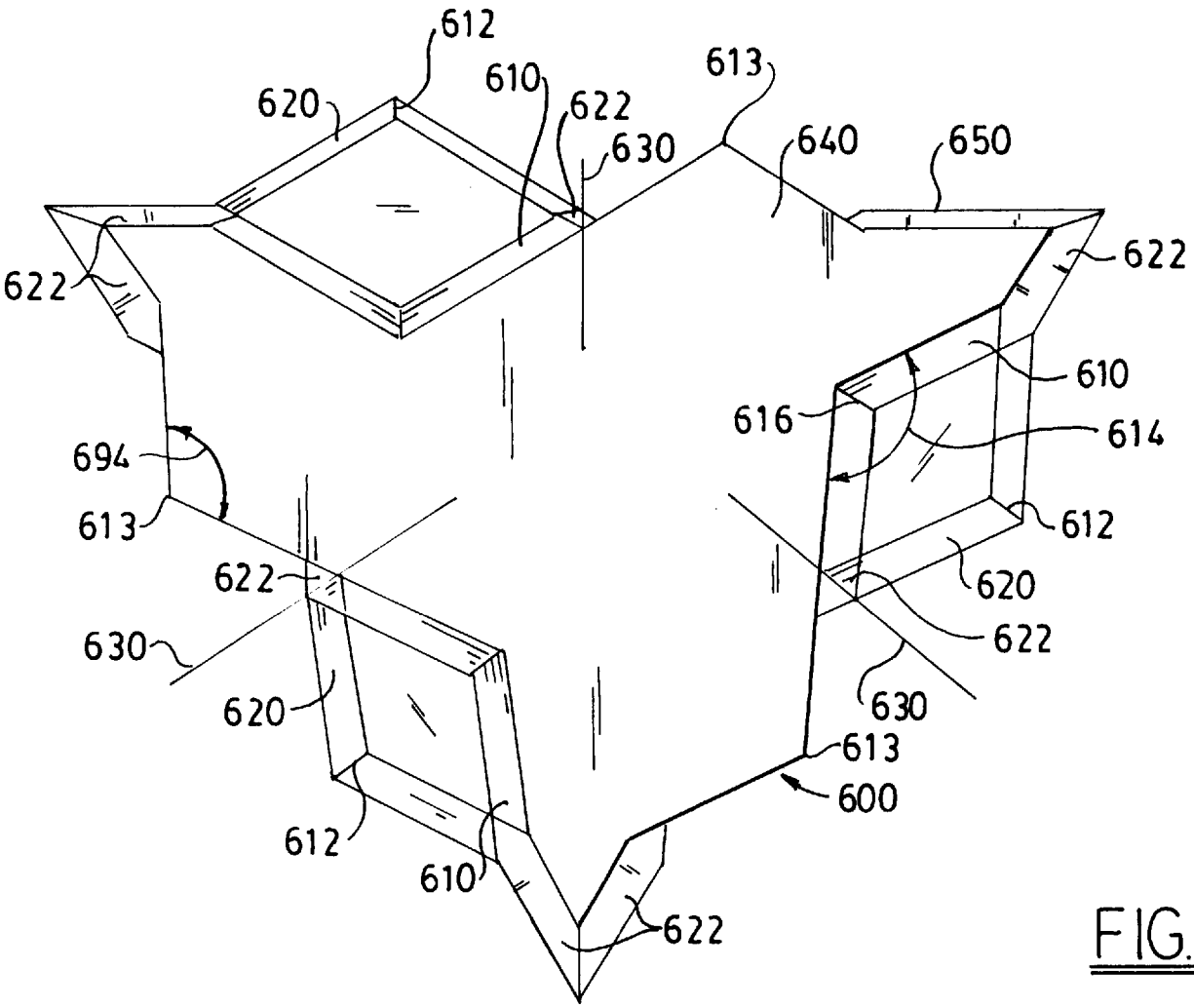
FIG. 100 is an end view of one pentagonal building block of this invention.

FIG. 100 illustrates another means of joining adjacent building blocks. In the preferred embodiment, each of the building blocks 600 is substantially solid. Each of these substantially solid building blocks is comprised of a substantially tapered zig-zag of alternating orifice 610 and plug 620 combination.

Figure 101:
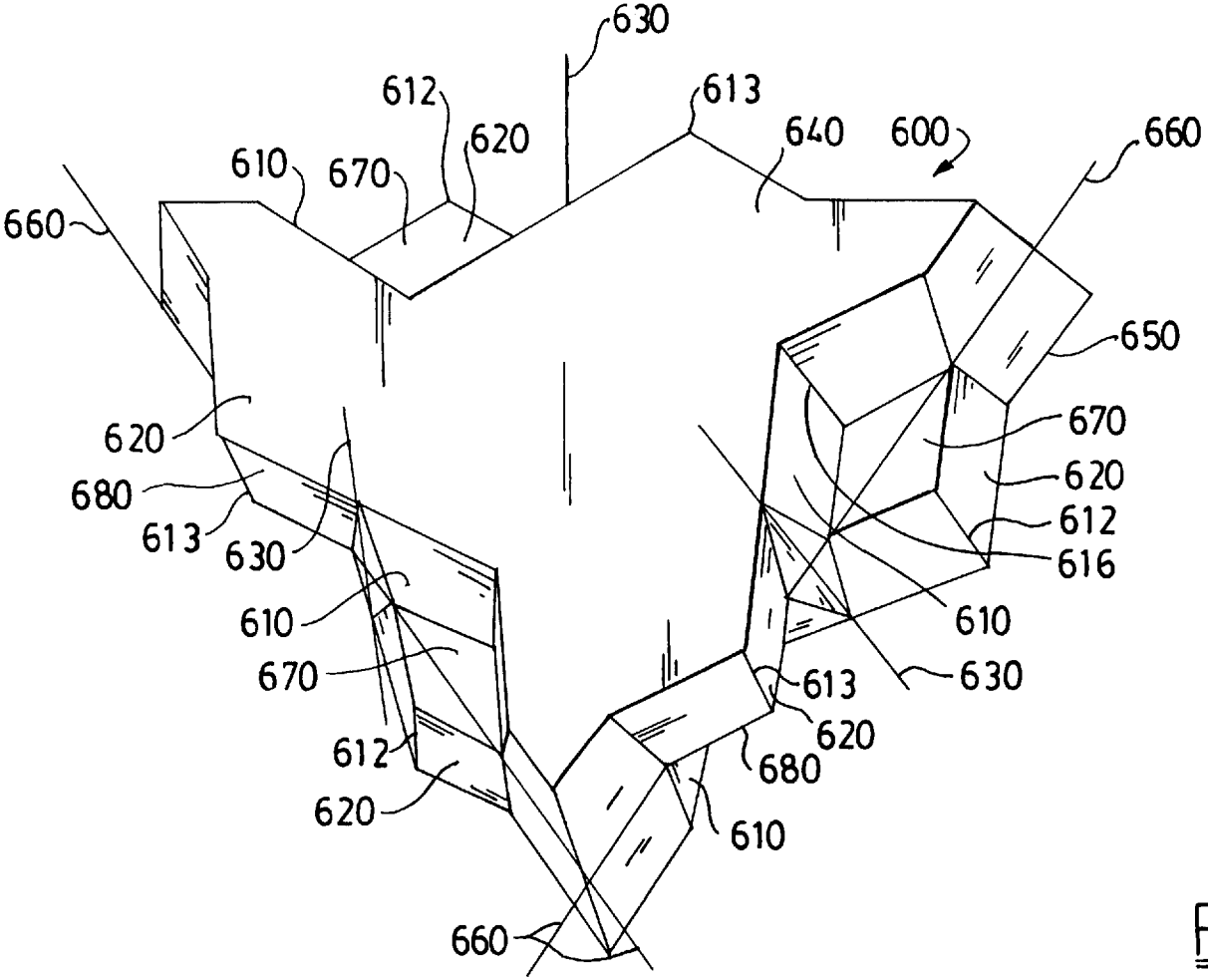
FIG. 101 is a perspective view of the block shown in FIG. 100.

FIG. 101 illustrates how orifice 610 and plug 620 alternate both from one corner of the triangle to the other, about the center of the edge 630, and from the inside triangular face of the block 640 to the outside triangular face of the block 650 (not shown) about the center of the abutting face of the block 660.

Referring to FIG. 101, it can be seen that three diamond-shaped planar surfaces 670 are formed at the centers 660 of the abutting edges of the block 600. Said diamond-shaped planar surfaces 670 are each counterclockwise to each of the centers 630 of each of the abutting edges of block 600. Alternately, it can be seen that three diamond-shaped planar surfaces 680 are formed at the centers of the abutting edges of the block 660. Said diamond-shaped planar surfaces 680 are each clockwise to each of the centers 630 of each of the abutting edges of block 600. It will be apparent to those skilled in the art that the diamond-shaped surfaces 670 and 680 provide abutting surfaces between adjacent blocks in a spherical structure. Furthermore, it will be apparent to those skilled in the art that said diamond-shaped surfaces effectively locate blocks in the tangential plane of the spherical surface so described, and prevent said blocks from sliding either towards or away from the center of said spherical surface. Moreover, it will be apparent to those skilled in the art that said diamond-shaped surfaces provide a supporting plane, and facilitate assembly of a spherical or dome-shaped structure. Alternately, the diamond-shaped surfaces 670 and 680 of two adjacent blocks may be separated by a given distance to allow for a tensile member to be inserted along the linear direction defined by the intersection of abutting faces 622 and inverse mirror planes 660. This separation distance can be filled with either gasket material or with conventional wet mortar.

Figure 102:
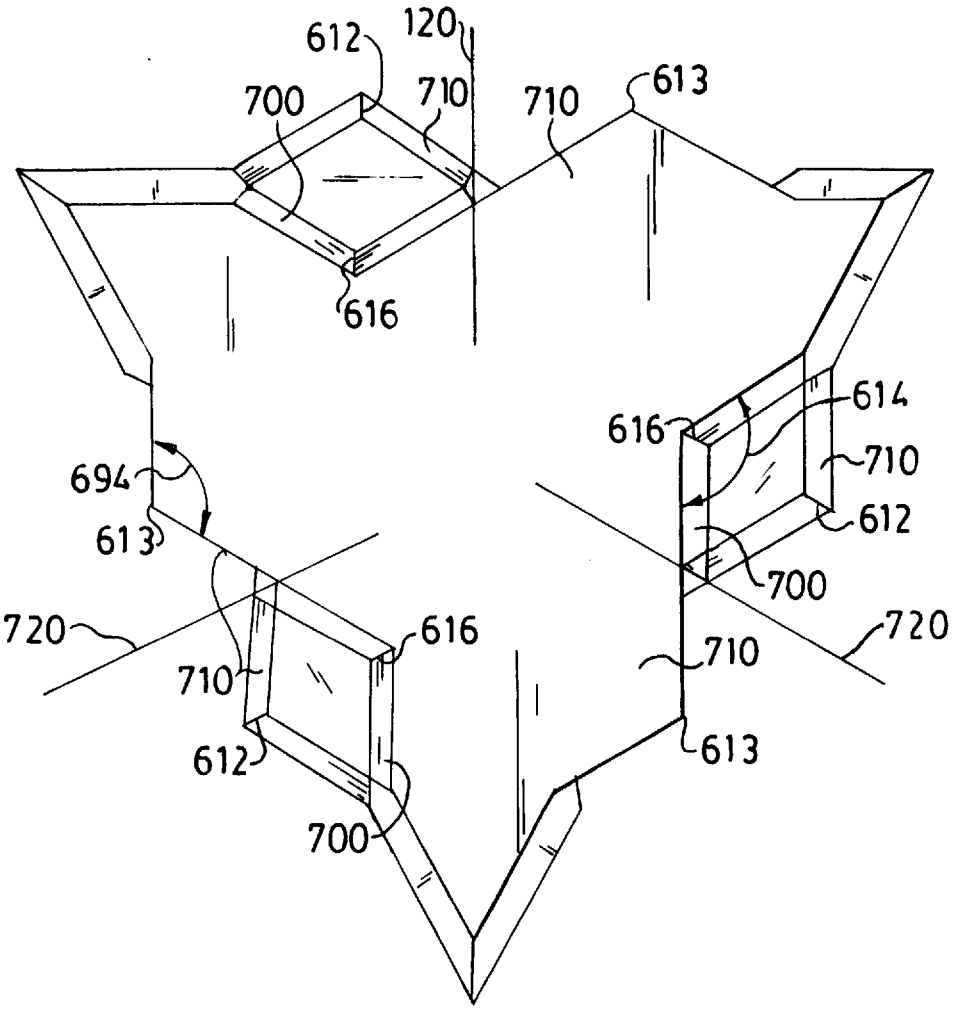
FIG. 102 is an end view of one hexagonal building block of this invention.

FIG. 102 illustrates another means of joining adjacent building blocks. In the preferred embodiment, each of the building blocks 690 is substantially solid. Each of these substantially solid building blocks is comprised of a substantially tapered zig-zag of alternating orifice 700 and plug 710 combination.

Figure 103:
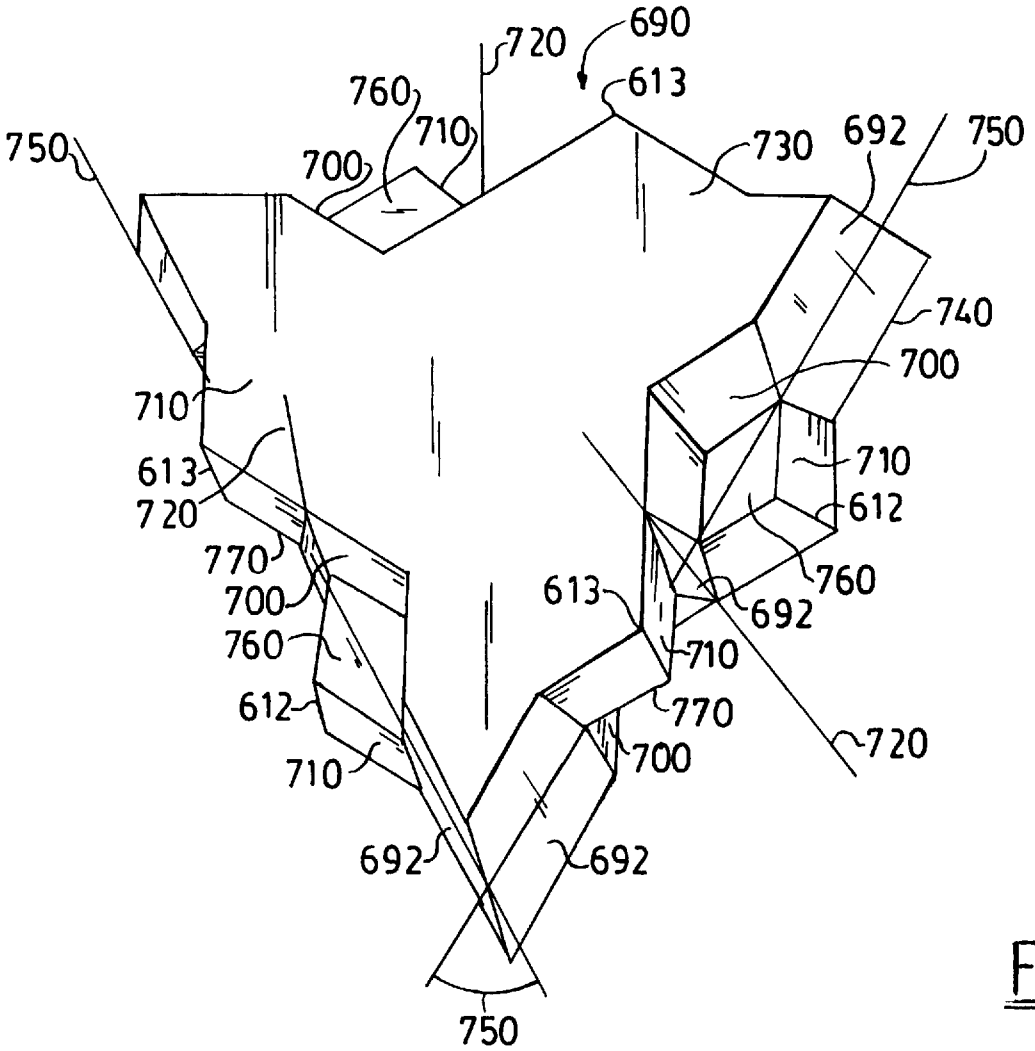
FIG. 103 is a perspective view of the block shown in FIG. 102.

FIG. 103 illustrates how orifice 700 and plug 710 alternate both from one corner of the triangle to the other, about the center of the edge 720, and from the inside triangular face of the block 730 to the outside triangular face of the block 740 (not shown) about the center of the abutting face of the block 750.

Referring to FIG. 103, it can be seen that three diamond-shaped planar surfaces 760 are formed at the centers 720 of the abutting edges of the block 690. Said diamond-shaped planar surfaces 760 are each counterclockwise to each of the centers 720 of each of the abutting edges of block 690. Alternately, it can be seen that three diamond-shaped planar surfaces 770 are formed at the centers of the abutting edges of the block 750. Said diamond-shaped planar surfaces 770 are each clockwise to each of the centers 720 of each of the abutting edges of block 690. It will be apparent to those skilled in the art that the diamond-shaped surfaces 760 and 770 provide abutting surfaces between adjacent blocks in a spherical structure. Furthermore, it will be apparent to those skilled in the art that said diamond-shaped surfaces effectively locate blocks in the tangential plane of the spherical surface so described, and prevent said blocks from sliding either towards or away from the center of said spherical surface. Moreover, it will be apparent to those skilled in the art that said diamond-shaped surfaces provide a supporting plane, and facilitate assembly of a spherical or dome-shaped structure. Alternately, the diamond-shaped surfaces 670 and 680 of two adjacent blocks may be separated by a given distance to allow for a tensile member to be inserted along the linear direction defined by the intersection of abutting faces 622 and inverse mirror planes 660. This separation distance can be filled with either gasket material or with conventional wet mortar.

Figure 103A:
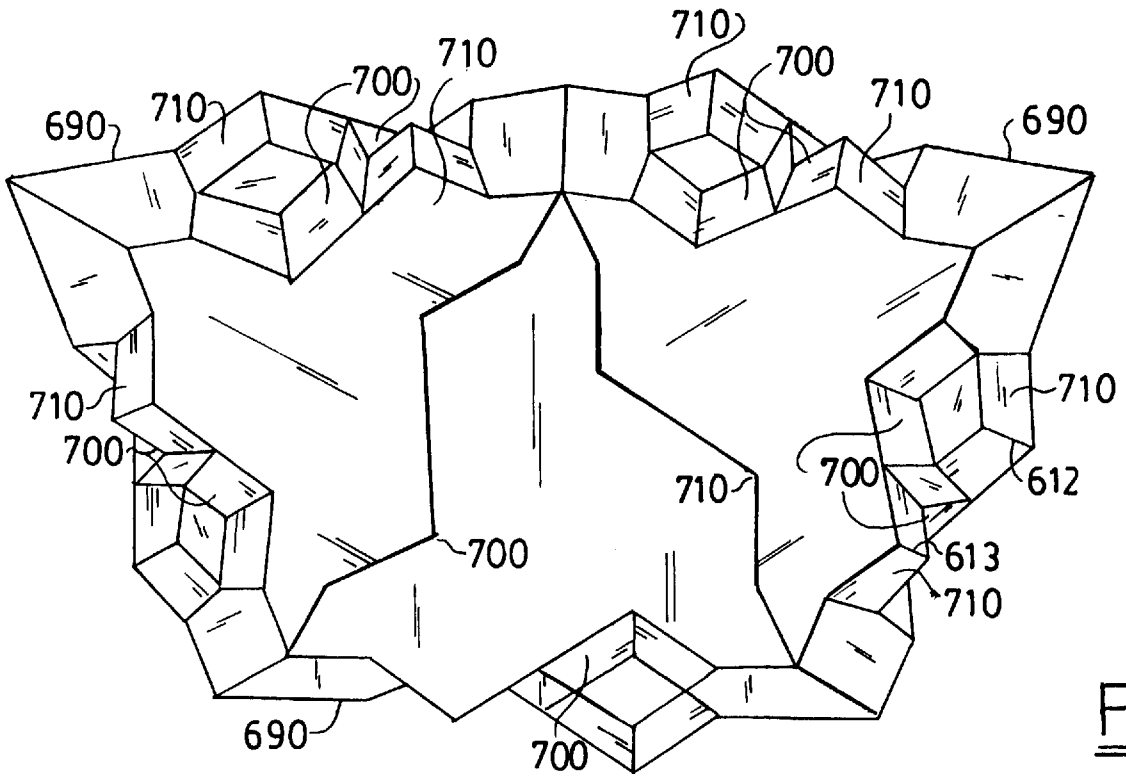
FIG. 103A is a sectional view of three of the building blocks of FIG. 102 joined together.

Referring to FIG. 103A, it can be seen that the tapered zig-zig orifice 700 and plug 710 combination alternates between the two abutting faces of each block. The blocks are joined together by the interlocking nature of the tapered zig-zag. The plug inserts into the orifice along the abutting faces of the two adjacent blocks, such that no independent key is required. In this embodiment, in addition to joining adjacent blocks together, the diamond shaped surface 760 and the diamond-shaped surface 770 also help to align them. This interlocking feature is achieved in a mold without undercuts, and can be made with existing two piece machines as are commonly used by industry. These machines include plastic injection machines, ceramic ram press machines, concrete block machines, brick machines, and the like. The blocks described in U.S. Pat. No. 5,261,194 and No. 5,329,737 can not be made on these simple two piece mold machines commonly used by industry, but require special equipment.

Figure 104:
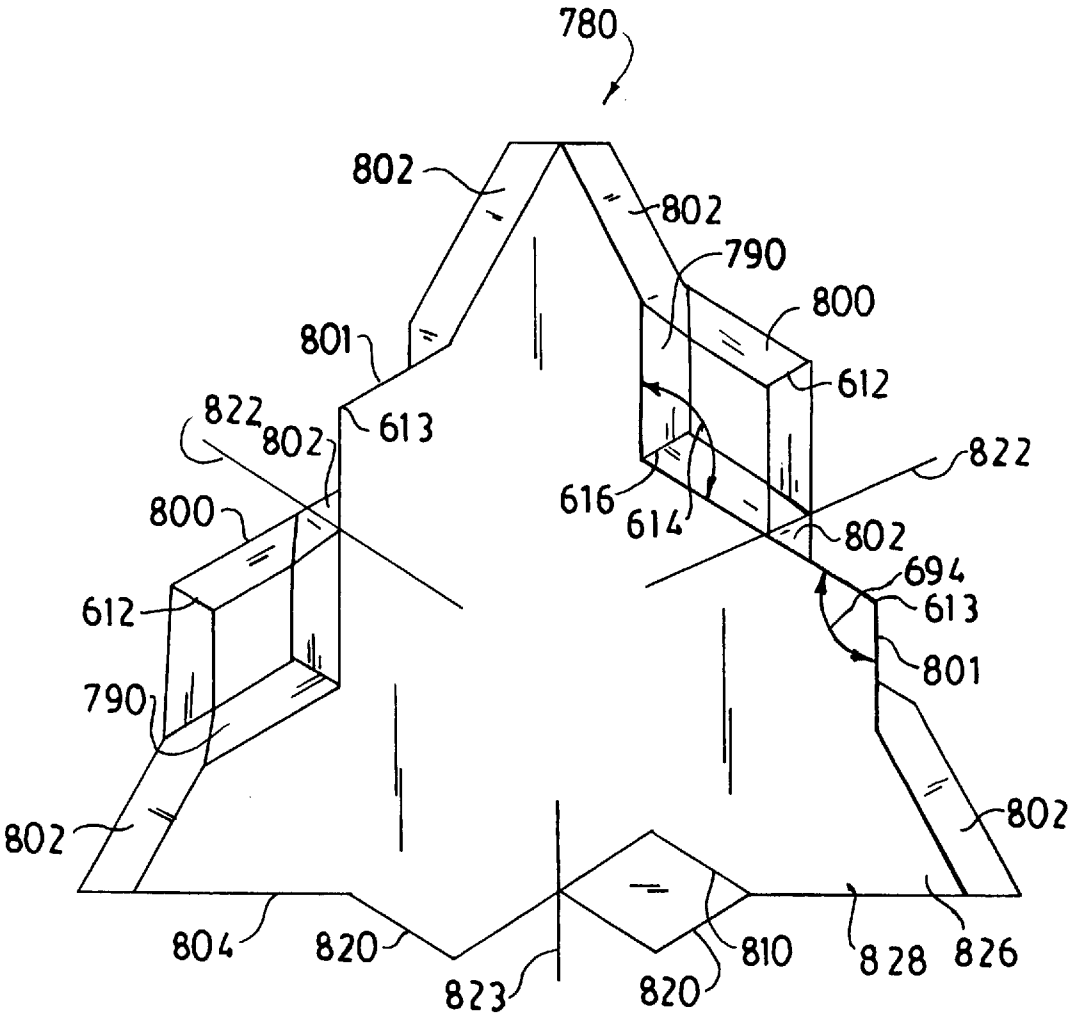
FIG. 104 is an end view of the third preferred block which may be used to construct the structure shown in FIG. 17.
Figure 105:
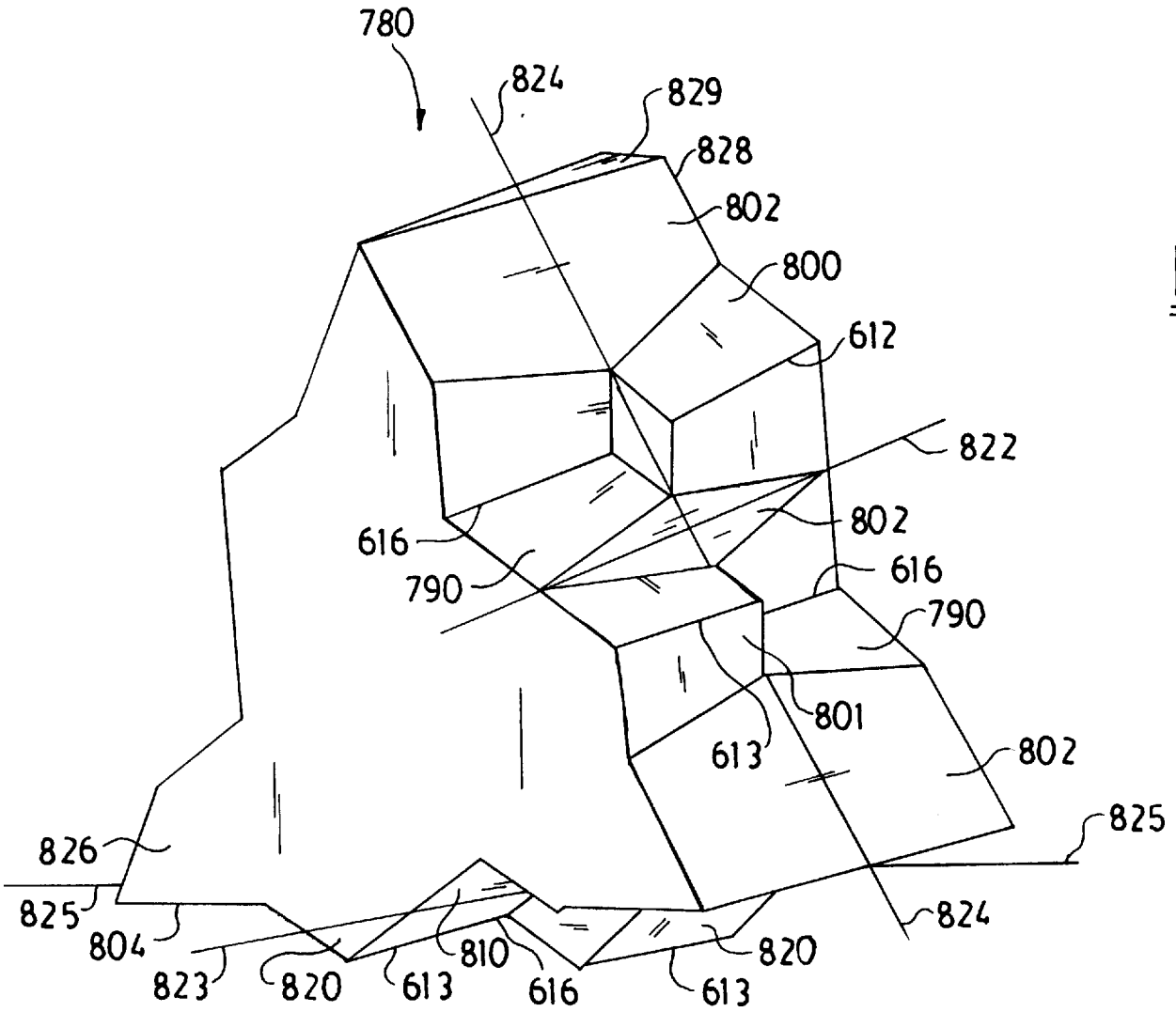
FIG. 105 is a perspective view of the third preferred block which may be used to construct the structure shown in FIG. 17.

Referring to FIGS. 104 and 105, the flat top block 780 is used to construct a right circular cylinder, which curves in two dimensions, as opposed to a sphere which curves in three dimensions. Thus only two sides of the flat top require the orifice 790 and the plug 800 to be tapered. The non-tapered or non-beveled side thus uses a non-tapered, or straight through, orifice 810 and a non-tapered, or straight through, plug 820.

Referring to FIG. 105, it will be apparent to those skilled in the art that orifices 790 and plugs 800 alternate about both the center of the edge 822 and the center of the abutting face 824 of block 780. This feature allows the blocks to be assembled in the manners described below.

Figure 106:
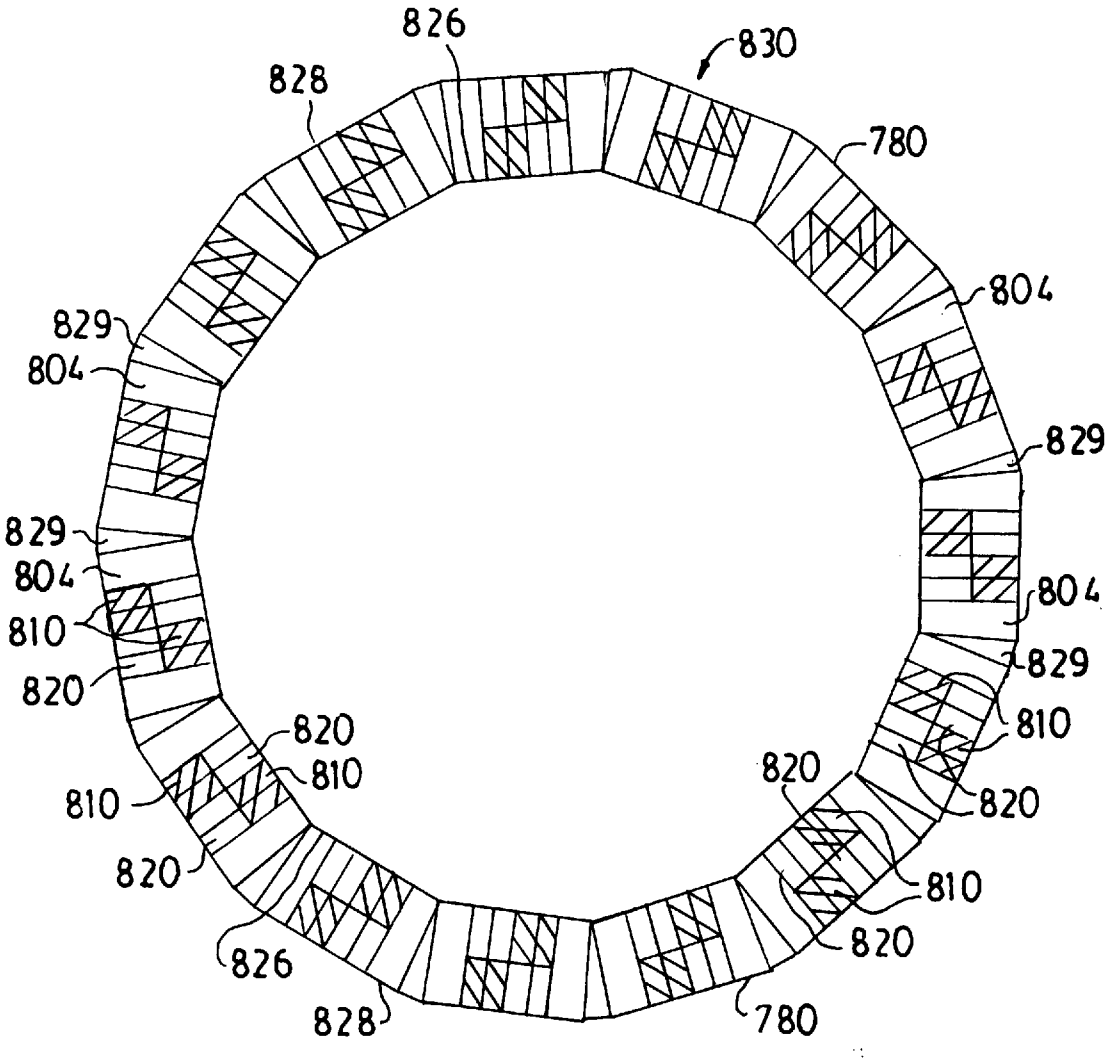
FIG. 106 is a top view of one preferred cylindrical structure constructed from the blocks of FIG. 104.
Figure 106A:
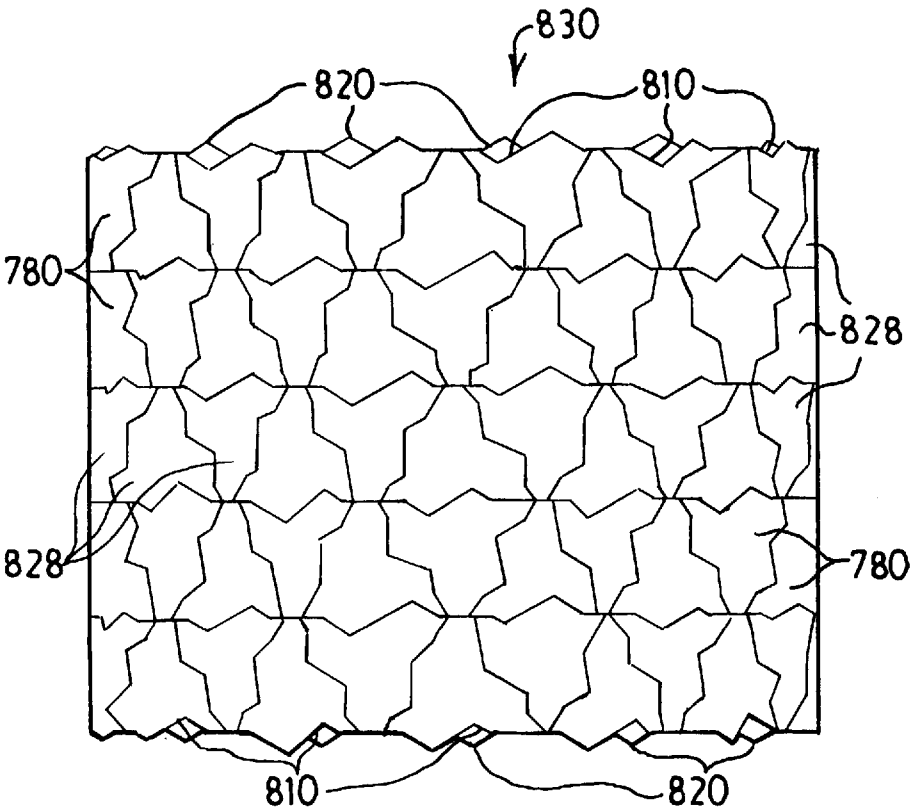
FIG. 106A is a side view of the cylindrical structure shown in FIG. 106.

Referring to FIGS. 106 and 106A, it will be apparent to those skilled in the art that the flat top block 780 can be used to construct a right circular cylinder 830 or a vaulted arch. Each of said embodiments can be built without the use of a parallelogram block 204. Each of said embodiments can also be built without the use of an independent key 168.

Figure 107:
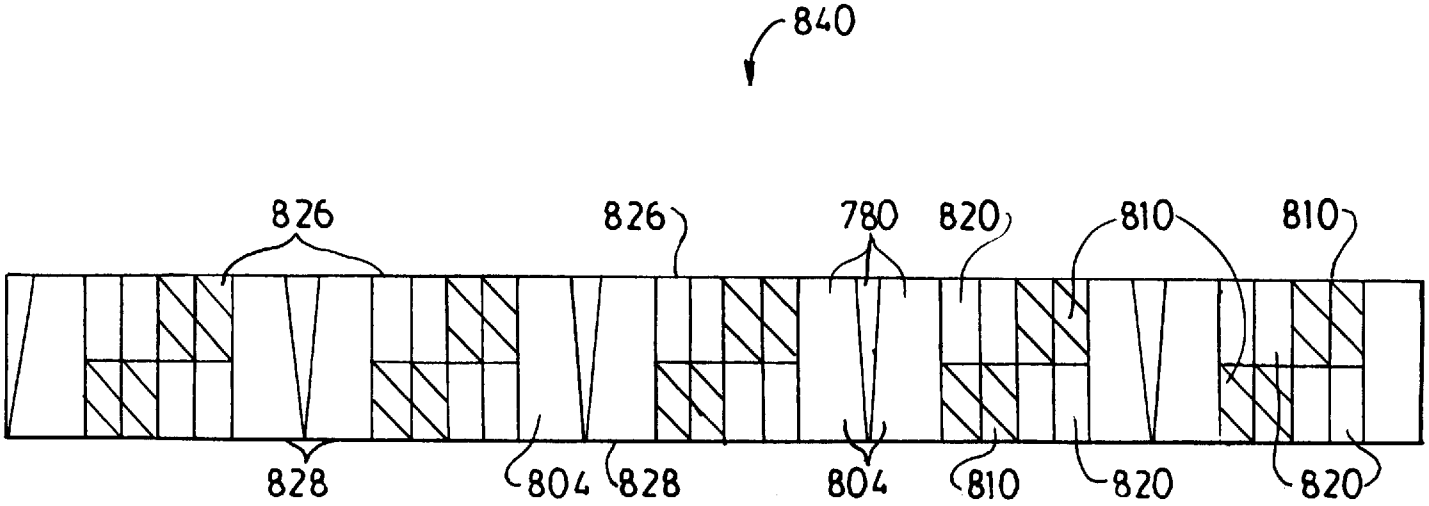
FIG. 107 is a top view of a straight wall structure constructed from the blocks of FIG. 104.
Figure 107A:
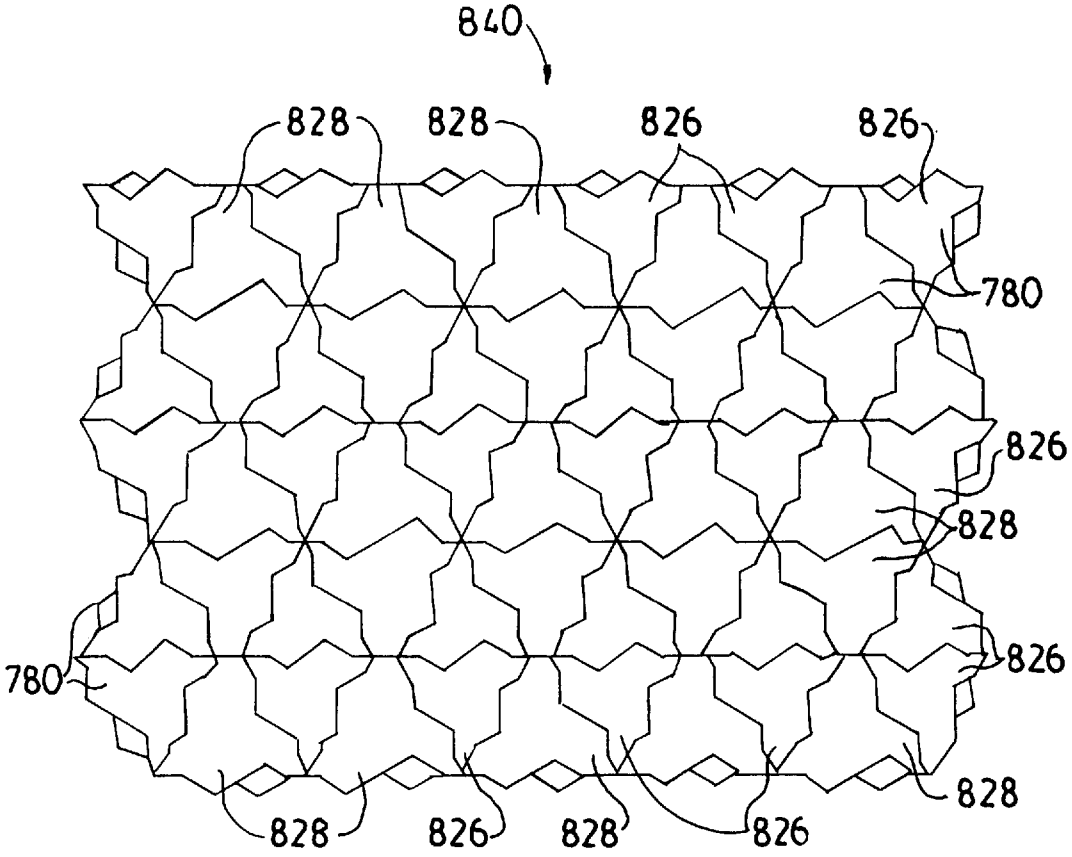
FIG. 107A is a side view of one preferred embodiment of the vertical wall shown in FIG. 107.
Figure 108:
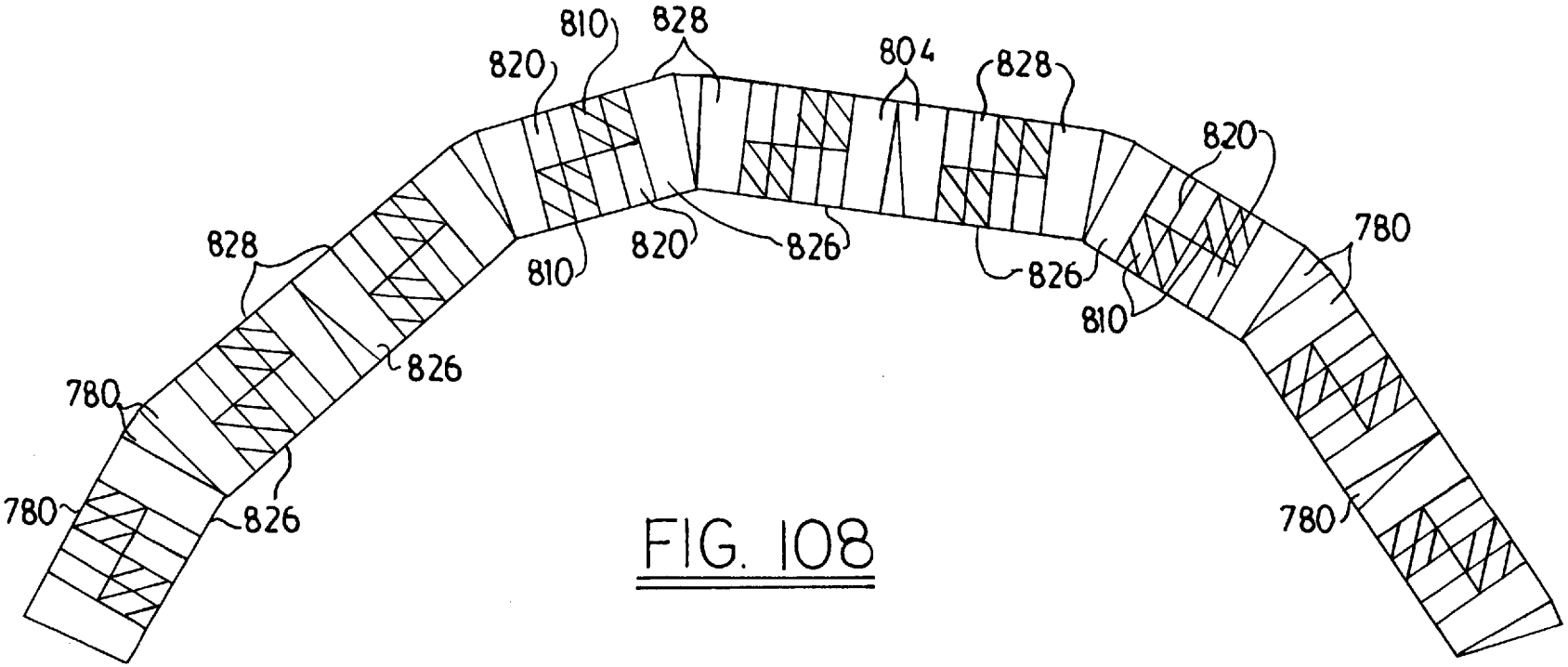
FIG. 108 is a top view of an expanded cylinder constructed from the blocks of FIG. 104.

Referring to FIGS. 107 and 107A, it will be apparent to those skilled in the art that the flat top block 780 can be used to construct a straight wall 840. Said embodiment can be built without the use of a parallelogram block 204. Said embodiment can also be built without the use of an independent key 168.

Referring to FIG. 107B, it will be apparent to those skilled in the art that the flat top block can be used to build a wall slightly inclined from the vertical 850. Said embodiment can be built without the use of a parallelogram block 204. Said embodiment can also be built without the use of an independent key 168.

Figure 23:
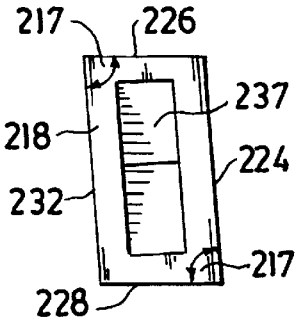
FIG. 23 is a side view of the block of FIG. 19.

Referring to FIG. 23, the flat top block can be seen to incline at an angle 217. That is, the block is slightly inclined from the vertical by an angle of 90 degrees minus (angle 217). As will be apparent to those skilled in the art, this inclination, or leaning, is advantageous for retaining walls 850 and the like. Greater stability is imparted to the wall 850 for the purpose of supporting, retaining or otherwise holding up a load, such as, e.g., earth.

Construction of geodesic dome 10

Referring to FIG. 1, a geodesic dome 10 may be constructed by placing a pentagonal building unit 14 at its apex, by surrounding said building unit 14 with five building unit's 12 and joining them thereto to form a second layer of structure; by joining five pentagonal building units 14 to the bases of the hexagonal building units 12 to form a partial third layer of structure; by inserting six hexagonal building units 12, into the interstices formed between the second layer of building units 12 and the third layer of building units 14 and joining said units; and by thereafter repeating the process until the desired domed shape is formed.

In another embodiment, the dome 10 may be built from the ground up instead of from the top down. In this latter embodiment, a scaffold is not needed to produce dome 10 inasmuch as each layer of structure is supported by the prior layer of structure and by the fasteners used to secure the building blocks together.

When one has produced a geodesic dome with the desired degree of curvature, one may place building units 16 into the interstices formed by the penultimate layer of building units 12 and the last layer of building units 14. Thereafter, one may join the last layer of structure, which now consists of alternating units 14 and 16, to a base (not shown).

By way of further illustration, and referring to FIG. 1, the retaining ring 19 which serves as a base and foundation for the dome 10 may be divided into two designations: those which are contiguous with the exterior edge 91 of the pentagonal isosceles block (also see FIG. 6 and element 91), and those which are contiguous with the interior edge 23 of the hexagonal isosceles block (see FIG. 3). Furthermore, the outer and inner faces of the retaining ring 19 may be contiguous with the outer and inner faces of other blocks; see, e.g., elements 151 and 153 of FIG. 13. The retaining ring 19 may also be contiguous with top and bottom structures such as, e.g., those surfaces which provide a base for the dome to be constructed on those which are common to the exterior edge of the isosceles block (FIG. 6, element 91) and those which are common to the interior edges of the isosceles block (FIG. 2, element 23).

Referring again to FIG. 1, any conventional means may be used to join the dome 10 to the base 19. In one embodiment, not shown, the base 19 is provided with metal brackets (not shown) containing an orifice, and a fastener is inserted through this orifice and the appropriate orifice of the building unit(s). One may sheath the fastener used in this embodiment so that it does not contact the ceramic material.

It will be apparent to those skilled in the art that, if one or more of building blocks 20 and/or 84 break, they may be detached from their adjacent building blocks by removing the fastener(s) therebetween, a new building block may then be inserted in place of the broken block(s), and the new building block(s) may then be fastened to the adjacent blocks. This feature permits the relatively inexpensive repair of a wall comprising said building blocks.

In one preferred embodiment, not shown, an underwater domed structure is provided. Because of the great compressive strength of such a structure, one need not provide an atmosphere at a pressure of substantially greater than 760 millimeters of mercury within the domed structure.

The underwater domed structure of this embodiment may be provided by the means described above, with one exception: one preferably continues the construction of dome 12 until the dome includes an arcuate span of from about 170 to about 360 degrees.

In one embodiment of this invention, a geodesic dome 10 may be used to store radioactive waste. Because dome 10 is comprised of ceramic material which is substantially inert, and which tends to block the propagation of radioactive emissions, it is especially suitable for this purpose.

In one embodiment, not shown, a hexagonally-shaped ceramic structure comprised of at least 90 weight percent of ceramic material is provided. This structure may contain a hollow center; alternatively, it may be a solid structure. In this embodiment, the hexagonally-shaped structure may be used to construct a relatively small structure such as, e.g., a small kiln.

In yet another embodiment, not shown, a pentagonally-shaped structure containing at least 90 weight percent of ceramic material, which may be either hollow or solid, is provided.

In one embodiment of the invention, a process for preparing a ram-pressed green body is provided. In the first step of this embodiment, there is provided a mold comprised of a semi-permeable air hose which, because of the force of air flow, facilitates the separation of the molded body from the mold surface. In the second step of the process, high-strength industrial plaster material (such as "CERAMICAL", which is sold by United States Gypsum Company) is poured into the mold. In the third step of the process, once the plaster material has begun to set, the semi-permeable air hose is purged with compressed air which is drawn by a vacuum directly to the mold surface; the vacuum is directed to specified portions of the mold surface by holes selectively placed in the mold surface.

Figure 17:
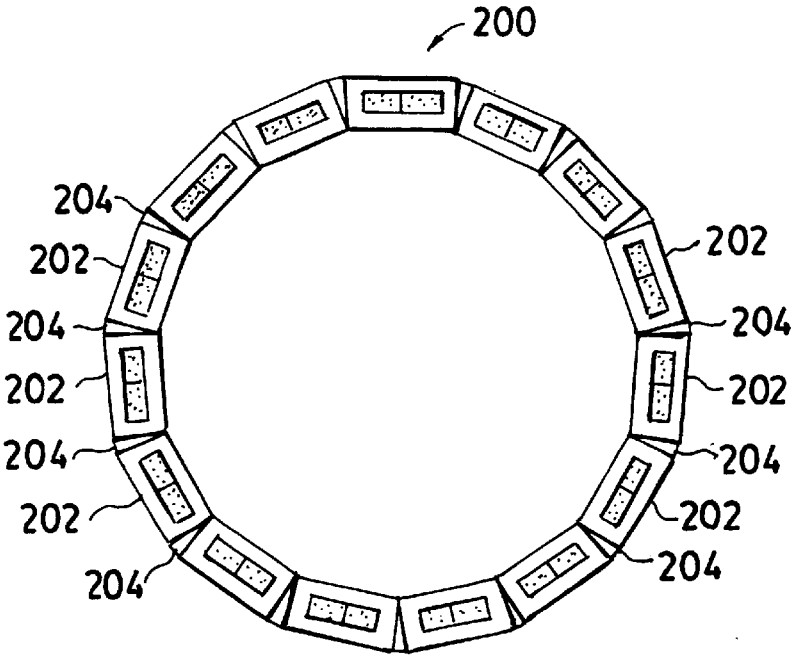
FIG. 17 is a top view of one preferred cylindrical structure of this invention.

FIG. 17 is a top view of a cylindrical structure 200 which is comprised of a multiplicity of building blocks 202 each of which is adjacent to a building block 204. These blocks may be manufactured in accordance with the procedures described in the first portion of this specification; they may be constructed out of plastic by conventional reaction injection molding, injection molding, blow molding, casting, vacuum and pressure forming, machining, and the like; and they may be formed by other techniques.

As will be apparent to those skilled in the art, the structure of FIG. 17 may be used not only to construct a cylinder but any portion of a cylinder. Thus, e.g., one may construct a portion of an arch with such a configuration.

In one preferred embodiment, fifteen blocks 202 (or an integral multiple of fifteen such blocks) are used in each layer 206 (see FIG. 18) of cylindrical structure 200. In such preferred embodiment, fifteen blocks 204 (or an integral multiple of fifteen such blocks) are also used in each layer 206. It will be apparent to those skilled in the art that an equal number of blocks 202 and blocks 204 are preferably used in each such layer 206.

Figure 19:
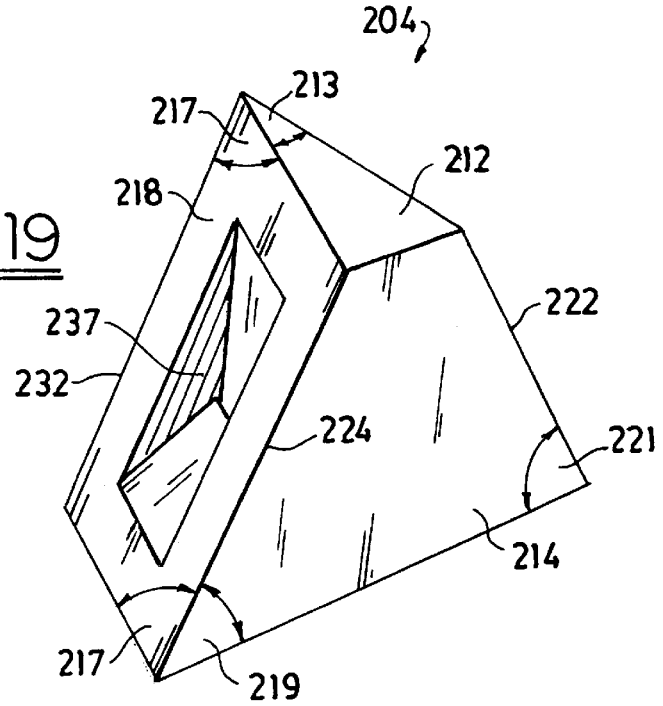
FIG. 19 is a perspective view of a first preferred building block which may be used to construct the structure of FIG. 17.
Figure 24:
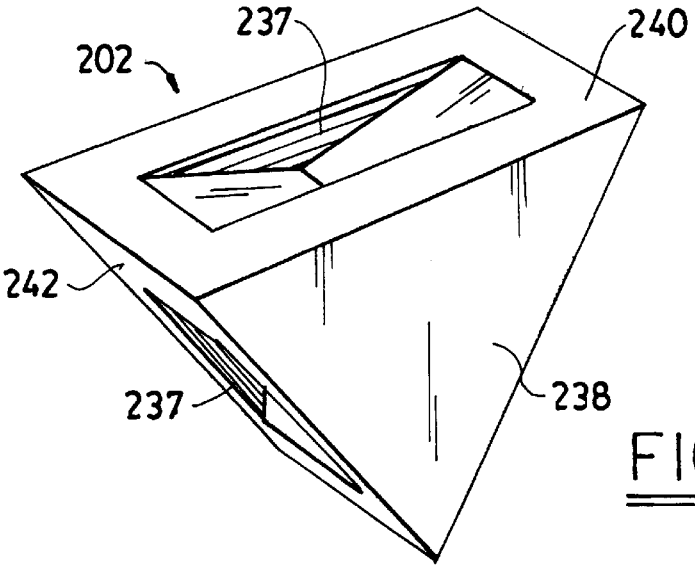
FIG. 24 is a perspective view of a second preferred building block which may be used to construct the structure of FIG. 17.
Figure 27:
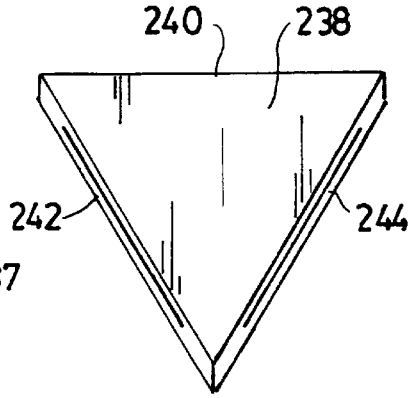
FIG. 27 is a front view of the block of FIG. 24.
Figure 28:
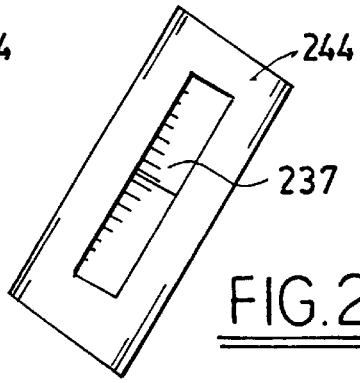

By way of further illustration, the cylindrical bricks illustrated in FIGS. 19 and 24 which are used to build a cylinder (hereafter referred to as "flat top" 204 [see FIG. 19] and a "parallelogram" 202 [see FIG. 24]) may also have their edge faces uniquely designated for simple assembly. The flat top brick 204 has a bottom edge which has a unique designation (see element 207, FIG. 19). The top edge of the flat top 204 has a unique designation (see element 203, FIG. 19). The oblique left side of the flat top brick 204 (see FIG. 19, element 218) also has a unique designation shared with the oblique right side of parallelogram 202 (see FIG. 27, element 244). The oblique right side of the flat top 220 (see FIG. 19) has a unique designation shared with the oblique left side of the parallelogram 242 (see FIG. 27). The bottom edge of the parallelogram 202 has a unique designation 240 (see FIG. 25).

As will be illustrated later in this specification, blocks 202 may be connected to blocks 204 by means of plugs 168 (see FIG. 15).

Figure 18:
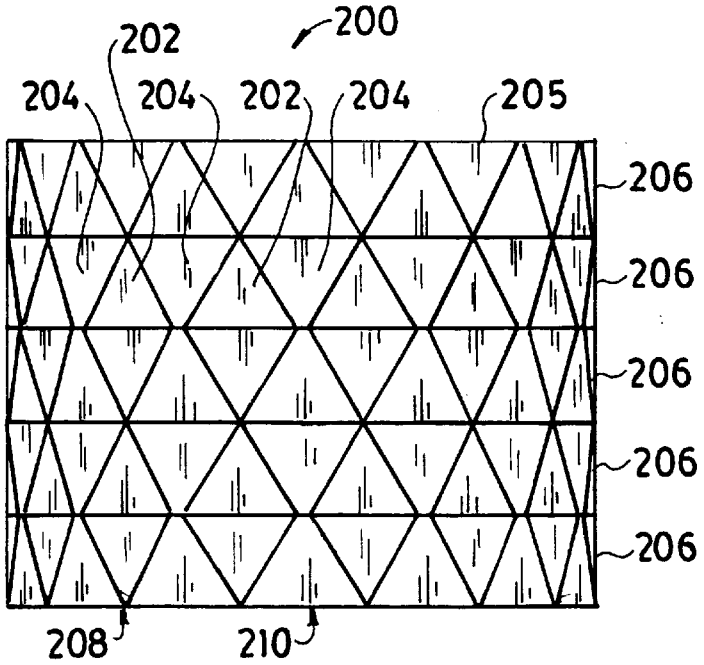
FIG. 18 is a side view of the structure of FIG. 17.

FIG. 18 is a side view of the structure of FIG. 17. It will be seen that, in any one layer 206 (such as, e.g., the second layer from top 205 of structure 200), each block 202 is adjacent to two blocks 204, and each block 204 is adjacent to two blocks 202. However, in the vertical direction (see course 208) one layer of blocks 202 are vertically stacked so that two blocks 202 are joined base to base, and the next two blocks 202 are joined tip to tip, and the next two blocks 202 are joined base to base, etc. Similarly, in the vertical direction (see course 210), two blocks 204 are stacked tip to tip, and the next two blocks 204 are stacked base to base, and the next two blocks 204 are stacked tip to tip, etc. The blocks 202 and 204 may be joined to each other by the means described elsewhere in this specification.

FIG. 19 is a perspective view of building block 204. Building block 204, like building block 20 and building block 84 and building block 202, is preferably comprised of at least 90 weight percent of ceramic material, which material is discussed and described elsewhere in this specification.

In one preferred embodiment, building block 204 and/or 20 and/or 84 and/or 202 consists essentially of plastic material. As is known to those skilled in the art, a plastic is a material that contains as an essential ingredient an organic substance of large molecular weight, is solid in its finished state, and, at some stage in its manufacture or in its processing into finished articles, can be shaped by flow. See A.S.T.M. Standards D 1695, D-23, C 582, and C-3. Also see the "Modern Plastics Encyclopedia '92" (the mid-October 1991 issue of Modern Plastics, Volume 68, Number 11). Thus, e.g., one or more of such blocks may consist essentially of such plastics as polystyrene, polyvinyl chloride, high density polyethylene, nylon, and the like.

In another embodiment, not shown, one or more of such blocks may consist essentially of a plastic/ceramic composite material.

In one embodiment, not shown, block 204 can be constructed with window sections similar to window sections 142, 144, and 146 (see FIGS. 10 and 11).

Figure 20:
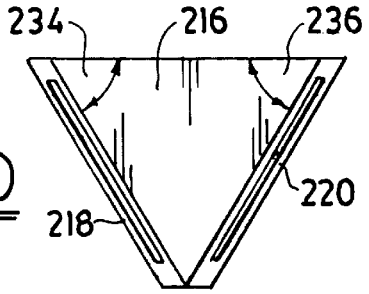
FIG. 20 is a back view of the block of FIG. 19.

Referring again to FIG. 19, it will be seen that block 204 is preferably comprised of at least six sides, including top side 212, front side 214, back side 216 (not shown in FIG. 19, but see FIG. 20), left side 218, and right side 220 (not shown in FIG. 19, but see FIG. 20).

Top side 212 is the truncated tip of beveled sides 218 and 220 and has a substantially triangular cross-sectional shape. It is preferred that top side 212 have a cross-sectional shape which is an isosceles triangle.

Front side 214 is in the shape of a trapezoid, which is comprised of two equal edges 222 and 224 (see FIG. 19).

Rear side 216 is in the form of a triangle (see FIG. 20) which may be, but need not be, in the form of an equilateral triangle.

Left side 218 and right side 220 are in the form of parallelograms. Thus, referring to FIG. 23, top edge 226 is parallel to bottom edge 228, and right edge 224 is parallel to left edge 232.

The apex of side 212 is formed by an acute angle 213 which, preferably is equal to or substantially equal to 360 degrees divided by the number of blocks 204 in any particular layer 206. Thus, e.g., if there are 15 such blocks in layer 206, angle 213 will be about 24 degrees. If there are 30 such blocks in layer 206, angle 213 will be 12 degrees. In general, it is preferred that angle 213 be from about 4 to about 24 degrees.

Referring again to FIG. 19, and the trapezoid defined by side 214, it is preferred that angle 219 be equal to angle 221 and that each of angles 219 and 221 be from about 30 to about 70 degrees.

Referring again to FIGS. 19 and 23, the angle 217 in the parallelogram defined by side 218 is less than ninety degrees and, preferably, will be from about 86 to about 89.5 degrees.

It is preferred that the precise angle 217 be equal to 90−x, wherein x is equal to (90−y/90)·z, wherein y is the number of degrees in angle 219 (or angle 221), and wherein z is equal to one half of the number of degrees in angle 213.

It will be appreciated by those skilled in the art that right side 220 will be congruent with left side 218 and, thus, will also contain two angles 217. Furthermore, referring to FIG. 20 and the side 216 depicted therein, it will be seen that angles 234 and 236 are equal to each other and also equal to angles 219 or 221.

Figure 21:
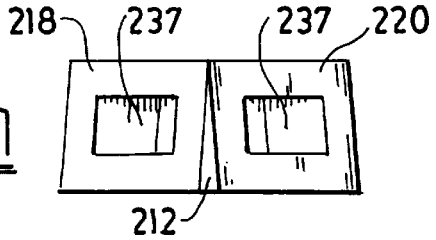
FIG. 21 is a top view of the block of FIG. 19.
Figure 22:
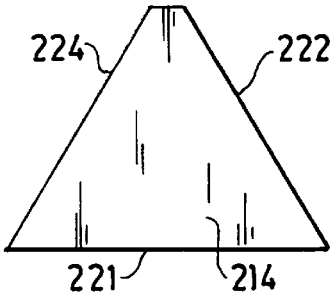
FIG. 22 is a front view of the block of FIG. 19.

FIG. 21 is top view of block 204. FIG. 22 is a front view of block 204.

Referring to FIGS. 19, 20, 21, and 23, it will be seen that, in the preferred embodiment illustrated in these Figures, a means is provided for connecting block 204 with an adjacent block 202. This means is similar to the means described elsewhere in this specification for joining adjacent building blocks 154, 156, and 158. In this embodiment, each of block 202 and block 204 of these substantially solid building blocks is preferably comprised of a substantially triangular orifice; when two of such orifices are placed base to base, they define a substantially diamond-shaped figure (see FIG. 12).

Referring again to FIG. 12, it can be seen that diamond shaped plug 160, 162, and 164 may be placed into the triangular orifices, such as orifices 166, 168, and 170. In a similar manner, and referring to FIGS. 19, 21, and 23, such a plug may be placed into orifice 237.

As will be apparent to those skilled in the art, block 224, in addition to containing such substantially triangular shaped orifice 237 on sides 218, on side 220, and on bottom side 221 (see FIG. 22).

In the preferred embodiment illustrated in FIGS. 19 through 22, the preferred plug used to connect block 204 with block 202 is substantially identical to the plug 168 which is illustrated in FIG. 15 and is discussed elsewhere in this specification.

FIG. 15 illustrates the shape of the preferred plug 168 which may be used in the embodiment of FIG. 12. In this embodiment, it is preferred that plug 168 define a four-sided figure containing two substantially acute angles 171 and 172 of about 60 degrees and two substantially obtuse angles 174 and 176 of about 120 degrees.

FIG. 24 is a perspective view of a second block, block 202, which also is used in the structure 200 of FIG. 17. As will be seen from FIG. 24, block 202 also contains orifice 237 on each of sides 240, 242, and 244.

Figure 25:
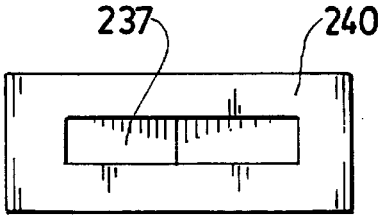
FIG. 25 is a top view of the block of FIG. 24.
Figure 26:
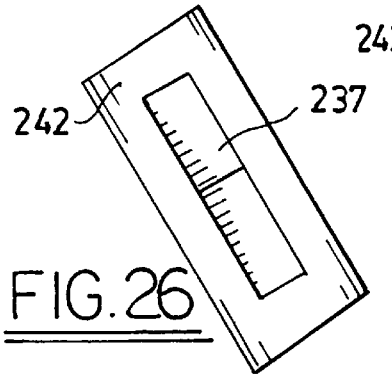
FIGS. 26 and 28 are each side views of the block of FIG. 24.

Referring to FIGS. 24 and 25, it will be seen that side 240 has a substantially rectangular shape. However, each of sides 242 and 244 are in the shape of a parallelogram with the same size and shape as the parallelogram defined by sides 218 and 220 of block 204 (see FIGS. 19 through 22).

Side 238 is in the shape of an isosceles triangle and is congruent to the isosceles triangle defined by side 216 of block 24 (see FIG. 20).

The triangle on the opposing side of side 238 (not shown in these Figures) is congruent to the triangle defined by side 238.

The building block 202 may be constructed in the same or similar manner, and contain the same or similar materials, as the building block 204.

FIG. 29 illustrates a substantially straight wall structure which is comprised of a multiplicity of substantially triangular building blocks 248. Referring to FIG. 30, which is a front view of block 248, it will be seen that the front face 250 of block 248 (and its back face, not shown, which is congruent to front face 250) is an isosceles triangle with sides 252 and 254 being equal. In one especially preferred embodiment, each of sides 252, 254, and 256 of block 248 are equal.

FIG. 31 is a front view of face 254. FIG. 32 is a front view of face 252. FIG. 33 is a front view of face 256. In the preferred embodiment illustrated in these Figures, each of face 252, 254, and 256 is in the shape of a rectangle.

Referring again to FIG. 29, two of building blocks 248 may be stacked to form a straight walled structure (which may be in the form of a parallelogram) 258. When a multiplicity of parallelograms 258 are placed in abutting connection (as, e.g., by means of plugs 168), the substantially straight walled structure of FIG. 29 is produced.

Figure 37:
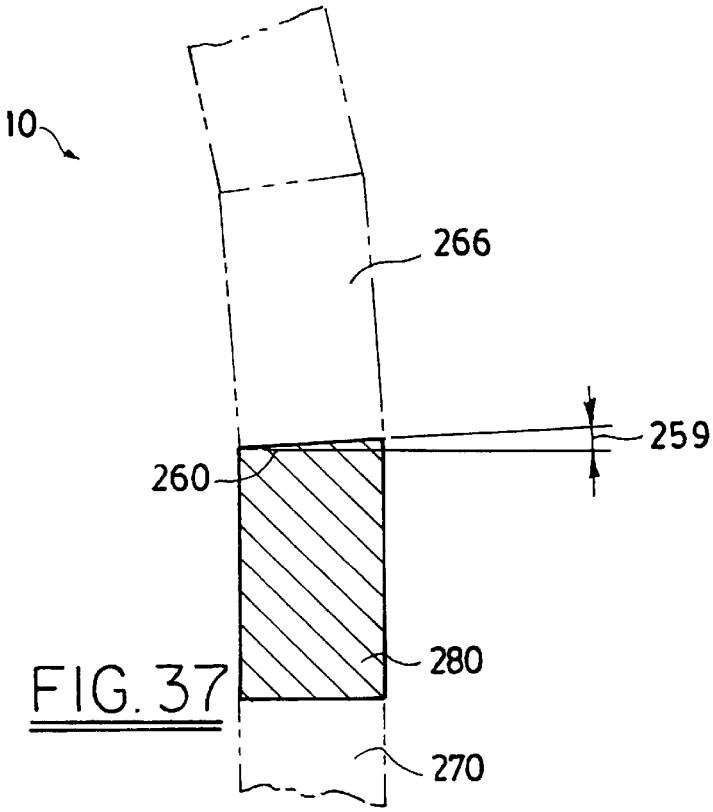
FIG. 37 is sectional view of the structure of FIG. 34.

When a geodesic dome 10 is produced in accordance with the procedure of this invention (see FIG. 1), the bottom surface of such dome will not be normal to the horizon. Referring to FIG. 37, it will be seen that geodesic dome 10 (only a portion of which is shown for the sake of simplicity) will form an angle 259 (often referred to as a bevel angle) with a flat surface 260 on which it is placed. Thus, as is disclosed elsewhere in this specification, the geodesic dome includes an arcuate span of less than 174 degrees on any vertical cross section thereof; consequently, angle 259 is at least 3 degrees.

The need for some means to stabilize the juncture of the geodesic dome and another structure is illustrated in FIGS. 34 through 37.

Figure 34:
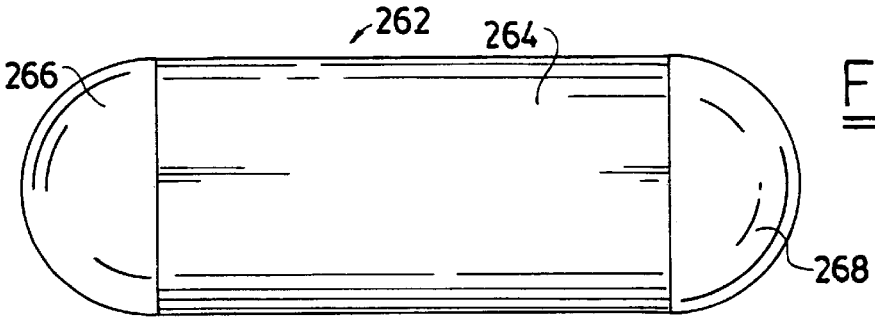
FIG. 34 is a top view of another preferred structure of applicants' invention.

FIG. 34 is a top view of one preferred building structure which is comprised of an arched section formed by half a cylinder 264 (which may be constructed by blocks 202 and 204), a first half of a geodesic dome 266 (which may be constructed by blocks 20 and 84), and a second half of a geodesic dome 268 (which also may be formed by blocks 20 and 84).

Figure 35:
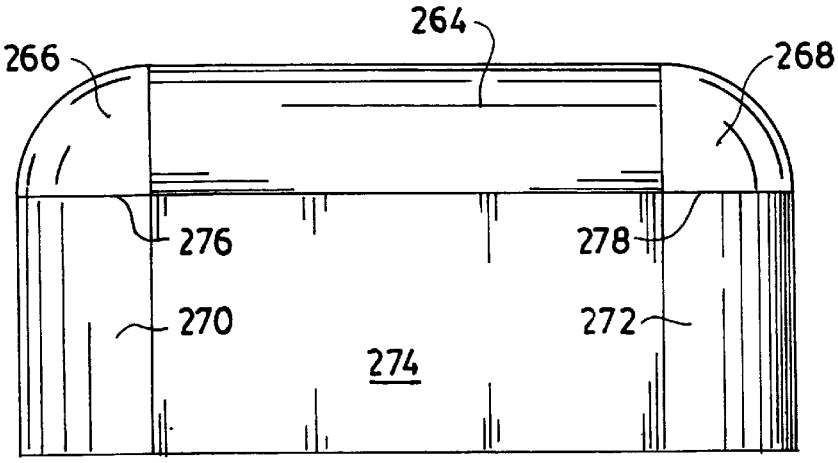
FIG. 35 is a side view of the structure of FIG. 34.
Figure 36:
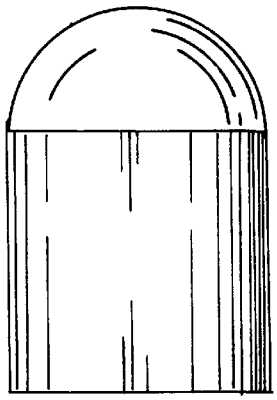
FIG. 36 is an end view of the structure of FIG. 34.

FIG. 35 is a side view of the structure 262 of FIG. 34. Referring to FIG. 35, it will be seen that structure 262 also is comprised of substantially cylindrical sections (half a cylinder) 270 and 272, each of which may be constructed from blocks 202 and 204. Furthermore, structure 262 also is comprised of substantially straight walled structure 274, which may be constructed from blocks 248.

Referring again to FIG. 35, the junctures 276 and 278 where sections 266 and 268 abut sections 270 and 272 produce an abutment which is substantially less than perfect. This abutment is illustrated in FIG. 37.

Referring to FIG. 37, it will be seen that a juncture ring 280 has been placed between section 266 and section 270 to compensate for the bevel 259 caused by section 266. In a similar manner, a similar junction ring may be placed at the junction 278 between section 268 and section 272. A preferred embodiment of this juncture ring is illustrated in FIGS. 38 through 42.

FIG. 38 is a perspective view of a first juncture ring block 282 which has a front face 284 which is substantially triangular in cross section. It is preferred that the front face 284 form a substantially isosceles triangle and, in one especially preferred embodiment, form a substantially equilateral triangle.

FIG. 39 is a side view of the juncture ring block 282 of FIG. 38. It will be seen that, in the embodiment depicted, back face 286 (not shown in FIG. 38, but shown in FIG. 39) will have a height which is less than the height of front face 284. Thus, a bevel will form an angle 259 (see FIGS. 39 and 37).

It will be apparent to those skilled in the art that the juncture ring block 282 of FIGS. 38 and 39 will decrease in width from point 290 to point 292. By comparison, the juncture ring block 294 of FIGS. 40 through 42 will also decreases in width from point 296 to point 298.

FIG. 40 is a top view of juncture ring block 294 illustrating apex 298. FIG. 41 illustrates that apex 298 has a bevel 300 from outer face 302 to the inner face 304 (see FIG. 41) of angle 259.

As will be apparent to those skilled in the art, block 282 may be placed on the top of section 270 (see FIG. 37), and block 294 may be placed adjacent to block 282. A ring structure similar to the one depicted in FIG. 17 may be formed from such alternating blocks 282 and 294 and form the ring juncture.

In one embodiment, not shown, one or more of the building blocks of this invention is joined by means of a plug 168 in which one or more of the apexes of triangular halves of the plug are rounded off.

In one embodiment, not shown, one or more of the building blocks of this invention is connected to one or more adjacent blocks by means of an expandable plug disposed within orifice 237 which, in whole or part, can replace static plug 168. Alternatively, one may have a multiplicity of expandable pins per face. In one embodiment, at least one face of the building block will have neither such a pin/plug assembly or an orifice 237.

In one embodiment, instead of being constructed from either ceramic material or plastic material, one or more of the building blocks of this invention consists essentially of a metal material, such as aluminum, steel, iron, and the like.

In one embodiment, the plug 168 is so constructed that an elastomeric gasket material extends from the middle plane of the plug. In this embodiment, when the plug is used to connect two adjacent building blocks, the juncture of such blocks is separated by the elastomeric gasket material.

Figure 43:
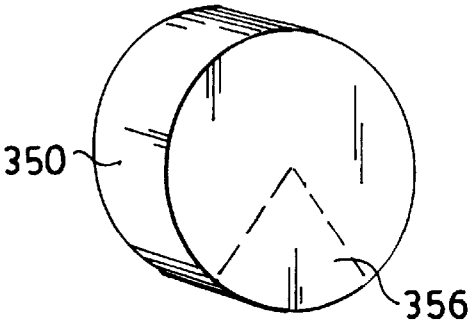
FIG. 43 is a perspective view of a substantially circular key which can be used to join adjacent building blocks.
Figure 44:
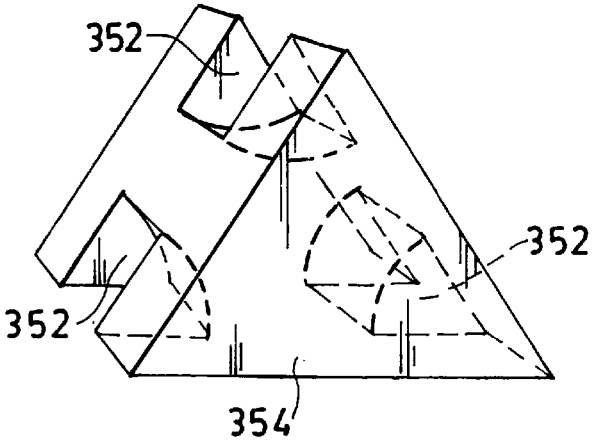
FIG. 44 is a perspective view of a building block which is adapted to be joined with the key of FIG. 43.
Figure 45:
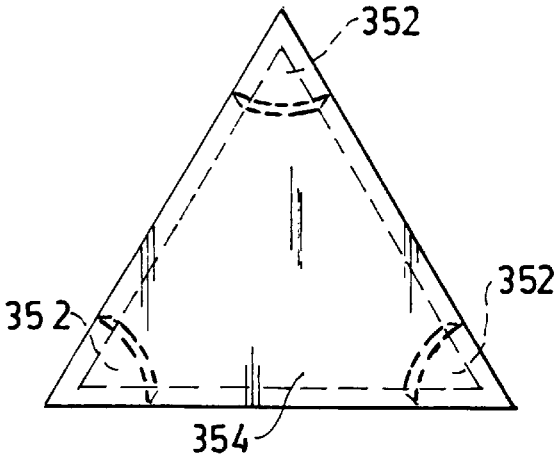
FIG. 45 is a top view of the block of FIG. 44.
Figure 46:
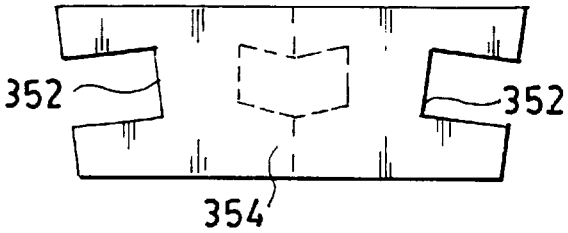
FIG. 46 is a side view of the block of FIG. 44.

The diamond shaped key 168 illustrated in FIG. 15 may be replaced either by a polygonal key (not shown) or by a circular disk key 350 (see FIG. 43) which may be inserted not into a notch of the abutting edge face (see element 168 of FIG. 13) of the building block, but in the abutting edge tip. Thus, e.g., referring to FIG. 44, the disk key 350 may be inserted into abutting edge tips 352 of building block 354. as will be apparent to those skilled in the art, section 356 of disk key 350 is adapted to exactly fit and mesh with recessed grooves 352.

Figure 47:
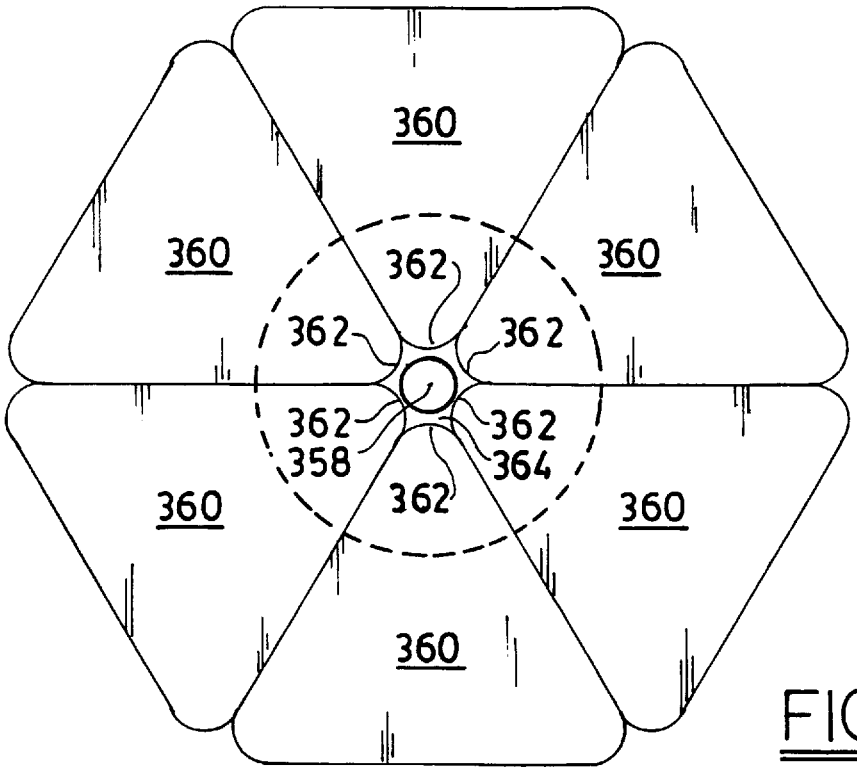
FIG. 47 is a top view of a structure whose blocks are joined by the key of FIG. 43 and a rod depicted in FIG. 49.
Figure 48:
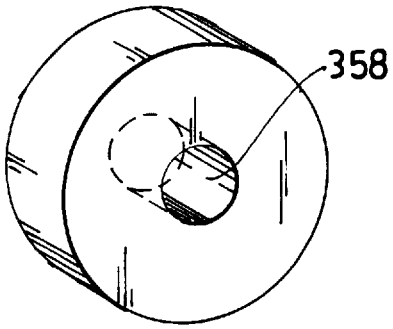
FIG. 48 is a perspective view of a disk shaped key which may be used to join adjacent building blocks.
Figure 49:
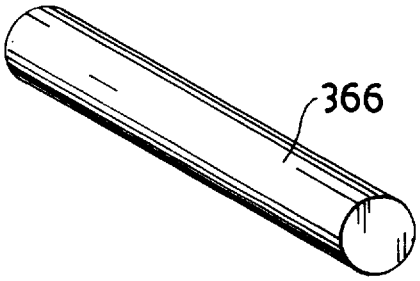
FIG. 49 is a perspective view of a rod which may be used in conjunction with the key of FIG. 48.

Referring to FIG. 47, the circular disk key (or the polygonal disk key) may have a hole 358 through the center of it. If the triangular unit blocks 360 are rounded at their tips 362, then wherever five or six tips meet, a small hole 264 is created. This hole 364 will be located exactly where the hole 358 in the polygon or circular disk key 350 is located. A rod 366 (see FIG. 49) may be inserted through these holes, thus further anchoring blocks 360 and key 350. Use of a polygonal or circular disc key allows for the assembly of blocks without creating an undercut until the structure is completed.

Figure 50:
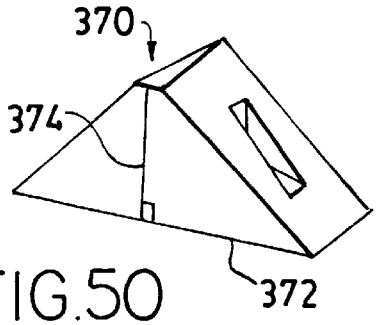
FIG. 50 is a perspective view of a six-sided building block.

FIG. 50 is a perspective view of a flat-top block 370 which is similar in some respects to the flat-top block 204 of FIG. 19.

In the preferred embodiment illustrated in FIG. 50, the block is constructed so that one half of the base 372 is proportional to the altitude 374 of block 370 by the approximate ratio of from 1.45/1 to about 1.65/1 and, more preferably, 1.55/1 to 1.59/1. Blocks which are made in these ratios may be used to construct a right circular cylinder section of wall with a spiral or helical edge, that is, an edge to a wall with both translation and rotation. Such cylindrical walled sections may be placed atop vertical walls which meet at right angles, in order to create a vaulted arch roof and ceiling. These cylindrical walled sections will meet exactly at both the vertical wall corners and at the center of the structure. The gap created by the helical edge of these contiguous cylindrical wall sections is an interesting and noteworthy shape (referred to as the "required surface"). Those bricks described above will hereafter be referred to as orthodesic, and the intersection of right circular sections made of such bricks will be called orthodesic structures.

The orthodesic block 370 as a triangle is an acute unit shape with sharp corners. These sharp corners create a weaker unit shape. Thus two adjacent and similar orthodesic blocks (not shown) may be made as a single diamond shaped block comprised of two triangular shapes. The resulting shape is stronger and more stable.

Figure 51:
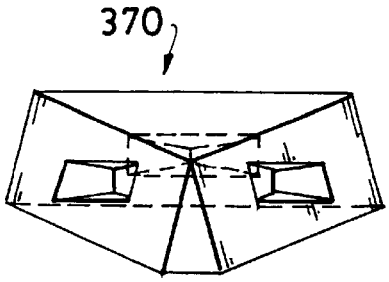
FIG. 51 is a top view of the block of FIG. 50.
Figure 52:
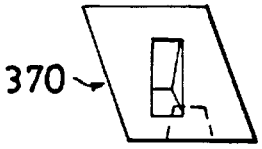
FIG. 52 is a side view of the block of FIG. 50.
Figure 53:
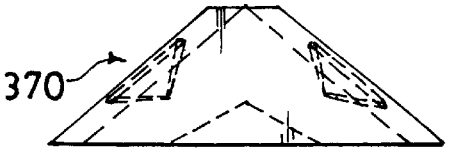
FIG. 53 is a front view of the block of FIG. 50.

FIG. 51 is a top view of the block 370. FIG. 52 is a side view of the block 370.

Figure 54:
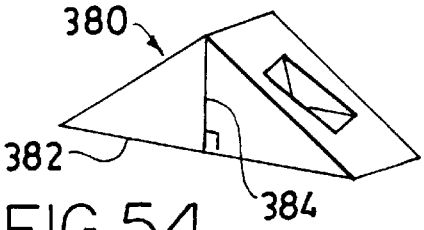
FIG. 54 is a perspective view of a five-sided building block.

FIG. 54 is a perspective view of a parallelogram block 380 which is similar in many respects to the parallelogram block 202 of FIG. 24. In this embodiment, the block 380 is constructed so that one half of the base 382 is proportional to the altitude 384 of block 380 by the approximate ratio of from 1.45/1 to about 1.65/1 and, more preferably, 1.55/1 to 1.59/1.

Figure 55:
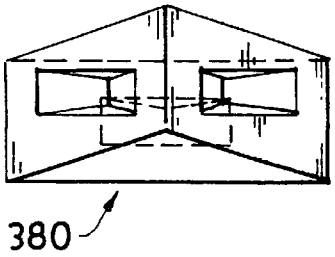
FIG. 55 is a top view of the building block of FIG. 54.
Figure 56:
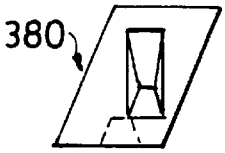
FIG. 56 is a side view of the building block of FIG. 54.
Figure 57:
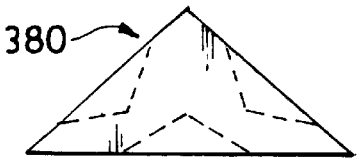
FIG. 57 is a front view of the building block of FIG. 54.

FIG. 55 is a top view of block 380. FIG. 56 is a side view of block 380. FIG. 57 is a front view of block 380.

Figure 58:
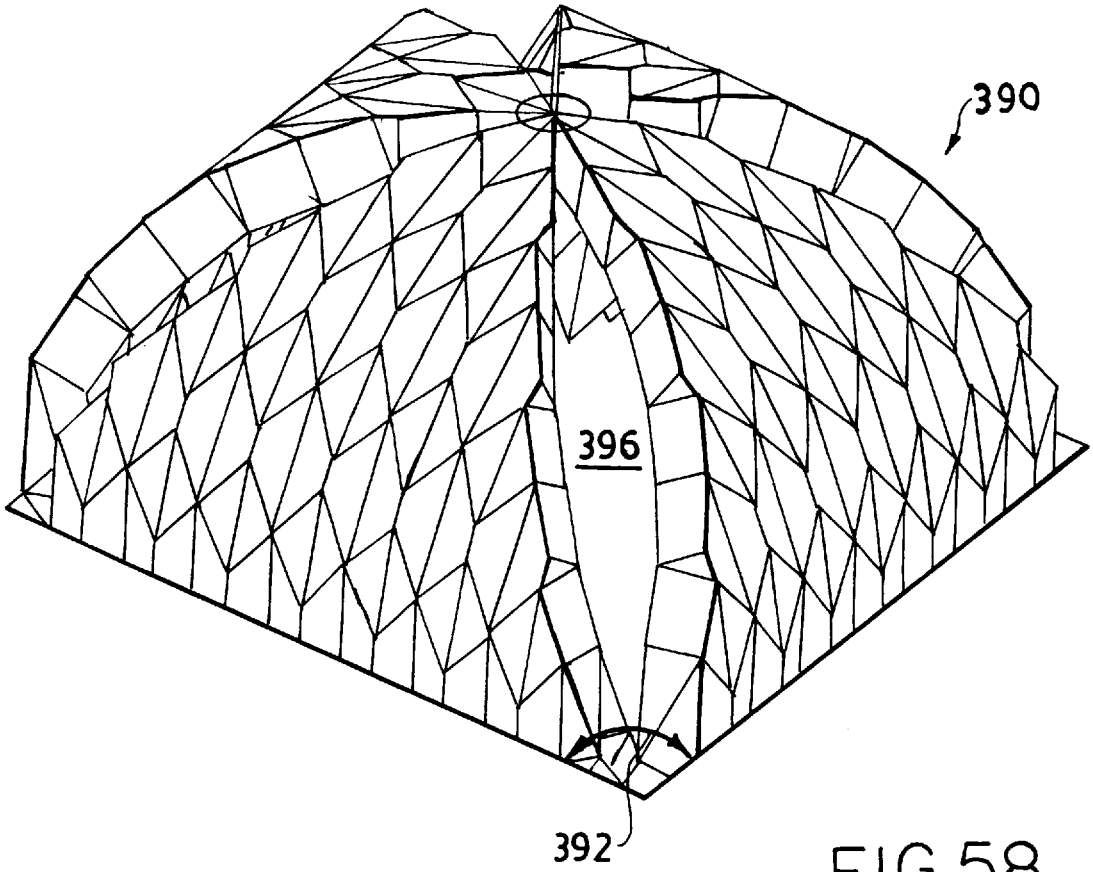
FIG. 58 is a perspective view of a turn-in structure made with the blocks of FIGS. 50 and 54.

FIG. 58 is a perspective view of an orthodesic turn-in structure 390 in which angle 392 is about ninety degrees.

The orthodesic structures created by orthodesic bricks 370 and 380 (see FIGS. 50 and 54) may complete a 90 degree corner 392, hereafter called a "turn-in". These same bricks 370 and 380 bricks may also be used to complete a 270 degree corner 394 (see FIG. 60), hereafter called "turn-out".

The turn-in intersection of the helical edges of the right circular cylinder sections (see element 396, FIG. 58), and the turn out intersection of the helical edges of the right. circular cylinder sections (see element 398 of FIG. 60), result in the created surface as described below (i.e., a cylindrical section, a spherical section, toroidal section, or an elliptical toroidal section). In the instance of a turn in, the edges of the required surface 396 are convex relative to the required surface 396. In the instance of a turn out, the edges of the required surface 398 are concave relative to the required surface 398.

Figure 59:
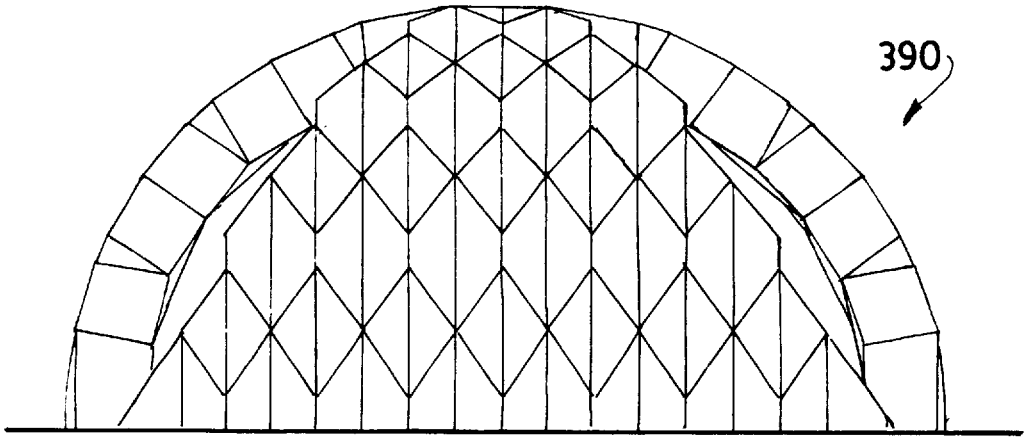
FIG. 59 is an end view of the structure of FIG. 58.

FIG. 59 is an end view of orthodesic turn in section 390.

Figure 60:
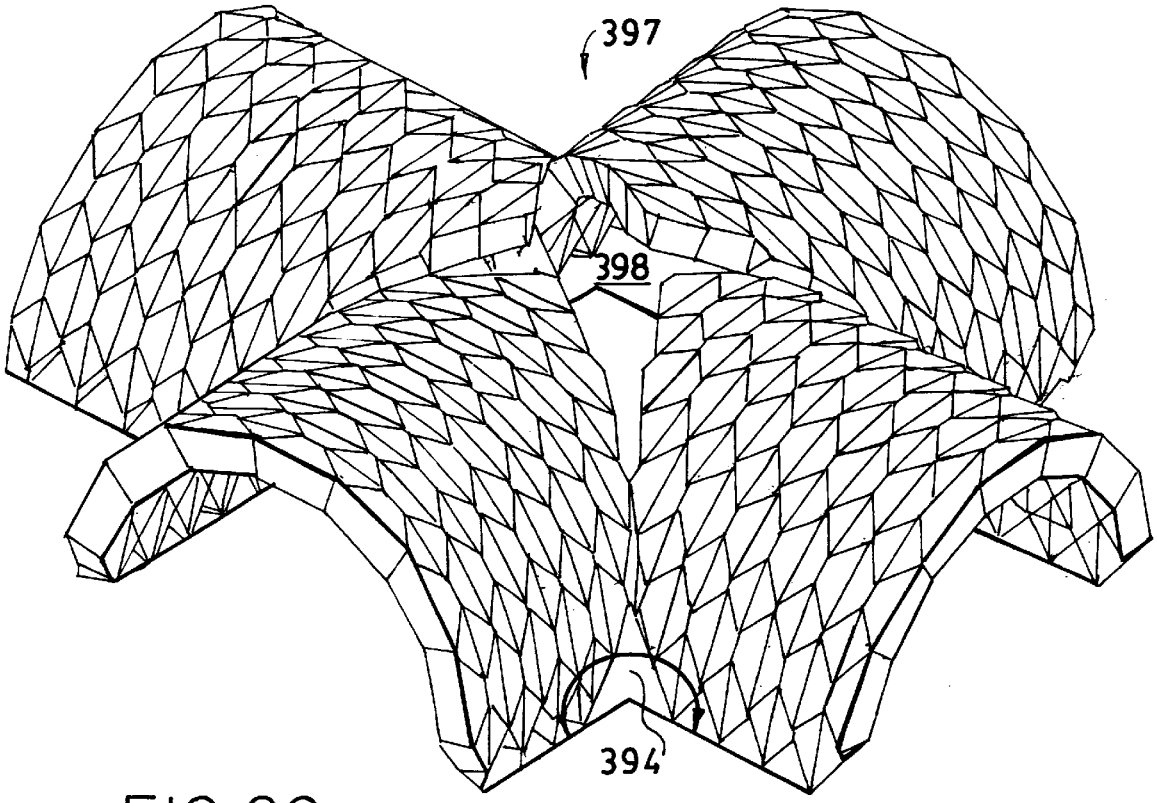
FIG. 60 is a perspective view of a turn-out structure made with the blocks of FIGS. 50 and 54.
Figure 61:
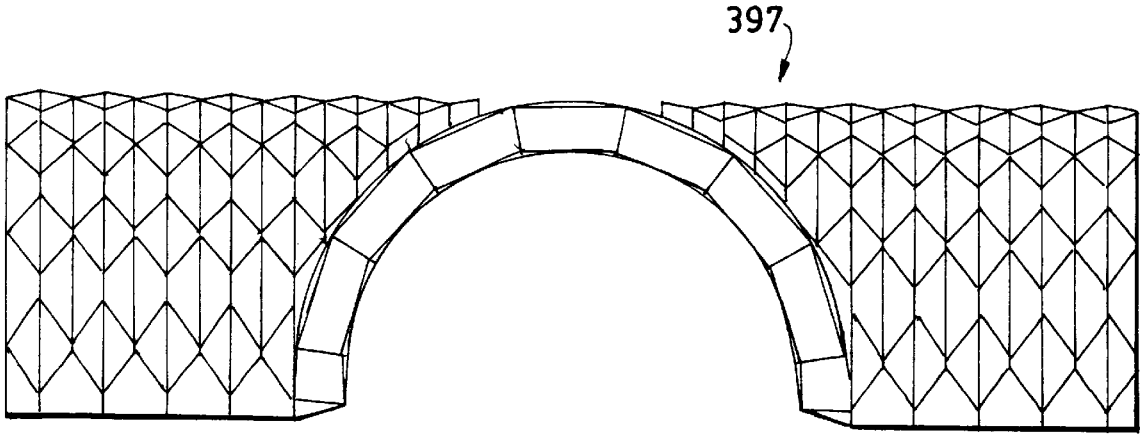
FIG. 61 is an end view of the structure of FIG. 60.
Figure 62:
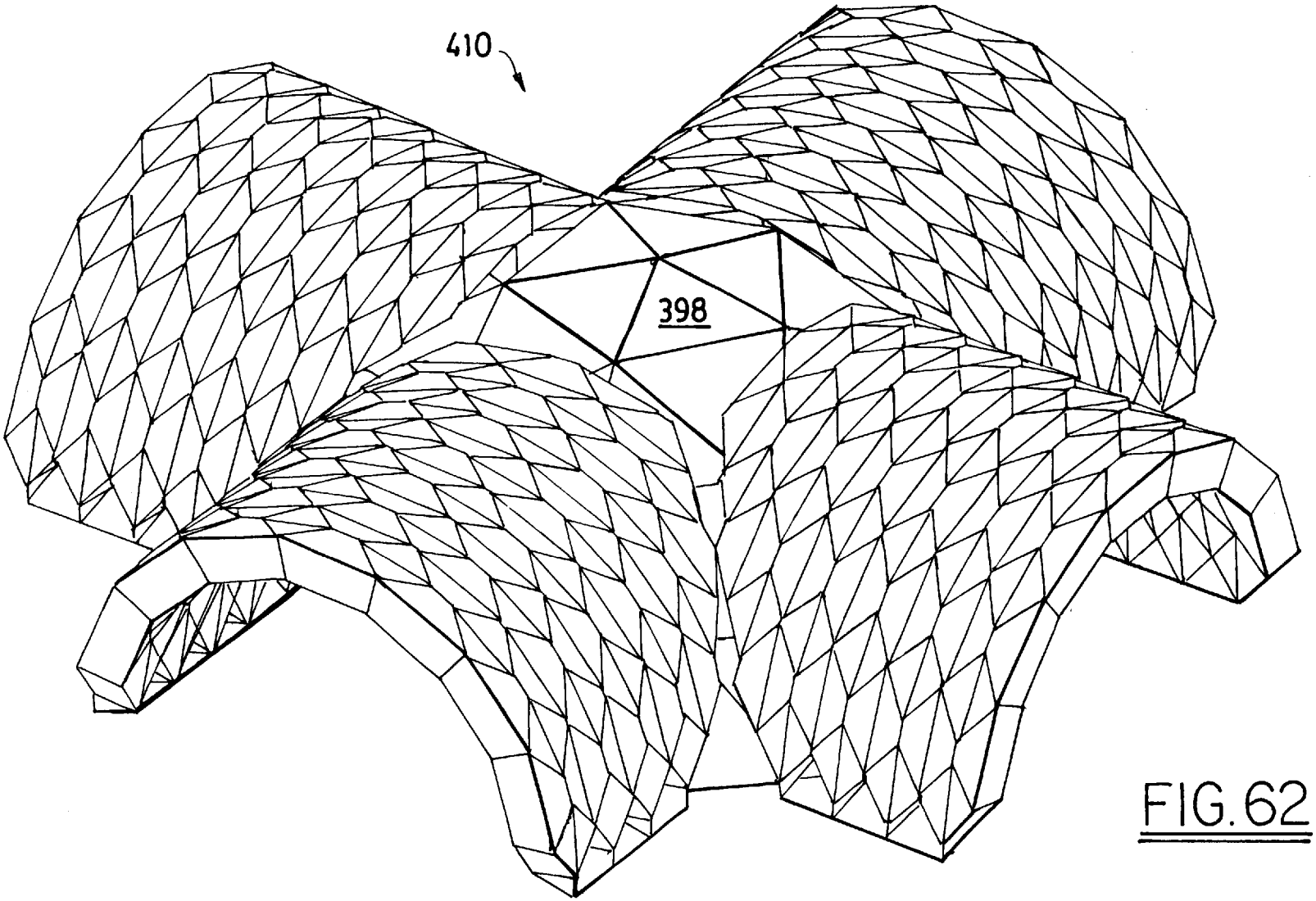
FIG. 62 is a perspective view of another turn-out structure.
Figure 63:
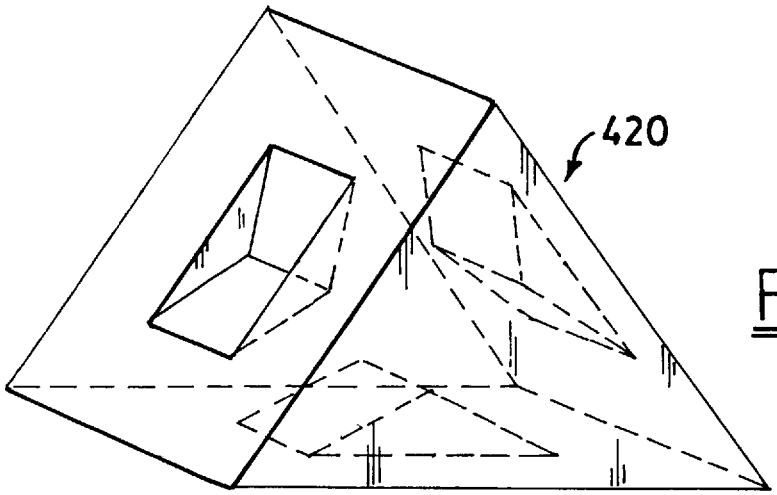
FIG. 63 is a perspective view of an isosceles straight wall block.

FIG. 60 is a perspective view of orthodesic turn out section 397.

The required surface for orthodesic structures is shaped approximately like an eye. Those skilled in the art will appreciate that (from a bird's eye view) the edge of the required surface represents the graph of a sine function from −pi/2 to +pi/2, rotated through 90 degrees four times, super-imposed and mirrored about the four fold axis. The widest part of the required surface will be referred to as the "haunch".

Those skilled in the art will appreciate that the required surface is close to a section of a right circular cylinder. If the original right circular walled sections with helical edges are of radius 1 then the required surface is most exactly a section of a right circular cylinder of radius 1.5 with an axis at 0.5 below the intersection of the original axes of the orthodesic cylinders of radius 1.0. The 1.5 radius right circular cylinder is turned at 45 degrees to the original walled section, in the plane of the axes. This 1.5 radius cylinder varies from the required surface by being the furthest out from said surface at the haunch.

The maximum deflection of the 1.5 radius cylinder from the required surface is less than 1.0% of the diameter of the 1.0 radius cylinder.

Those skilled in the art will appreciate that the required surface is closer to a section of a sphere. If the original right circular cylinder walled sections with helical edges are of radius 1.0 then the required surface is almost more exactly a section of a sphere of radius 1,5 with the center located 0.5 below the original right circular cylinder's intersecting centers, or axes. The 1.5 radius sphere varies from the required surface by being furthest out from said surface at the haunch. The maximum deflection of the 1.5 radius sphere from the required surface is less than 0.5% of the 1.0 radius cylinder.

Furthermore, those skilled in the art also will appreciate that the required surface is closer still to a section of a round circular torus. If the original right circular cylinder walled sections with helical edges of radius 1.0 then the required surface is almost even more exactly a section of a torus of radius 1.5 with a center located 0.5 below the original right circular cylinder's intersecting centers, or axes.

The required surface may be left open so as to create an eye-shaped corner ceiling window at the corners of orthogonally intersecting vertical walls. This eye-shaped section may be framed with a rigid support to provide additional strength. This eye shaped section may also be made of solid material for maximum support. This eye-shaped section may be made of triangular geodesic bricks (see U.S. Pat. No. 5,261,194) which comprise a sphere of radius 1.5 relative to the original cylinder's radius of 1 which are cut or sectioned to meet with the required edge.

As will also be appreciated by those skilled in the art, two orthodesic cylinders of radius 1 which meet at a turn create an edge (opposite of the contiguous intersecting edges) which is substantially shared with the edge of a sphere of radius 1.5 which has a center 0.5 below the inter section of the axes of cylinders. Thus two intersecting orthodesic cylinders may merge into a section of a larger sphere.

Figure 66:
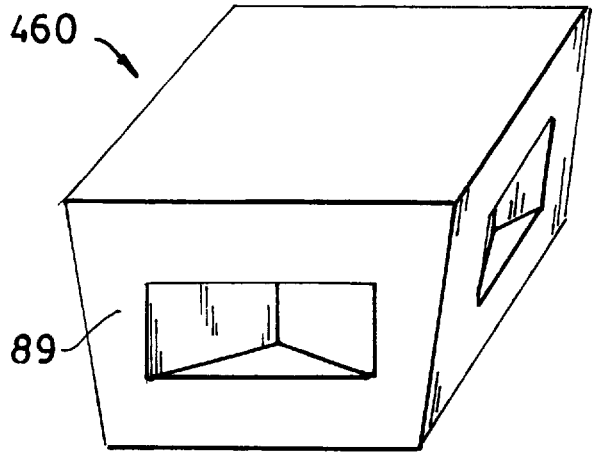
FIG. 66 is a perspective view of another building block of the invention.
Figure 67:
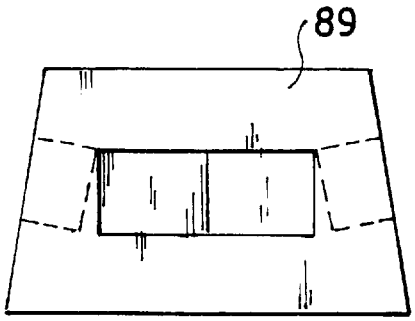
FIG. 67 is an end view of the block shown in FIG. 66.
Figure 68:
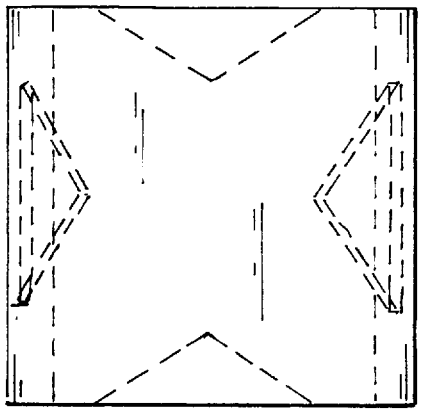
FIG. 68 is a top view of the block of FIG. 66.
Figure 69:
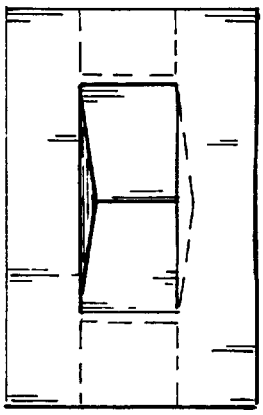
FIG. 69 is a side view of the block of FIG. 66.
Figure 78:
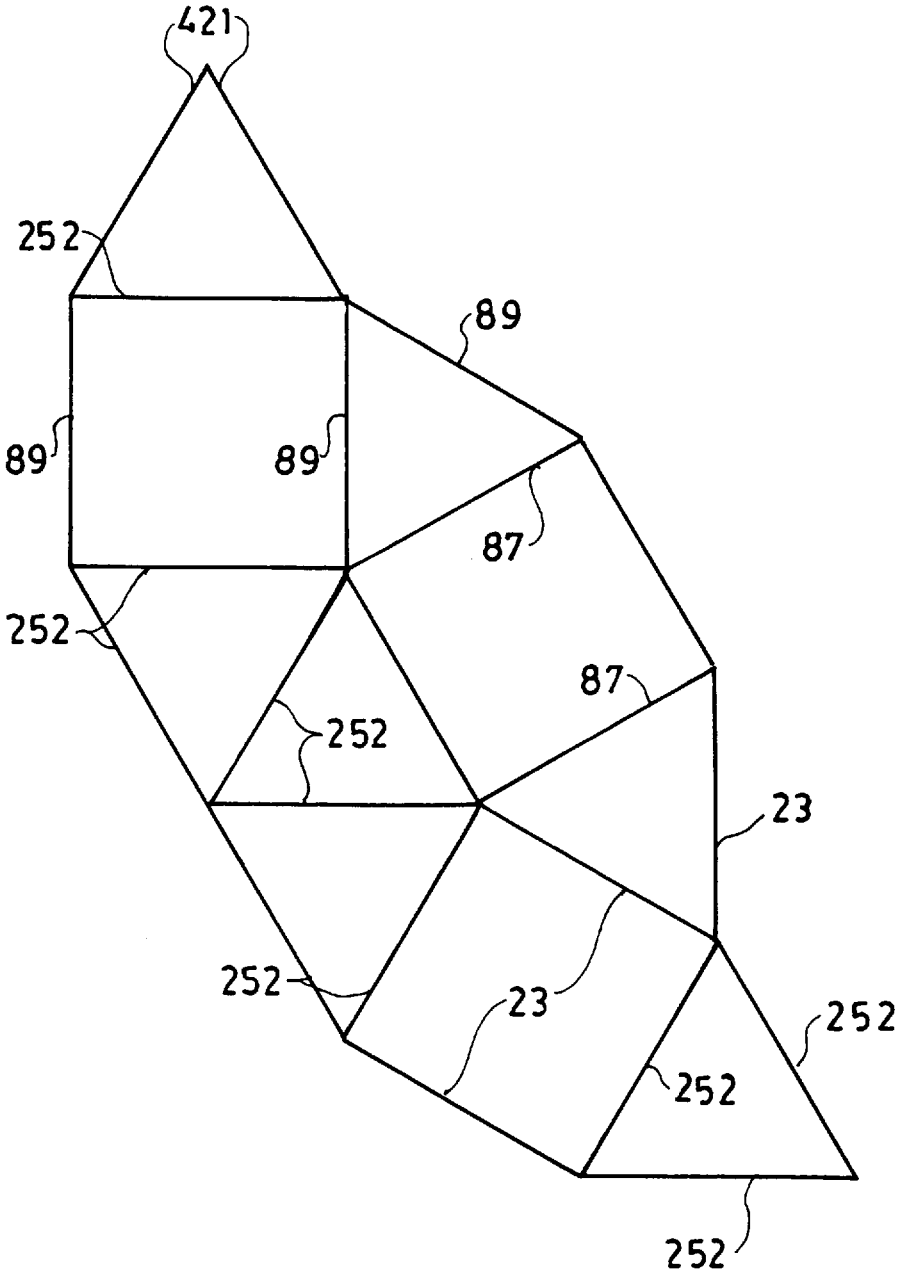
FIG. 78 is a schematic view showing the arrangement of building blocks in an expanded geodesic structure.
Figure 79:
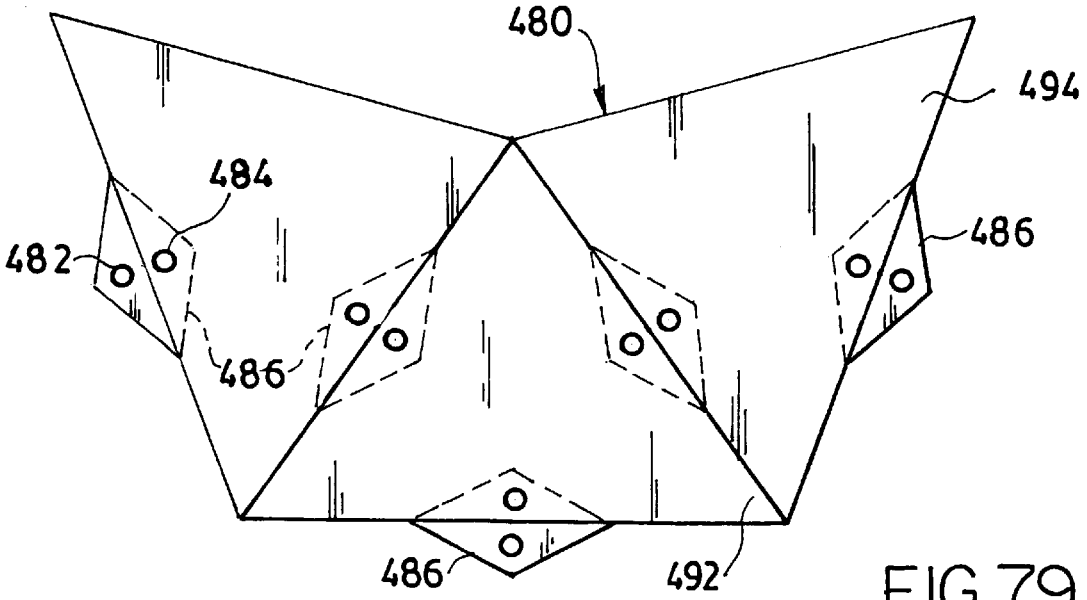
FIG. 79 is a front view of a building structure secured by a locking key.
Figure 81:
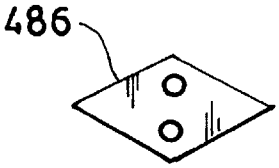
FIG. 81 is a top view of the key of FIG. 79.
Figure 83:
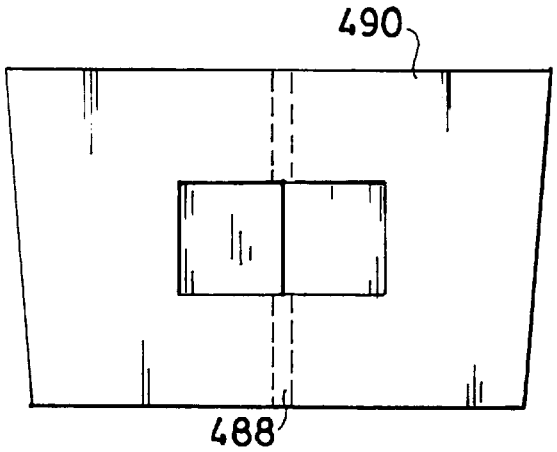
FIG. 83 is a side view of the block used in the structure of FIG. 79.
Figure 82:
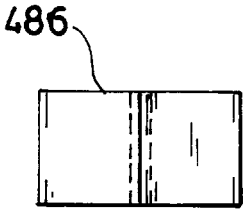
FIG. 82 is a side view of the key of FIG. 79.
Figure 80:
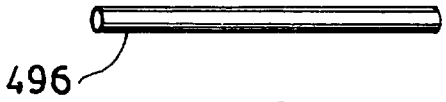
FIG. 80 is a perspective view of a rod used in conjunction with the key of FIG. 79.
Figure 84:
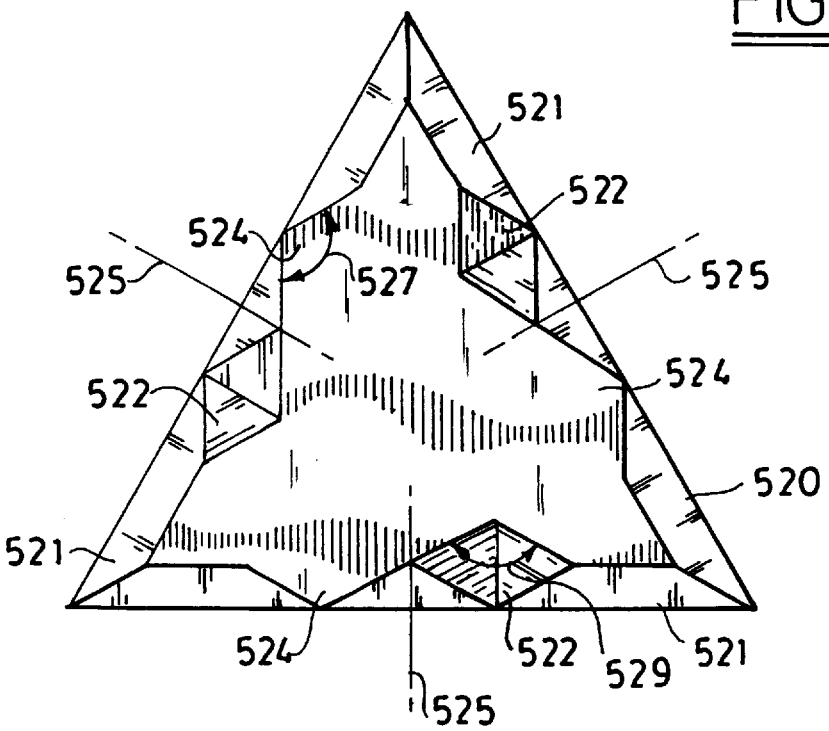
FIG. 84 is an end view of one hexagonal building block of this invention.
Figure 84A:
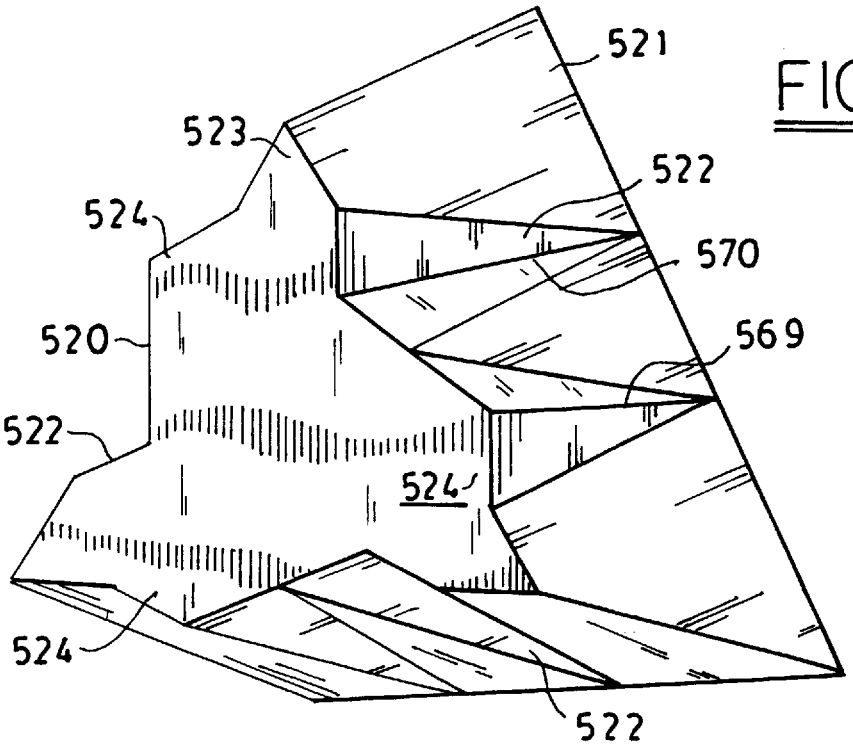
FIG. 84A is a perspective view of the block shown in FIG. 84.

As illustrated in FIGS. 63–78, the use of four unique block allows the geodesic dome structure to be expanded ad infinitum with additional straight wall blocks. The outer edge of an isosceles block which create pentagons (see FIG. 6, element 87, and also FIG. 70) shares a designation with two base edges of a rectangular beveled block 450 (see FIG. 66), hereafter called "out straight". The outer edge of the equilateral block which creates hexagons (element 87, FIG. 70) also shares a common designation with the same base edges of out straight 450. The inner edge of the isosceles block which create pentagons (see FIG. 6, element 89, and also FIG. 66, element 460) shares a designation with two base edges of a rectangular beveled block 60, hereafter called "pent straight". The inner edge of the equilateral block (element 23) which create hexagons share a designation with two base edges of a rectangular beveled block (element 470, FIG. 74) hereafter called "hex straight". The two edges of out straight and hex straight blocks which are not base edges all have the same designation which is on all three sides of the equilateral straight wall block (see FIG. 30, elements 252, 254, 256; also see FIGS. 73 and 77, elements 480). One edge of each pent straight block shares a designation with equilateral straight wall block. Five isosceles straight wall blocks fill the gap created by the five pent straight blocks.

Figure 64:
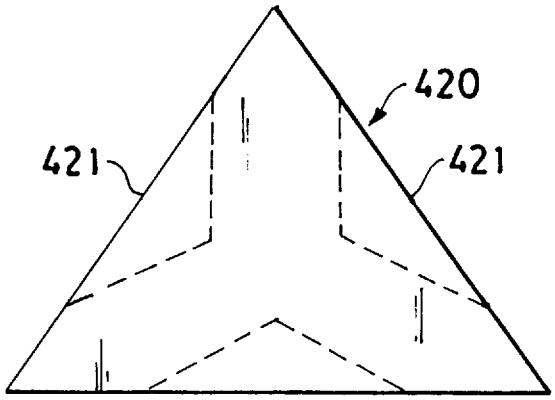
FIG. 64 is a front view of the block of FIG. 63.
Figure 65:
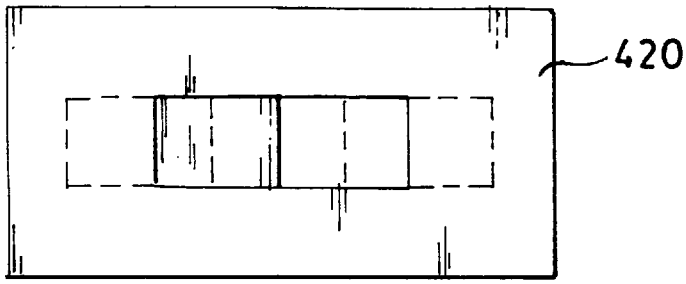
FIG. 65 is a side view of the block of FIG. 63.

The inner edges of the isosceles straight wall block all share a common designation (see FIG. 64, element 421).

The larger and smaller straight wall blocks may be added to the out straight and hex straight and pent straight blocks, respectively, to create larger structures ad infinitum (limited only by strength requirements). The straight wall blocks which construct flat surfaces on the geodesic may be altered so as to create peaked surfaces in the centers of the hexagons and pentagons which are closer to the surface of the sphere described by the geodesic than they would if they were left as flat surfaces.

The key to the block locking rod system is illustrated in FIGS. 79–82. Referring to these Figures, it will be seen that the system 480 may be configured so that there are two holes 482 and 484 in each diamond shaped key 486. These holes 482 and 484 are located so that they correspond with holes 488 and 490 in both blocks 492 and 494 which said key brings together. A rod 496 may be placed through this hole, so that this rod 496 will go through both the block and key 486, thus effectively locking the block and key together. This will result in a stronger structure, i.e., a structure which does not deflect as much under an applied load.

Interlocking Unit Shape for Trapezoidal Hexecontahedron

Figure 91:
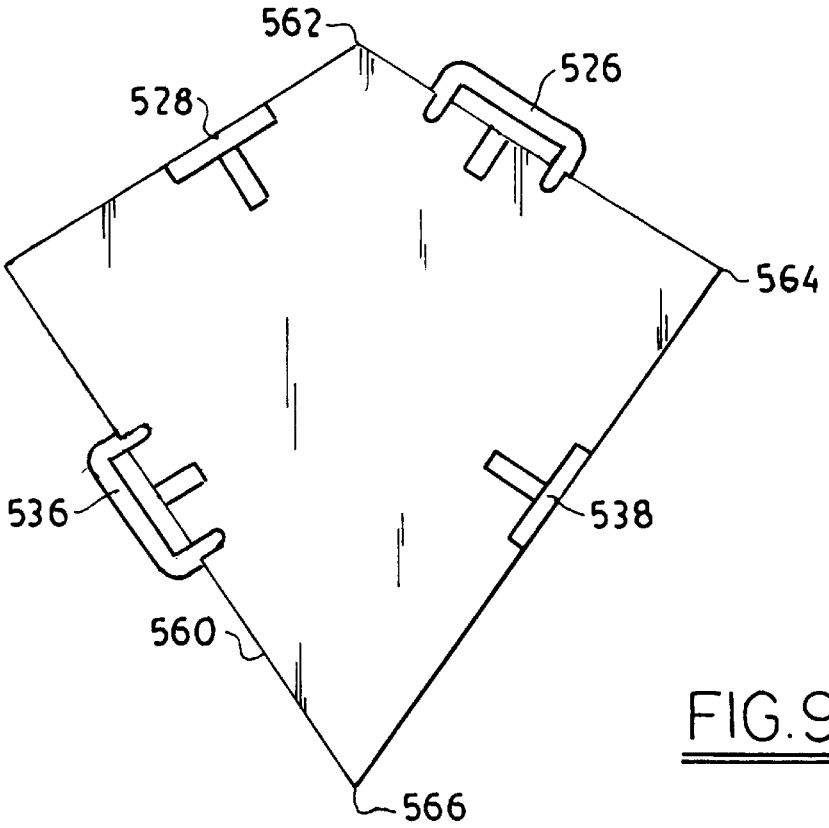
FIG. 91 is an end view of one kite shaped building block.

Certain advantages. are realized in the assembly of a spherical shell from unit shapes which describe a trapezoidal hexecontahedron 560, as shown in FIG. 91. Only one type of unit shape is required. This shape has four sides, instead of three as in a triangle. Thus two sides can be made as male, and two sides can be made as female, so no independent key is required.

The location of the two male keys and two female keyways are each equidistant from the center of the unit shape. This location is also the midpoint of those lines which describe a rhombicosidodecahedran polyhedra of the same mean radius as the trapezoidal hexecontahedron, its dual. For reference to this subject, see *Polyhedra Primer* by Peter and Susan Pearce, Van Nostrand, New York, 1978. p.65 and p.83.

Referring to FIG. 91, it will be apparent to those skilled in the art that a radial line drawn through the corner 562 is a three fold rotational axis of symmetry. That is, three corners 562 of three different shapes 560 meet in the tangent to the sphere so described at this point.

Referring again to FIG. 91, it will be apparent to those skilled in the art that a radial line drawn through the corner 564 is the intersection of two mirror planes. That is, four corners 564 of four different shapes 560 meet in the tangent to the sphere so described at this point.

Referring again to FIG. 91, it will be apparent to those skilled in the art that a radial line drawn through the corner 566 is a five fold rotational axis of symmetry. That is, five corners 566 of five different shapes 560 meet in the tangent to the sphere so described at this point.

Corners 562, 564 and 566 represent the juncture of 3, 4 and 5 different unit shapes, respectively. 3 multiplied by 4 is equal to 12, and 12 multiplied by 5 is equal to 60. There are 60 unit shapes in a trapezoidal hexecontahedron. Thus a trapezoidal hexecontahedron serves to tangibly demonstrate basic numerical and geometric properties to students of mathematics in a simple and straightforward manner. Thus a toy which utilizes sixty of the unit shapes 560 to assemble into a trapezoidal hexecontahedron serves as an educational tool. Furthermore, it will be apparent to those skilled in the art that a trapezoidal hexecontahedron possesses higher symmetry than a truncated icosahedron.

The two male keys 528 and 538 are in the shape of two different triangles, each of which describe the connecting edge lines of a rhombicosidodecahedron. It will be apparent to those skilled in the art that a rhombicosidodecahedron is a polyhedra composed of triangles, squares and pentagons. This allows the shorter key or plug 528 to lock into the respective shorter keyway orifice 526, and the longer key or plug 538 to lock into the respective longer keyway orifice 536, both without any undercut. That is, the unit shapes will simply slide and lock into position.

Both male plugs 538 and 528 are planar and parallel to each other and are also both parallel to a radial line drawn from the center of the unit shape, perpendicular to the tangent at the center of the unit shape. Accordingly, there is no undercut in the manufacture of the unit shape 560 in a two piece mold.

Figure 92:
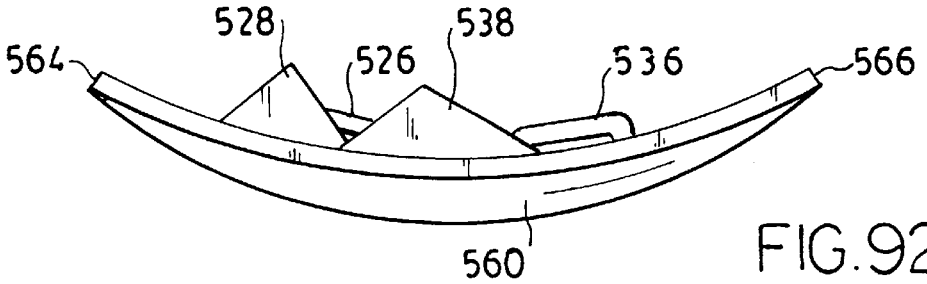
FIG. 92 is a side view of one kite shaped building block.
Figure 93:
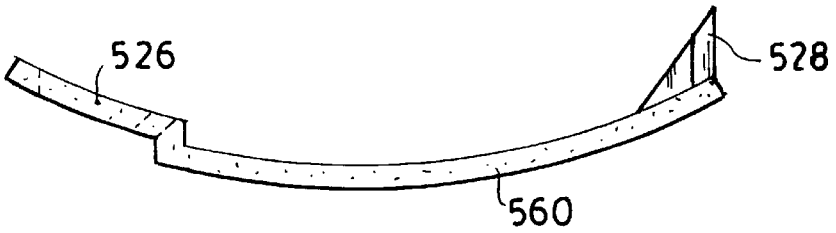
FIG. 93 is a sectional view of one kite shaped building block.
Figure 91A:
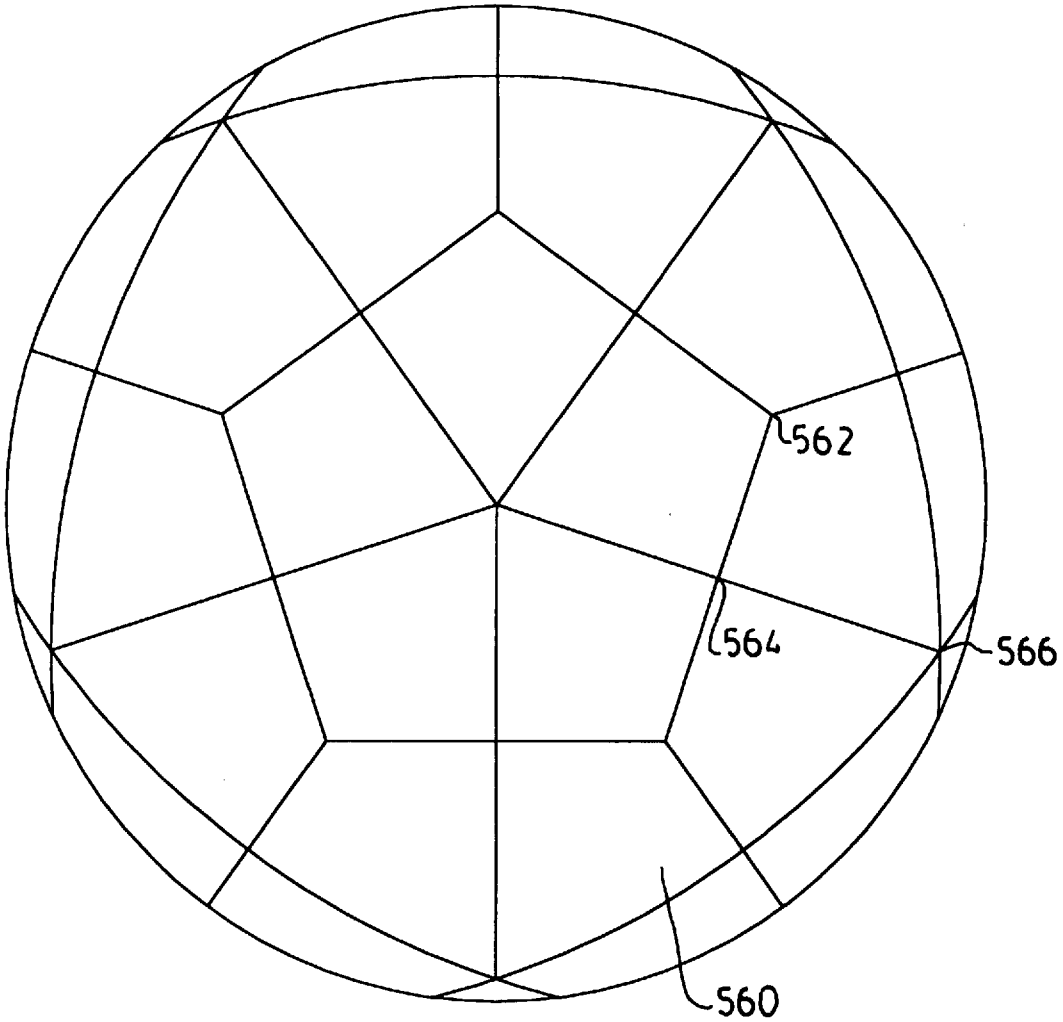

The unit shape 560 can be made with a radius of curvature to its outer surface, as shown in FIG. 92. Sixty of the shapes so made will construct a round sphere, wherein each of the edges of each unit shape 560 is a great circle arc of said sphere. This is a preferred embodiment for use as a sixty piece puzzle, the solution to which is a model of the planet earth, wherein the geographical features of the earth are shown on the outer curved surfaces of the sixty shapes.

It is also possible to make the unit shape 560 as a flat surface (not shown). Sixty of the shapes so made will construct a trapezoidal hexecontahedron with sixty flat planar surfaces.

The blocks of this invention (and of U.S. Pat. No. 5,329,737) may be used to construct spheres, domes, cylinders, vaulted arches and straight walls. These blocks may be made suitable for use as a children's toy by providing a simple and easy to follow construction method.

In the structures depicted herein it will be recognized that all straight wall blocks are equilateral and all edges share the same designation (see FIGS. 30, elements 254, 256,252).

In one embodiment each pair of abutting faces present in a geodesic structure share a unique designation. This is necessary when each block must be located in a specific location on the surface of the sphere. e.g., a dymaxion map of the earth printed on the outer surface of each geodesic block (as described in FIG. 13 of U.S. Pat. No. 5,261,194) would allow for the map to be assembled exactly. Such a system could also serve to display maps of all planetary bodies, moons, stars, solar systems, and galaxies.

The diamond shaped keys used in the block system described by U.S. Pat. No. 5,261,194 may be made with magnetic material. The key-ways for receiving the key in the edge of the triangular block may have a metal surface which will attract and bond to the magnetic material in the diamond-shaped key. This will result in a stronger joint between the key and block.

In another embodiment, the adjoining blocks are joined to each other by the use of "VELCRO" fasteners; these fasteners may be used in the place of, or in addition to, the other joining means described herein.

In another embodiment, a mold is provided with dimensions identical to the block to be manufactured. This mold may be filled with snow, or water, and either compressed or frozen to form ice blocks which then, in appropriate weather can be used to construct igloos or snow forts. Such scoops or molds may be hinged for simple release of the blocks from the mold.

In another embodiment, the blocks described herein may be made as a split (or bisected) block. These split blocks allow for the creation of a square or rectangular hole or opening which may be used as a door or window.

In another embodiment, the blocks of this invention, especially when they are constructed from plastic, may have a recess for accepting a key. This key may be diamond shaped, which fits into the recesses in the abutting faces of the blocks. This key may be a polygonal or circular disc, which fits into the recesses in the abutting tips of the blocks. For both diamond shaped keys and polygonal or circular disc keys, there may be a bubble shaped convex surface on the key which will serve to securely fasten the key to the block by creating a tight friction fit.

It will be apparent that the blocks and keys of this invention may be blow molded, so as to create a hollow block and key. This is especially desirable for larger structures (e.g.: domes larger than two feet across).

The blocks and keys of this invention may be made from a soft, foam type of elastomeric material (similar to Nerf material). This type of material is especially desirable for larger blocks to be used by children to build structures which may be entered. These types of structures may be safely collapsed or otherwise destroyed with minimal risk to children inside and around the structures.

The blocks which comprise this system may be built so that one or more of the abutting edge faces and/or inner and outer block faces will accept other toy construction sets. These faces may have receptacles for the acceptance of Lego, Bright Blocks, K'Nex, Polydron, Erector Sets, Lincoln Logs and other similar systems.

Description of Novel Blocks

Each of the three novel triangular blocks described in this specification (FIGS. 100, 102 and 104) is specifically similar to each of three of the triangular blocks described in earlier U.S. Pat. No. 5,261,194 and No. 5,329,737 (FIGS. 3, 7 and 19, respectively). The novel blocks (FIGS. 100, 102 and 104) differ from the blocks mentioned earlier (FIGS. 3, 7 and 19) in the means by which they are removably attached to one another, as will become clear upon reading the description below and upon examination of the relevant Figures.

None of the novel three blocks described here uses an independent diamond shaped key, as is the case with the four blocks with which they correspond; as described in U.S. Pat. No. 5,261,194 and No. 5,329,737 (see FIG. 12). Furthermore, none of the four novel blocks described here has an undercut. That is, they can each be made from a two piece mold, where the two visible portions of each block (which correspond to the two halves of a mold) are entirely visible from a line of sight perspective. This greatly simplifies the manufacturing process necessary to produce each of these four novel blocks. In contrast, the blocks described in U.S. Pat. No. 5,261,194 and No. 5,329,737 (FIGS. 3, 7, 19 and 24) each have half-diamond-shaped recesses in their abutting faces, thus creating an undercut and complicating their manufacture.

In U.S. Pat. No. 5,261,194 and No. 5,329,737, each of the triangular blocks as shown in FIGS. 3, 7, 19 and 24 requires an independently removable diamond shaped key 168 as shown in FIG. 13. Because a triangle has an odd number of sides (three), it is not possible to have an even number of male keys and an even number of female keyways, if the diamond key and half-diamond keyway are located in the center of the abutting faces, as shown in FIG. 12. Nonetheless, as described below, four substantially triangular blocks are arranged wherein an even number of male keys and female keyways are provided.

It will be apparent to those skilled in the art that the block shown in FIG. 102 is a hexagonal block, (item 690) similar to the block shown in FIG. 3, item 20. Six of the blocks 690 can be assembled into a hexagon 12 as shown in FIG. 1; similar to the arrangement created with the six blocks 20, 22, 24, 26, 28 and 30.

Referring to FIG. 103, each of the three abutting faces 692 of block 690 is divided in half by an inverse mirror plane 720 which is normal to the plane of face 692. That is, if a male plug 710 is on the right side of the inverse mirror plane 720, then a female orifice 700 must be on the left side of 720. Both 710 and 700 will be the same size, and both 710 and 700 will be the same distance from the inverse mirror plane 720. Furthermore, an additional inverse mirror plane 750 is provided in this invention for block 690. This inverse mirror plane 750 is at a right angle to the inverse mirror plane 720, and also lies in each of the three abutting surfaces 692 of block 690.

Referring to FIG. 102, the angle 694 (as taken at the plane normal to the linear crest 612 of the key 710) is 120 degrees. Furthermore, the angle 614 (as taken at the plane normal to the linear trough of the keyway 700) is also 120 degrees. Thus the half-diamond-shaped male key 710 of block 690 fits into the half-diamond-shaped orifice 700 of the next adjacent block. This interlocking feature was previously accomplished in U.S. Pat. Nos. 5,261,194 and 5,329,737 by using an independent, removable diamond shaped key 168, as shown in FIG. 12.

The linear crests of three of the six half-diamond-shaped plugs corresponds with the linear axis of mold movement and also with the direction of mold separation, such that no undercut is created in producing blocks 690.

Figure 85:
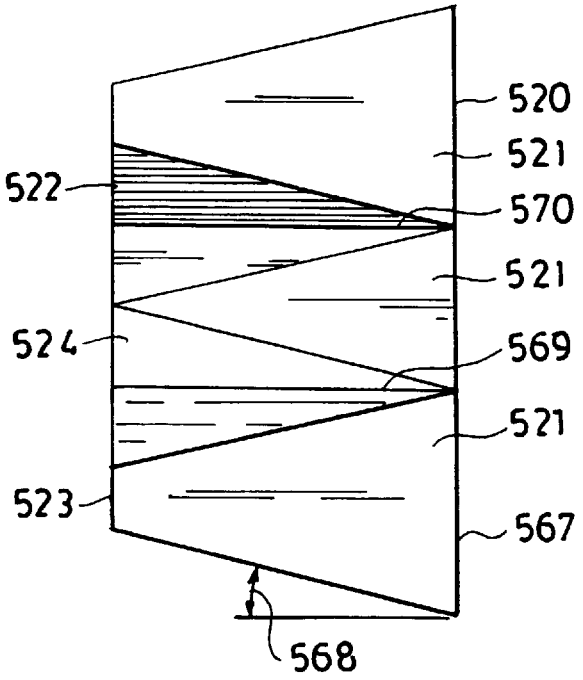
FIG. 85 is a side view of one hexagonal building block of this invention.
Figure 86:
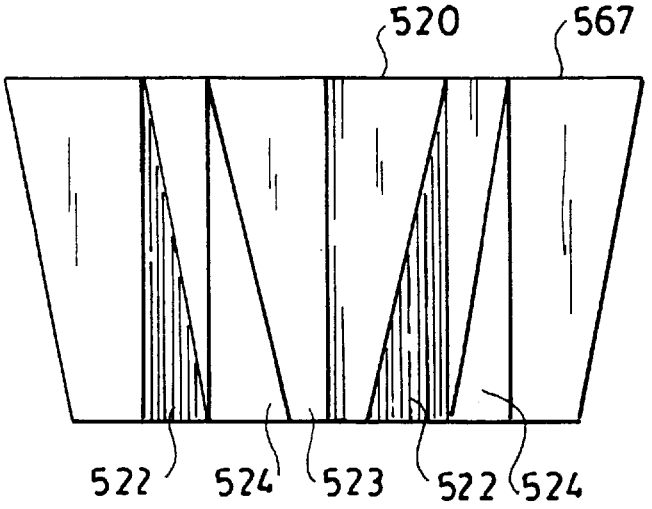
FIG. 86 is a top view of one hexagonal building block of this invention.
Figure 87:
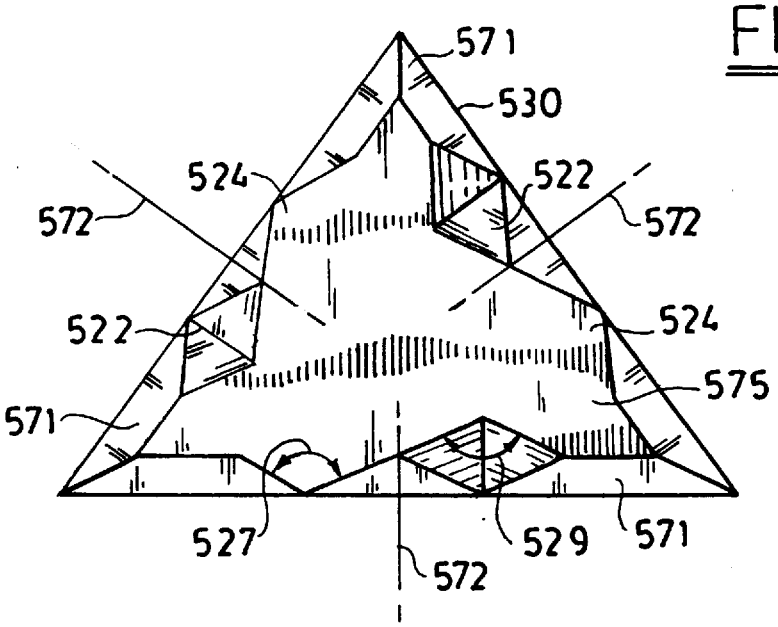
FIG. 87 is an end view of one pentagonal building block of this invention.
Figure 87A:
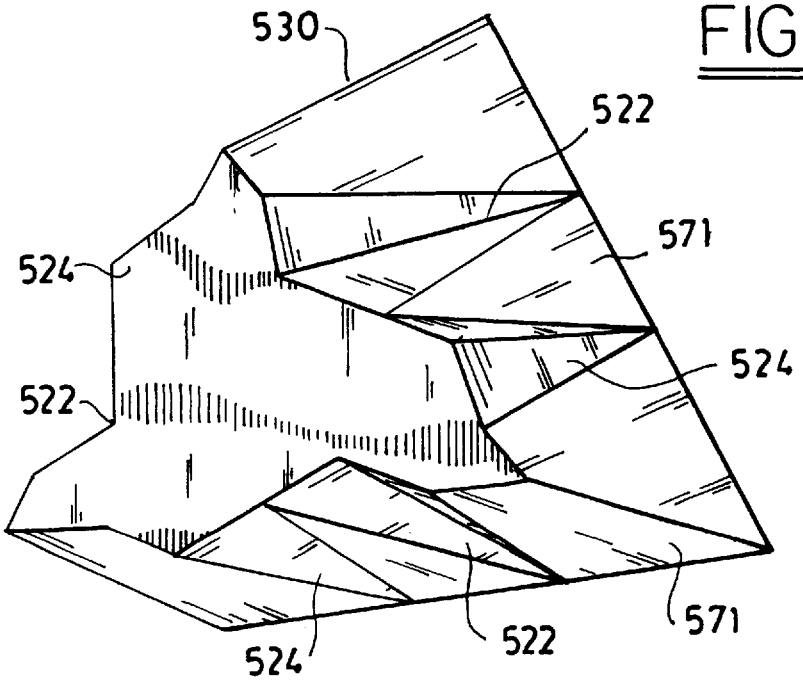
FIG. 87A is a perspective view of the block shown in FIG. 87.
Figure 88:
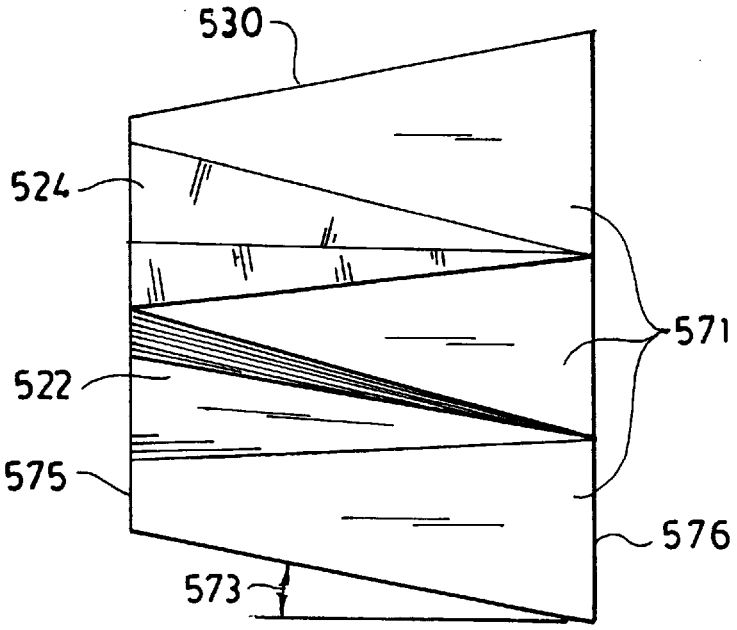
FIG. 88 is a side view of one pentagonal building block of this invention.
Figure 89:
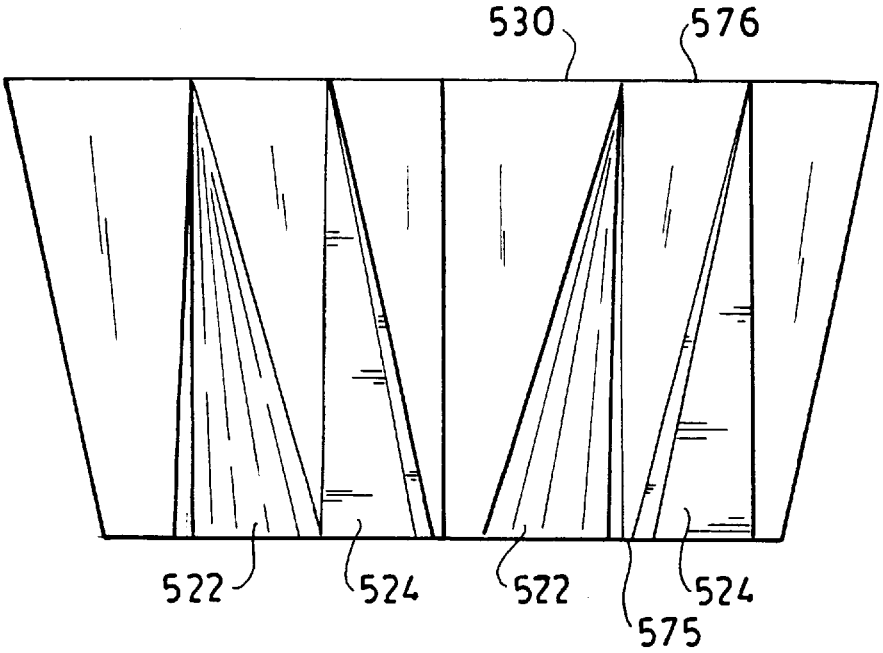
FIG. 89 is a top view of one pentagonal building block of this invention.

Referring to FIG. 85, it will be apparent to those skilled in the art that the three abutting faces 521 of hexagonal block 690 are each at a beveled angle 568 between the inside face 730 (not shown) and the outside face 740 (not shown) so as to create a block which tapers inward along its abutting faces. Hexagonal blocks 520 and 690 are exactly similar in this respect; they share beveled angle 568.

Referring to FIG. 103, the linear crests 613 of each of the half-diamond-shaped male plugs 710 which abut inner face 730 are normal to (in one plane of) the inside face 730 and normal to (in one plane of) the outside face 740 of block 690. The altitudes of the half-diamond-shaped crests 710 start at a minimum at their intersection with inverse mirror plane 750, and increase at a slope which is equal to angle 588, until each plug, or key, reaches its maximum altitude at inside face 589.

The linear trough lines 616 are also at an angle 588 with abutting faces 584. The depth of the half-diamond-shaped troughs 700 each starts at a maximum at their intersection with the edge of outside face 740, and decreases at a slope which is equal to angle 588, until each trough reaches its minimum depth at inverse mirror plane 750.

It will be apparent to those skilled in the art that the block shown in FIG. 100 is a pentagonal block, (item 600) similar to the block shown in FIG. 7, item 84. Five of the blocks 600 can be assembled into a pentagon 14 as shown in FIG. 1; similar to the arrangement created with the five blocks 84, 86, 88, 90 and 92.

Referring to FIG. 100, each of the three abutting faces 622 of block 600 is divided in half by an inverse mirror plane 630 which is normal to the plane of face 622. That is, if a male plug 620 is on the right side of the inverse mirror plane 630, then a female orifice 610 must be on the left side of 630. Both 610 and 620 will be the same size, and both 610 and 620 will be the same distance from the inverse mirror plane 630. Furthermore, an additional inverse mirror plane 660 is provided in this invention for block 600. This inverse mirror plane 660 is at a right angle to the inverse mirror plane 630, and also lies in each of the three abutting surfaces 622 of block 600.

Referring again to FIG. 100, the angle 694 (as taken at the plane normal to the linear crest 612 of the key 610) is 120 degrees. Furthermore, the angle 614 (as taken at the plane normal to the linear trough of the keyway 610) is also 120 degrees. Thus the half-diamond-shaped male key 620 of block 600 fits into the half-diamond-shaped orifice 610 of the next adjacent block. This interlocking feature was previously accomplished in U.S. Pat. Nos. 5,261,194 and 5,329,737 by using an independent, removable diamond shaped key 168, as shown in FIG. 12.

The linear crests of three of the six half-diamond-shaped plugs corresponds with the linear axis of mold movement and also with the direction of mold separation, such that no undercut is created in producing blocks 530.

Referring to FIG. 85, it will be apparent to those skilled in the art that the three abutting faces 521 of pentagonal block 520 are each at a beveled angle 568 between the inside face 523 (not shown) and the outside face 567 (not shown) so as to create a block which tapers inward along its abutting faces. Pentagonal blocks 520 and 600 are exactly similar in this respect; they share angle 568.

Referring to FIG. 101, the linear crests 613 of each of the half-diamond-shaped male plugs 620 which abut inner face 640 are normal to (in one plane of) the inside face 640 and normal to (in one plane of) the outside face 650 of block 600. The altitudes of the half-diamond-shaped crests 620 start at a minimum at their intersection with inverse mirror plane 660, and increase at a slope which is equal to angle 568, until each plug, or key, reaches its maximum altitude at inside face 640.

The linear trough lines 616 are also at an angle 568 with abutting faces 622. The depth of the half-diamond-shaped troughs 610 each starts at a maximum at their intersection with the edge of outside face 650, and decreases at a slope which is equal to angle 568, until each trough reaches its minimum depth at inverse mirror plane 660.

It will be apparent to those skilled in the art that the block shown in FIG. 104 is a flat top block, (item 780) similar to the block shown in FIG. 19, item 204. From three to any larger multiple number of the blocks 780 can be assembled together with an equal number of parallelogram blocks 550 into a right circular cylinder 200 as shown in FIG. 18.

Referring to FIG. 104, each of the two abutting faces 802 and the one abutting face 804 of block 780 are divided in half by inverse mirror planes 822 and 823 which are normal to the plane of faces 802 and 804, respectively. That is, if a male plug 800 is on the right side of the inverse mirror plane 822, then a female orifice 790 must be on the left side of 822. Both 790 and 800 will be the same size, and both 790 and 800 will be the same distance from the inverse mirror plane 822.

Referring to FIG. 104, the angle 694 (as taken at the plane normal to the linear crest 612 of the key 800) is 120 degrees. Furthermore, the angle 616 (as taken at the plane normal to the linear trough of the keyway 790) is also 120 degrees. Thus the half-diamond-shaped male key 800 of block 780 fits into the half-diamond-shaped orifice 790 of the next adjacent block. This interlocking feature was previously accomplished in U.S. Pat. Nos. 5,261,194 and 5,329,737 by using an independent, removable diamond shaped key 168, as shown in FIG. 17.

The linear crests of three of the six half-diamond-shaped plugs corresponds with the linear axis of mold movement and also with the direction of mold separation, such that no undercut is created in producing blocks 780.

Referring to FIG. 96, it will be apparent to those skilled in the art that the two abutting faces 577 of flat top block 540 are each at a beveled angle 581 between the inside face 582 and the outside face 583 (not shown) so as to create a block which tapers inward along two of its abutting faces. Flat top blocks 540 and 780 are exactly similar in this respect; they share angle 581.

The linear crests 613 of each of the half-diamond-shaped male plugs 800 and 820 are parallel to the plane of flat top 829. The altitudes of the half-diamond-shaped crests 800 start at a maximum at their intersection with the edge of outside face 590, and increase at a slope which is equal to angle 581, until each plug, or key, reaches its minimum altitude at inverse mirror plane 824.

The linear trough lines 616 are also at an angle 581 with abutting faces 802. The depth of the half-diamond-shaped troughs 790 each starts at a maximum at their intersection with the edge of outside face 828, and increases at a slope which is equal to angle 581, until each trough reaches its minimum depth at inverse mirror plane 824.

Referring to FIG. 104, it is apparent that the bottom side 804 of block 780 does not bevel, as do the two sides 802 of block 780. Since side 804 does not bevel, the orifice, or keyway 810 on side 804 does not taper, but is a straight through half-diamond-shaped orifice of constant height from the inside face 826 to the inverse mirror plane 823 at the center of face 804. The orifice 810 continues on the opposite side of inverse mirror plane 823, and goes from the center of face 804 to the outside face 828 (not shown). Similarly, the plug, or key 820 on side 804 does not taper, but is a straight through half-diamond-shaped key of constant height from the inside face 826 to the inverse mirror plane 823 at the center of face 804. The half-diamond-shaped key 820 continues on the opposite side of inverse mirror plane 823, and goes from the center of face 804 to the outside face 828 (not shown).

It will be apparent to those skilled in the art that the block shown in FIG. 97 is a parallelogram block, (item 550) similar to the block shown in FIG. 24, item 202. From three to any larger multiple number of the blocks 540 can be assembled together with an equal number of flat top blocks 540 into a right circular cylinder 200 as shown in FIG. 18.

Each of the abutting faces 584 and 586 of block 550 are divided in half by inverse mirror planes 585 and 587 which are normal to the plane of faces 584 and 586, respectively. That is, if a male plug 524 is on the right side of the inverse mirror plane 585, then a female orifice 522 must be on the left side of 585. Both 524 and 522 will be the same size, and both 524 and 522 will be the same distance from the inverse mirror plane 585.

Referring to FIG. 97, the angle 527 (as taken at the plane normal to the linear crest 569 of the key 524) is 120 degrees. Furthermore, the angle 529 (as taken at the plane normal to the linear trough of the keyway 522) is also 120 degrees. Thus the half-diamond-shaped male key 524 of block 550 fits into the half-diamond-shaped orifice 522 of the next adjacent block. This interlocking feature was previously accomplished in U.S. Pat. Nos. 5,261,194 and 5,329,737 by using an independent, removable diamond shaped key 168, as shown in FIG. 17.

Figure 97A:
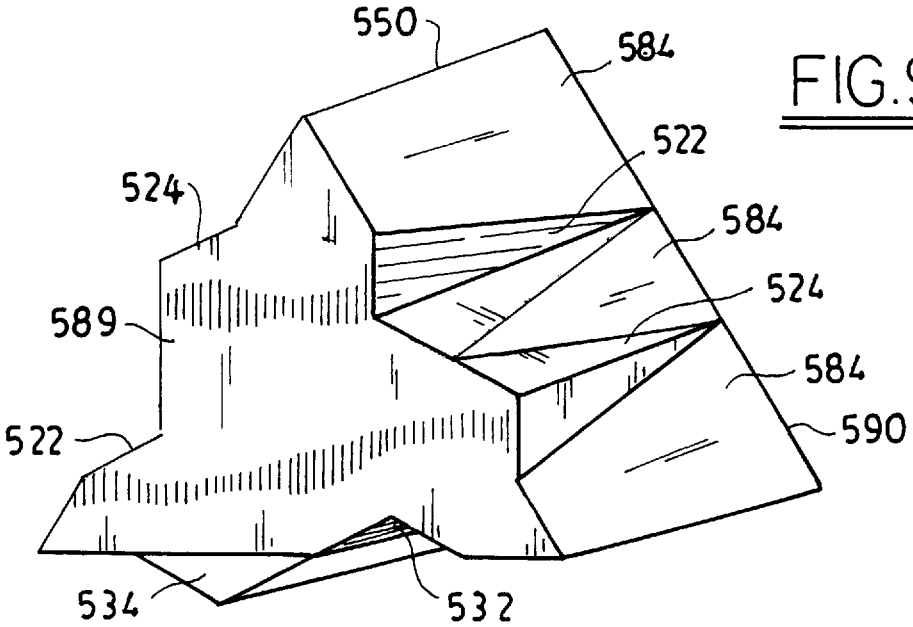
Figure 98:
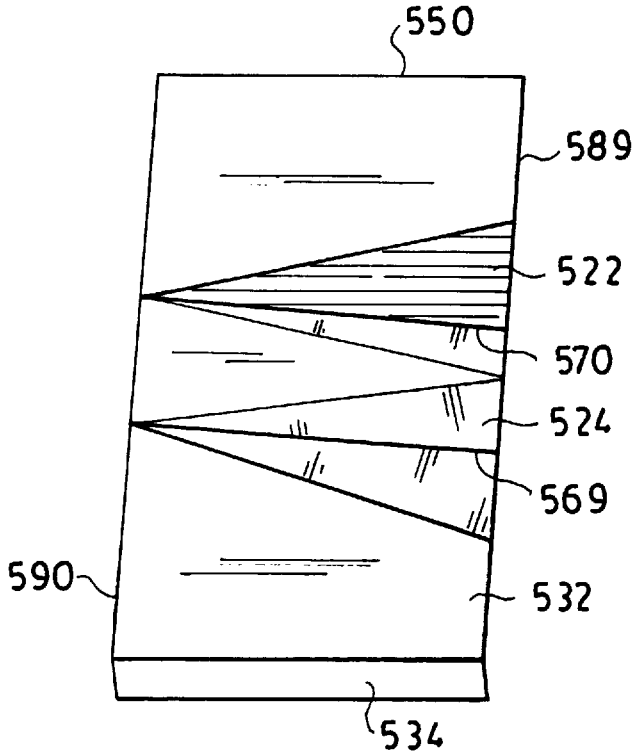
FIG. 98 is a side view of a second preferred building block which may be used to construct the structure of FIG. 17.
Figure 99:
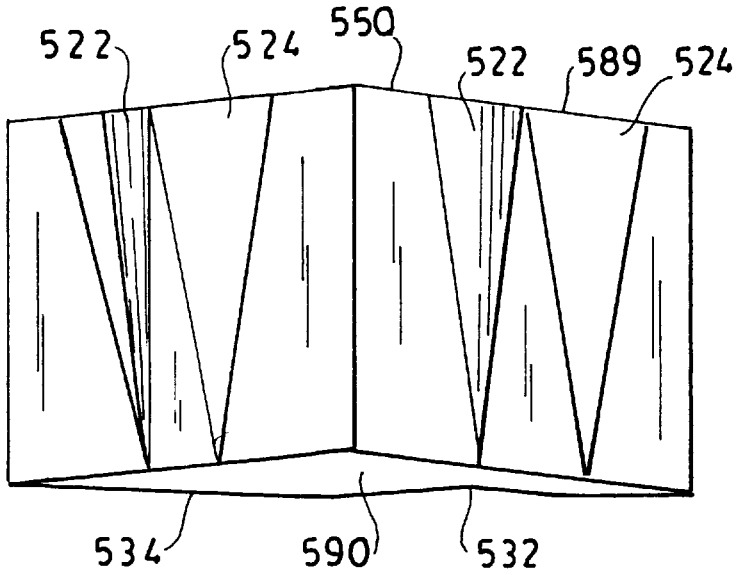
FIG. 99 is a top view of a second preferred building block which may be used to construct the structure of FIG. 17.

Referring to FIG. 97A, it will be apparent to those skilled in the art that the two abutting faces 584 of parallelogram block 550 are each at a beveled angle 588 between the inside face 589 (not shown) and the outside face 590 (not shown) so as to create a block which tapers inward along two of its abutting faces. The linear crests 569 of each of the half-diamond-shaped male plugs 524 are normal to (in one plane of) the inside face 582 and normal to (in one plane of) the outside face 583 of block 540. The altitudes of the half-diamond-shaped crests 524 start at zero at their intersection with the edge of outside face 590, and increase at a slope which is equal to angle 588, until each plug, or key, reaches its maximum altitude at inside face 589.

The linear trough lines 570 are also at an angle 588 with abutting faces 584. The depth of the half-diamond-shaped troughs 522 each starts at zero at their intersection with the edge of outside face 590, and increases at a slope which is equal to angle 588, until each trough reaches its maximum depth at inside face 589.

Referring to FIG. 97A, it is apparent that the bottom side 586 of block 550 does not bevel, as do the two sides 584 of block 550. Since side 586 does not bevel, the orifice, or keyway 532 on side 586 does not taper, but is a straight through half-diamond-shaped orifice of constant height from the inside face 589 to the outside face 590. Similarly, the plug, or key 534 on side 586 does not taper, but is a straight through half-diamond-shaped key of constant height from the inside face 589 to the outside face 590.

Alternately, the parallelogram block can be configured so as to fit together with the flat top block as shown in FIG. 104. Said parallelogram block (not shown) has two inverse mirror planes at right angles to each other on each of its three abutting faces.

I claim:

1. An arcuate building structure comprised of a first five-sided building block adjacent to and abutting a first six-sided building block, a second five-sided building block, a third five-sided building block, a second six-sided building block and a third six-sided building block wherein:

(a) said first six-sided building block, is comprised of a first top side, a first front side, a first back side, a first left side, a first right side, and a first bottom side, wherein:

1. said first top side has a substantially triangular shape with at least two sides, wherein at least two of said sides of such triangular shape are equal, and said first top side is substantially parallel to said first bottom side,
2. said first front side has a substantially trapezoidal shape comprising a top edge, a bottom edge, a right edge, and a left edge, wherein said right edge and said left edge have equal lengths and form equal angles with said bottom edge,
3. said first back side has a substantially triangular shape with at least two sides equal in length to each other,
4. said first left side and said first right side have shapes which are congruent, and each of said first left side and said first right side are in the shape of a parallelogram with walls and comprise two substantially triangular-shaped recesses and two substantially triangular-shaped projections disposed between said walls of said parallelogram, and
5. said first bottom side has a substantially trapezoidal shape and is comprised of two substantially triangular recesses and two substantially triangular-shaped projections disposed between the walls of such trapezoidal shape, and
6. first left side and first right side comprise two substantially triangular-shaped plugs disposed between the walls of said parallelogram, and
7. one of each of two said triangular projections which is adjacent to said back side has a linear crest which is at a substantially right angle to said front side and said back side,
8. said projections contain one substantially obtuse angle of about 120 degrees,
9. said recesses contain one substantially obtuse angle of about 120 degrees, (b) each of said first five-sided building block, said second five-sided building block, and said third five-sided building block is comprised of a second top side, a second front side, a second back side, a second right side, and second left side, wherein:

1. said second top side has a substantially rectangular shape and comprises two substantially triangularly shaped recesses and two triangular-shaped projections disposed within said substantially rectangular shape,
2. said second left side and said second right side are congruent with each other and are also congruent with said first left side and said first right side,
3. said second front side is congruent with both said second back side and said first back side; and (c) one of each of two said triangular projections which is adjacent to said back side has a linear crest which is at a substantially right angle to said front side and said back side, (d) said projections contain one substantially obtuse angle of about 120 degrees, (e) said recesses contain one substantially obtuse angle of about 120 degrees.

2. The arcuate building structure as recited in claim 1, wherein each of said first five-sided building block, said first six-sided building block, said second five-sided building block, said second six-sided building block, said third five-sided building block, and wherein each of said third six-sided building block consists essentially of ceramic material.

3. The arcuate building structure as recited in claim 1, wherein each of said first five-sided building block, said first six-sided building block, said second five-sided building block, said second six-sided building block, said third five-sided building block, and said third six-sided building block consists essentially of plastic material.

4. The arcuate building structure as recited in claim 1, wherein each of said first five-sided building block, said first six-sided building block, said second five-sided building block, said second six-sided building block, said third five-sided building block, and said third six-sided building block consists essentially of metal material.

5. The arcuate building structure as recited in claim 1, wherein said arcuate building structure is comprised of at least fifteen of said five-sided building blocks.

6. The arcuate building structure as recited in claim 5, wherein said arcuate building structure is comprised of at least fifteen of said six-sided building blocks.

7. The arcuate structure as recited in claim 6, where the number of said five-sided building blocks in said structure is equal to the number of said six-sided building blocks in said structure.

8. A building structure comprised of a plurality of building blocks connected to each other by a plurality of integrally connected blocks, recesses and projections wherein:

(a) each of said building blocks is an integral building block with a substantially triangular cross-sectional shape, wherein each of said integrally connected ceramic building blocks is comprised of an outside face, an inside face, a first wall, a second wall, and a third wall;

(b) said outside face opposes said inside face and is connected to said inside face by said first wall, said second wall, and said third wall;

(c) said first wall is comprised of two triangular-shaped recesses and two triangular-shaped projections which are disposed between said outside face and said inside face;

(d) said second wall is comprised of two triangular-shaped recesses and two second triangular-shaped projections which are disposed between said outside face and said inside face;

(e) said third wall is comprised of two triangular-shaped recesses and two triangular-shaped projections which are disposed between said outside face and said inside face.

9. The building structure as recited in claim 8, wherein each of said building blocks consists essentially of ceramic material.

10. The building structure as recited in claim 8, wherein each of said building blocks consists essentially of plastic material.

11. The building structure as recited in claim 8, wherein each of said building blocks consists essentially of metal material.

12. An arcuate structure comprised of a plurality of six-sided building blocks connected to each other by a plurality of recesses and projections wherein:

1. each of said building blocks is an integral building block with a substantially trapezoidal cross-sectional shape, wherein said integral building block is comprised of an outside face, an inside face, a first wall, a second wall, a third wall, and a fourth wall, and
2. said outside face opposes said inside face and is connected to said inside face by said first wall, said second wall, said third wall and said fourth wall, and
3. said first wall is comprised of a first planar projection which is substantially perpendicular to said outside wall and said inside wall, and
which points inward, towards said inside wall, and
4. said first planar projection is located on said first wall with a center at a position where a straight line drawn perpendicular to said first wall on said inside face will go through the center of said inside face, and
5. said second wall is comprised of a first receptacle with a hole to accept said first planar projection from the nearest adjacent block, and
6. said first receptacle is at a substantially acute angle to said outside wall and to said inside wall, and
7. said first receptacle is located on said second wall with a center at a position where a straight line drawn perpendicular to said second wall on said inside face will go through the center of said inside face, and
8. said third wall is comprised of a second planar projection which is substantially perpendicular to said outside wall and said inside wall, and which points inward, towards said inside wall, and
9. said second planar projection is located on said third wall with a center at a position where a straight line drawn perpendicular to said first wall on said inside face will go through the center of said inside face, and
10. said fourth wall is comprised of a second receptacle with a hole to accept said second planar projection from the nearest adjacent block, and
11. said second receptacle is at a substantially acute angle to said outside wall and to said inside wall, and
12. said second receptacle is located on said fourth wall with a center at a position where a straight line drawn perpendicular to said second wall on said inside face will go through the center of said inside face, and
13. said building structure is comprised of sixty building blocks, and
14. said building structure is comprised of a trapezoidal hexecontahedron.

* * * * *